US005945959A

United States Patent [19]

Tanidokoro et al.

[11] Patent Number: 5,945,959

[45] Date of Patent: Aug. 31, 1999

[54] SURFACE MOUNTING ANTENNA HAVING A DIELECTRIC BASE AND A RADIATING CONDUCTOR FILM

[75] Inventors: Hiroaki Tanidokoro; Takeshi Aso, both of Yokozemachi; Naohisa Goto, Hachioji, all of Japan

[73] Assignee: Mitsubishi Materials Corporation, Tokyo, Japan

[21] Appl. No.: 08/928,143

[22] Filed: Sep. 12, 1997

[30] Foreign Application Priority Data

| | | | |
|---|---|---|---|
| Sep. 12, 1996 | [JP] | Japan | 8-241686 |
| Sep. 26, 1996 | [JP] | Japan | 8-254100 |
| Oct. 15, 1996 | [JP] | Japan | 8-272653 |
| Oct. 15, 1996 | [JP] | Japan | 8-272654 |
| Oct. 18, 1996 | [JP] | Japan | 8-276143 |
| Oct. 18, 1996 | [JP] | Japan | 8-276144 |
| Mar. 28, 1997 | [JP] | Japan | 9-077982 |
| Mar. 28, 1997 | [JP] | Japan | 9-077983 |

[51] Int. Cl.[6] ..... H01Q 21/00

[52] U.S. Cl. ..... 343/728; 343/700 MS; 343/702; 343/741

[58] Field of Search ..... 343/700 MS, 702, 343/725, 728, 741, 742, 866, 867, 873, 846, 848

[56] References Cited

U.S. PATENT DOCUMENTS

| | | | |
|---|---|---|---|
| 5,300,936 | 4/1994 | Izadian | 343/700 MS |
| 5,581,262 | 12/1996 | Kawahata et al. | 343/700 MS |
| 5,633,646 | 5/1997 | Strickland | 343/700 MS |
| 5,646,633 | 7/1997 | Dahlberg | 343/700 MS |
| 5,696,517 | 12/1997 | Kawabatw et al. | 343/700 MS |
| 5,748,149 | 5/1998 | Kawabata | 343/700 MS |

*Primary Examiner*—Don Wong
*Assistant Examiner*—Tan Ho
*Attorney, Agent, or Firm*—Oblon, Spivak, McClelland, Maier & Neustadt, P.C.

[57] ABSTRACT

An antenna device including a radiating conductor film having two ends adjacent to each other and connecting the two ends in a loop-like shape, formed on an upper face of a dielectric base body in a rectangular parallelepiped shape having the upper face and a lower face in a square shape in parallel with each other, a grounding conductor film extending in a planar shape formed on the lower face of the dielectric base body, and feeding conductor films and respectively connected to the two ends of the radiating conductor film 12. The feeding conductor films extend in the up and down direction in parallel with each other one of which is connected to the grounding conductor film, are formed on a side face of the dielectric base body 11. The antenna device has high directivity and efficiently transmits and receives electromagnetic waves used in communication.

23 Claims, 36 Drawing Sheets

SURFACE MOUNTING ANTENNA HAVING A DIELECTRIC BASE AND A RADIATING CONDUCTOR FILM

BACKGROUND OF THE INVENTION

1. Field of the Invention

The present invention relates to an antenna device used in portable communication devices. The present invention is more particularly related to an antenna device used in a portable communication device that can be mounted to a circuit board of the portable communication device, and provides a maximum gain in a direction not toward a user of the portable communication device.

2. Description of the Related Art

An antenna device which is small-sized, having high gain, fabricated at low cost and easy to mount has been long needed as an antenna device for use in portable communication devices. Unfortunately, conventional linear antennas such as dipole antennas, monopole antennas, etc., are of large volume which hampers downsizing of a communication device. Furthermore, such antennas are not easily mounted to a main body of a communication device and therefore a communication device equipped therewith is difficult to use and less portable.

Several antennas have been proposed to resolve such problems.

FIG. 65 is a perspective view showing an antenna device proposed in Japanese Unexamined Patent Publication No. JP-A-7-235825.

A radiating conductor film 992 is formed on the entire upper face of a dielectric substrate 991 constituting an antenna device 990. A grounding film 993 is formed on the lower face of the dielectric substrate 991. The grounding conductor film 993 has a shape where a portion of one of two short sides is notched and an exciting conductor film 994 is formed at the notched portion. A feed electrode 995 is formed at a side face of the dielectric substrate 991 and the feed electrode 995 is connected to the exciting conductor film 994. Ground electrodes 996 and 997 are formed to interpose the feed electrode 995 at the side face of the dielectric substrate 991 and the ground electrodes 996 and 997 are connected to the grounding conductor film 993. Further, a through hole 998 having a conductor at an inner wall thereof is formed in the dielectric substrate 991. And the radiating conductor film 992 and a front end portion of the exciting conductor film 994 are electrically connected by the through hole 998.

The antenna device 990 constituted as described above is mounted on the surface of a circuit board incorporated in the main body of a communication device, high frequency power is supplied from the main body of the communication device to the radiating conductor film 992 via the feed electrode 995, the exciting conductor film 994 and the through hole 998. Electromagnetic waves are radiated to air from the radiating conductor film 992 by an electromagnetic coupling between the exciting conductor film 994 and the radiating conductor film 992.

FIG. 66 is a perspective view showing an antenna device proposed by Japanese Unexamined Patent Publication No. JP-A-7-283639.

A through hole 1102 constituting a radiating conductor film at its inner wall is formed in a dielectric base body 1101 constituting an antenna device 1100. A surface electrode 1103 is formed on the surface of the dielectric base body 1101 and a connector external conductor plate 1104 is attached to the rear face thereof. The surface electrode 1103 and the connector external conductor plate 1104 are electrically connected by the radiating conductor film formed on the inner wall of the through hole 1102. Further, a coaxial connector 1105 is attached to a face of the connector external conductor plate 1104 opposed to a face thereof on which the dielectric base body 1101 is attached. An external conductor and an internal conductor of the coaxial connector 1105 are electrically connected to the connector external conductor plate 1104 and the radiating conductor film in the through hole 1102, respectively.

The antenna device 1100 constituted as described above is arranged to the main body of a communication device by connecting the coaxial connector 1105 to a connector installed to the main body of the communication device. High frequency power is supplied from the main body of the communication device to the antenna device 1100 via the coaxial connector 1105 and electromagnetic waves are radiated from the radiating conductor film formed on the inner wall of the through hole 1102.

FIG. 67 is a perspective view showing an antenna device proposed by Japanese Unexamined Patent Publication No. JP-A-7-221537.

A through hole 1212 constituting a radiating conductor film at its inner wall is formed in a dielectric substrate 1211 constituting an antenna device 1210 in a direction of long side of the dielectric substrate 1211. A side face electrode 1213 is formed on an entire face of an end face of the dielectric substrate 1211, a feed electrode 1214 is formed at a central portion of the other end face and the side face electrode 1213 and the feed electrode 1214 are electrically connected by the radiating conductor film formed on the inner wall of the through hole 1212. Further, side face electrodes 1215 and 1216 are formed to interpose the feed electrode 1214 on the other end face of the dielectric substrate 1211 where the feed electrode 1214 is formed.

The antenna device 1210 constituted as described above is mounted to a circuit board incorporated in the main body of a communication device, high frequency power is supplied from the main body of the communication device to the antenna device 1210 via the feed electrode 1214 and electromagnetic waves are radiated from the radiating conductor film at the inner wall of the through hole 1212.

According to the antenna device 990 shown by FIG. 65, the frequency band of electromagnetic waves must be narrowed to enhance gain. Therefore, when frequencies of electromagnetic waves for transmission and receiving are different from each other as in a portable telephone, it is difficult to use the antenna device 990 as an antenna both for transmission and receiving.

The antenna devices 1100 and 1210 shown by FIG. 66 and FIG. 67, are nondirectional in respect of a face expanding perpendicularly to a direction of extending the through hole where the radiating conductor film is formed. When such antenna devices are mounted to, for example, a portable telephone, a portable telephone generally transmits and receives vertically polarized electromagnetic waves and therefore, the antenna device is mounted to the main body of a portable telephone such that a direction of extending the through hole coincides with a longitudinal direction of the main body of the portable telephone.

When a person actually uses a portable telephone mounted with such an antenna device, since the antenna device is nondirectional in respect of a face perpendicular to a direction of extending the through hole, a portion of electromagnetic waves transmitted from the antenna device is radiated toward a human body. The electromagnetic waves radiated toward the human body are not used in communication.

SUMMARY OF THE INVENTION

Accordingly, it is one object of the present invention to provide a first antenna device where electromagnetic waves are efficiently used in communication, including, (1) a dielectric base body having an upper face and a lower face in parallel with each other, (2) a radiating conductor film formed on the upper face of the dielectric base body, having two ends adjacent to each other and connecting the two ends in a loop-like shape, (3) a grounding conductor film formed on the lower face of the dielectric base body and extending in a planar shape, and (4) feeding conductor films formed on a side face of the dielectric base body, respectively connected to the two ends of the radiating conductor film, extending in an up and down direction in parallel with each other, one of which is connected to the grounding conductor film.

According to the first antenna device of the present invention, the radiating conductor film having the two ends adjacent to each other and connecting the two ends in a loop-like shape, is formed on the upper face of the dielectric base body and the grounding conductor film extending in a planar shape is formed on the lower face of the dielectric base body. Therefore, electromagnetic waves having a resonance frequency of a length of the radiating conductor film is radiated such that maximum gain is obtained in a direction perpendicular to a loop face of the radiating conductor film and the electromagnetic waves radiated from the radiating conductor film and progressing toward the grounding conductor film are reflected by the grounding conductor film.

Therefore, an electromagnetic wave radiated from the antenna device has maximum gain in a direction perpendicular to a plane including the radiating conductor film and directed from the grounding conductor film to the radiating conductor film. Therefore, an antenna device having high directivity and high gain is obtained.

When the antenna device is attached to, for example, a portable telephone, if the grounding conductor film is disposed between a person and the radiating conductor film when the person uses the portable telephone, electromagnetic waves are not radiated toward the side of the person and radiated electromagnetic waves have maximum gain in the direction directed from the grounding conductor film to the radiating conductor film. Therefore, the antenna device can be efficiently used in communication.

According to the first antenna device of the present invention, it is not necessary in forming the radiating conductor film to construct a through hole in a dielectric base body. Therefore, reduced fabrication cost is achieved.

It is preferable that the feeding conductor films of the first antenna device also serve as electrodes in mounting onto a surface of a circuit board. Therefore, the antenna device can be easily mounted onto the face of the circuit board.

In order to achieve the above-described object, a second antenna device of the present invention includes (1) a dielectric base body having an upper face and a lower face where a through hole for connecting the upper face and the lower face is formed, (2) a monopole conductor filled in the through hole, (3) a loop conductor in a film-like shape formed on the upper face, having two ends adjacent to each other and connecting the two ends in a loop-like shape where one of the two ends is connected to the monopole conductor, and (4) a grounding conductor in a film-like shape extending on the lower face.

According to the second antenna device of the present invention, the loop conductor in a film-like shape is formed on the upper face of the dielectric base body and the grounding conductor in a film-like shape is formed on the lower face of the dielectric base body. Accordingly, electromagnetic waves are radiated from the loop conductor in a film-like shape with maximum gain in a direction perpendicular to a loop face of the loop conductor. Electromagnetic waves radiated toward the grounding conductor in a film-like shape are reflected back toward the loop conductor. Accordingly, electromagnetic waves having maximum gain in a direction perpendicular to the loop conductor and directed from the grounding conductor to the loop conductor are radiated, and an antenna device having wide directivity can be obtained. Further, since the monopole conductor is filled in the through hole formed in the dielectric substrate, electromagnetic waves radiated from the monopole conductor have maximum gain in a direction parallel to the loop face of the loop conductor in a filmlike shape. Accordingly, electromagnetic waves are not radiated to the side of the grounding conductor in a film-like shape, that is, to the side of a human body and electromagnetic waves are effectively radiated in directions other than the direction toward the side of the human body.

Further, the antenna device may have a coaxial conductor having a central conductor connected from the lower face side to the monopole conductor and an external conductor connected to the grounding conductor extending on the lower face.

When the coaxial connector is provided, the antenna is connected to a circuit board or the like to which the coaxial cable is connected via the coaxial cable.

It is further preferable that the second antenna device is provided with a signal line one end of which is connected to the monopole conductor on the lower face and forming coplanar lines along with the grounding conductor on the lower face, a feed terminal formed on a side face of the dielectric base body and connected to the signal line, and ground terminals formed on a side face the same as the side face where the feed terminal is formed and connected to the grounding conductor.

When the signal line forming coplanar lines along with the grounding conductor, is provided, the antenna device having a desired line impedance is obtained by fabricating the antenna device such that a width of the signal line and a gap width between the signal line and the grounding conductor become desired values. Further, when the feed terminal and the ground terminal are provided, the antenna device can easily be mounted on the surface of a circuit board.

In order to achieve the above-described object, a third antenna device of the present invention includes, (1) a dielectric base body having a lower face and side faces, (2) a grounding conductor film formed on the lower face and extending in a planar shape, (3) a radiating conductor film formed on the side faces, having two ends adjacent to each other in a left and right direction and connecting the two ends by turning around horizontally the side faces, and (4) two feeding conductor films formed on the side face, extending in the up and down direction in parallel with each other, one of which is connected to one of the two ends and the other one of which is connected to the other one of the two ends and also connected to the grounding conductor film.

According to the third antenna device of the present invention, the radiating conductor film turning horizontally around the side faces is formed on the side faces and the grounding conductor film extending in a planar shape is formed on the lower face. Accordingly, electromagnetic waves are radiated from the radiating conductor film having maximum gain in a direction perpendicular to a plane including the radiating conductor film and electromagnetic waves progressing toward the grounding conductor film are reflected by the grounding conductor film. That is, the electromagnetic waves radiated from the antenna device have maximum gain in a direction perpendicular to the plane including the radiating conductor film and are directed from the grounding conductor film to the radiating conductor film. Therefore, when the antenna device is attached to, for example, a portable telephone, if the grounding conductor film is disposed between a person and the radiating conductor film when the person uses the portable telephone, electromagnetic waves are not radiated to the side of the person and electromagnetic waves are efficiently used in communication with maximum gain in a direction directed from the grounding conductor film to the radiating conductor film.

Further, according to the third antenna device of the present invention, it is not necessary in forming the radiating conductor film to constitute a through hole in a dielectric base body, therefore reducing fabrication costs.

Here, it is preferable for the third antenna device of the present invention that the feeding conductor films also serve as electrodes in mounting onto the surface of a circuit board.

When the feeding conductor films also serve as electrodes in mounting onto the surface of a circuit board, the antenna device can easily be mounted on the circuit board.

In order to achieve the above-described object, a fourth antenna device of the present invention includes, (1) a dielectric base body having a lower face, (2) a grounding conductor film formed on the lower face of the dielectric base body and extending in a planar shape, (3) a radiating conductor film formed at an inner portion of the dielectric base body, having two ends adjacent to each other in the left and right direction and connecting the two ends by making a turn in a loop-like shape on a horizontal plane, (4) inner feeding conductor films formed at the inner portion of the dielectric base body and connecting respectively the two ends of the radiating conductor film to a side face of the dielectric base body, and (5) side face feeding conductor films formed on the side face of the dielectric base body, extending in the up and down direction in parallel with each other and connected respectively to the inner feeding conductor films, one of which is connected to the grounding conductor film.

According to the fourth antenna device of the present invention, the radiating conductor film making a turn in a loop-like shape on a horizontal plane is formed at the inner portion of the fourth antenna device and the grounding conductor film extending in a planar shape is formed on the lower face. Therefore, electromagnetic waves radiated from the radiating conductor film have maximum gain in a direction perpendicular to a plane including the radiating conductor film and electromagnetic waves progressing toward the grounding conductor film among radiated electromagnetic waves, are reflected by the grounding conductor film. That is, the electromagnetic waves radiated from the antenna device have maximum gain in a direction perpendicular to the plane including the radiating conductor film and directed from the grounding conductor film to the radiating conductor film. Accordingly, when the antenna device is attached to, for example, a portable telephone, if the grounding conductor film is disposed between a person and the radiating conductor film when the person uses the portable telephone, electromagnetic waves are not radiated to the side of the person, but instead, the radiated electromagnetic waves can efficiently be used in communication having maximum gain in a direction directed from the grounding conductor film to the radiating conductor film.

Meanwhile, when a wavelength of an electromagnetic wave in air is compared with a wavelength of an electromagnetic wave of a same frequency in a dielectric body, the wavelength of the electromagnetic wave in the dielectric body is shorter. Accordingly, in a case where a radiating conductor film is formed at an inner portion of a dielectric base body, is compared with a case where the radiating conductor film is formed on a surface of the dielectric base body in radiating electromagnetic waves having the same frequency, the length of the loop of the radiating conductor film can be shortened. Furthermore, in the case where the radiating conductor film is formed at the inside of the dielectric base body when the length of the loop of the radiating conductor film is shortened in this way, the dimension of the dielectric base body can be downsized.

Accordingly, downsizing of the fourth antenna device of the present invention where the radiating conductor film is formed at the inner portion of the dielectric base body can be realized.

Further, according to the fourth antenna device of the present invention, it is not necessary in forming the radiating conductor film to constitute a through hole in the dielectric base body by which a reduction in fabrication cost is achieved.

Here, according to the fourth antenna device of the present invention, it is preferable that the feeding conductor films also serve as electrodes in mounting onto the surface of a circuit board, thereby providing an antenna device that can easily be mounted on the circuit board.

In order to achieve the above-described object, a fifth antenna device of the present invention includes, (1) a dielectric base body having an upper face and a lower face extending horizontally, (2) a grounding conductor film formed on the lower face of the dielectric base body and extending in a planar shape, (3) a first loop radiating conductor film formed on the upper face of the dielectric base body and making a turn on the upper face such that two ends opposed to each other via a predetermined first gap are formed, (4) a second loop radiating conductor film formed at an inner portion of the dielectric base body and making a turn on a horizontal plane such that two ends opposed to each other via a second gap having a direction different from a direction of the first gap in respect of a loop of the first loop radiating conductor film, are formed, (5) two first feeding conductor films respectively connected to the two ends of the first loop radiating conductor film and extending in parallel with each other, one of which is connected to the grounding conductor film, and (6) two second feeding conductor films respectively connected to the two ends of the second loop radiating conductor film and extending in parallel with each other via a side face of the dielectric base body, one of which is connected to the grounding conductor film.

The fifth antenna device of the present invention is provided with the first loop radiating conductor film and the second loop radiating conductor film having directions of the gaps in respect of loops different from each other. Accordingly, the polarizing direction of electromagnetic waves transmitted and received by the first loop radiating conductor and polarizing direction of electromagnetic waves transmitted and received by the second loop radiating conductor film are different from each other. Accordingly, electromagnetic waves having polarizing directions different from each other can be transmitted and received by a single antenna device.

Further, the fifth antenna device of the present invention is provided with a loop antenna structure since it has the first loop radiating conductor film making a turn on the upper face of the dielectric base body and the second loop radiating conductor film making a turn on a horizontal plane at an inner portion of the dielectric base body and electromagnetic waves radiated from the first and the second loop radiating conductor films, are electromagnetic waves having maximum gain in a direction perpendicular to the planes including the radiating conductor films. Further, since the grounding conductor film is formed on the lower face of the dielectric base body, electromagnetic waves progressing toward the grounding conductor film among electromagnetic waves radiated from the first and the second loop radiating conductor films, are reflected by the grounding conductor film. That is, the electromagnetic waves radiated from the antenna device have maximum gain in the direction from the grounding conductor film to the first and the second loop radiating conductor films. Accordingly, when the fifth antenna device of the present invention is attached, for example, to a portable telephone, if the grounding conductor film is disposed between a person and the loop radiating conductor films when the person uses the portable telephone, electromagnetic waves are not radiated to the side of the person and the radiated electromagnetic waves having maximum gain in the direction from the grounding conductor film to the radiating conductor films are efficiently used in communication.

It is preferable for the fifth antenna device of the present invention that the first loop radiating conductor film and the second loop radiating conductor film are formed such that the direction of the first gap in respect of the loop of the first loop radiating conductor film and the direction of the second gap in respect of the loop of the second radiating conductor film are different from each other by 90° on a horizontal plane. When the first loop radiating conductor film and the second loop radiating conductor film are formed in this manner, electromagnetic waves can efficiently be received irrespective of whether the received electromagnetic waves are vertically or horizontally polarized.

Further, according to the fifth antenna device of the present invention, it is not necessary in forming the radiating conductor film to constitute a through hole in the dielectric base body by which a reduction in fabrication cost is achieved.

Here, it is preferable for the fifth antenna device of the present invention that the first and the second feeding conductor films also serve as electrodes in mounting onto a surface of a circuit board.

When the feeding conductor films also serve as electrodes in mounting onto the surface of a circuit board, the antenna device can easily be mounted on the circuit board.

In order to achieve the above-described object, a sixth antenna device of the present invention includes, (1) a dielectric base body having an upper face, a lower face, and side faces, (2) a grounding conductor film formed on the lower face of the dielectric base body, (3) four radiating conductor films formed on the upper face or the side faces of the dielectric base body, extending in a horizontal direction, contiguous ends of which are opposed to each other via gaps, making a turn by forming four of the gaps at equal intervals as a whole, and (4) eight feeding conductor films respectively connected to the respective ends of the four radiating conductor films and extending in an up and down direction.

The sixth antenna device of the present invention is provided with a loop antenna structure since it has the radiating conductor films making a turn as a whole.

FIG. 1 is an explanatory top view for explaining the operation of an antenna device 10 having a loop antenna structure. A radiating conductor film 12 where two ends 12*a* and 12*b* adjacent to each other are opposed to each other via a gap and which connect the two ends 12*a* and 12*b* by making a turn in a circular loop shape with a point O as center, is formed on the surface of a dielectric base body 11 constituting the antenna device 10. The length of the radiating conductor film 12 is adjusted to a length the same as the resonance wavelength of electromagnetic wave that is an object of transmission and receiving. Further, point A designates a point indicating the position of the two ends 12*a* and 12*b* and points B, C and D are points at positions which is rotated from point A clockwisely by 90°, 180° and 270° with point 0 as center, respectively.

According to the antenna device 10 constituted as described above, when voltage is applied between the two ends 12*a* and 12*b*, current is supplied from the two ends 12*a* and 12*b* to the radiating conductor film 12, a standing wave is generated in the radiating conductor film 12 and current flowing in the radiating conductor film 12 is maximized at point A and point C, and becomes almost 0 at point B and point D. At point A and point C where the maximum current flows, the direction of current is in a direction along a line connecting point B and point D. Accordingly, the polarized wave direction is in a direction along the line connecting point B and point D.

FIG. 2 is an explanatory view explaining the operation of an antenna device 20. Instead of the radiating conductor film shown by FIG. 1, a feed point is provided also at the position of point C and radiating conductor films constituting a looplike shape as a whole are adopted.

According to the antenna device 20 constituted as described above, when currents having the same amplitude and the same phase are supplied from point A and point C, standing waves are generated in radiating conductor films 22 and currents flowing in the radiating conductor films 22, are maximized at point A and point C and become almost 0 at point B and point D similar to the antenna device 10 shown by FIG. 1. The direction of currents is in a direction along a line connecting point B and point D at point A and point C where the maximum current flows. Accordingly, a polarized wave in a direction along the line connecting point B and point D similar to the antenna device 10 shown by FIG. 1 is produced.

FIG. 3 is an explanatory view for explaining the operation of an antenna device 30 constituted by adopting radiating conductor films forming a loop-like shape as a whole where feed points are provided also at positions of point B and point D in place of the radiating conductor films shown by FIG. 2.

According to the antenna device 30 constituted as described above, in respect of radiating conductor films 32 constituting the antenna device, the loop is cut off at positions of point B and point D where current becomes almost 0. Accordingly, when currents having the same amplitude and the same phase are supplied from point A and point C, similar to the antenna device 20 shown by FIG. 2, standing waves are generated in the radiating conductor films 32 and currents flowing in the radiating conductor film 32 are maximized at point A and point C and become 0 at point B and point D. The direction of current is in a direction along a line connecting point B and point D at point A and point C where the maximum current flows. Accordingly, similar to the antenna device 20 shown by FIG. 2, the polarizing direction is in a direction along the line connecting point B and point D. Meanwhile, when currents having the same amplitude and the same phase are supplied from point B and point D in place of point A and point C, standing waves are generated in the radiating conductor films 32 and currents flowing in the radiating conductor films 32 are maximized at point B and point D and becomes 0 at point A and point C. The direction of current is in a direction along a line connecting point A and point C at point B and point D where the maximum current flows and the polarized wave direction is in a direction along the line connecting point A and point C.

Accordingly, when a state where currents having the same amplitude and the same phase are supplied to point A and point C and a state where currents having the same amplitude and the same phase are supplied to point B and point D, can be switched freely, an antenna device having the gain capable of switching to polarized wave directions perpendicularly intersecting with each other, is provided.

According to the sixth antenna device of the present invention, the four radiating conductor films extending in the horizontal direction, contiguous ends of which are opposed to each other via gaps and making a turn by forming four of the gaps at equal intervals as a whole, are constituted as shown by FIG. 3 and accordingly, electromagnetic waves in polarized directions perpendicularly intersecting with each other can be transmitted and received.

Further, according to the sixth antenna device of the present invention, it is not necessary in forming the radiating conductor films to form a through hole in a dielectric base body by which reduction in fabrication cost is achieved.

Further, it is preferable that the feeding conductor films of the six antenna device also serve as electrodes in mounting onto the surface of a circuit board.

When the feeding conductor films also serve as electrodes in mounting onto the surface of a circuit board, the antenna device can easily be mounted on the circuit board.

In order to achieve the above-described object, a seventh antenna device of the present invention includes, (1) a dielectric base body, (2) a radiating conductor film in a closed loop shape formed on the dielectric base body and making a r-urn horizontally, (3) a grounding conductor film formed on the dielectric base body and extending horizontally, and (4) a pair of feeding conductor films extending in an up and down direction in parallel with each other via a side face of the dielectric base body and connected to the radiating conductor film.

According to the seventh antenna device of the present invention, since the radiating conductor film in a closed loop shape making a turn horizontally is formed on the dielectric base body, it has a single wave loop structure and electromagnetic waves radiated from the radiating conductor film have maximum gain in a direction perpendicular to a plane including the radiating conductor film. Further, since the grounding conductor film extending horizontally is formed on the dielectric base body, electromagnetic waves progressing toward the grounding conductor film among electromagnetic waves radiated from the radiating conductor film, are reflected by the grounding conductor film. That is, the electromagnetic waves radiated from the antenna device have maximum gain in a direction perpendicular to the plane including the radiating conductor film and directed from the grounding conductor film to the radiating conductor film. Accordingly, when the seventh antenna device of the present invention is attached, for example, to a portable telephone, if the grounding conductor film is disposed between a person and the radiating conductor film when the person uses the portable telephone, electromagnetic waves are not radiated to the side of the person and radiated electromagnetic waves are provided with maximum gain in the direction directed from the grounding conductor film to the radiating conductor film are efficiently used in communication.

Further, according to the seventh antenna device of the present invention, it is not necessary in forming the radiating conductor film to constitute a through hole in the dielectric base body by which reduction in fabrication cost is achieved.

Here, the radiating conductor film of the seventh antenna device of the present invention may be a radiating conductor film in a closed loop shape making a turn on the upper face of the dielectric base body or turning around side faces of the dielectric base body.

Further, the radiating conductor film of the seventh antenna device of the present invention may be a radiating conductor film in a closed loop shape making a turn on a horizontal plane at the inside of the dielectric base body.

When a wavelength of an electromagnetic wave in air is compared with a wavelength of an electromagnetic wave of a same frequency in a dielectric body, the wavelength of the electromagnetic wave in the dielectric body is shorter and therefore, the length of the loop of the radiating conductor film can be shortened when the radiating conductor film is formed at an inner portion of the dielectric base body. Accordingly, the dimensions of dielectric base body can be downsized and downsizing of the antenna device is achieved.

It is preferable that the seventh antenna device of the present invention further includes in addition to the radiating conductor film, a second radiating conductor film in a closed loop shape making a turn horizontally at a position of the dielectric base body different from the position where the radiating conductor film is formed, and a second pair of feeding conductor films extending in the up and down direction in parallel with each other via positions of a side face of the dielectric base body different from the positions where the pair of feeding conductor films are formed and connected to the second radiating conductor film.

When the pair of feeding conductor films and the second pair of feeding conductor films are formed via positions of the side face of the dielectric base body, which are different from each other, polarized directions of transmitted and received electromagnetic waves at the radiating conductor film connected to the pair of feeding conductor films and the second radiating conductor films connected to the second pair of feeding conductor films, are different from each other. An explanation will be given of the reason why polarized directions of transmitted and received electromagnetic waves are different from each other with respect to the radiating conductor films as follows.

FIG. 4 is a top explanatory view of an antenna device 40. A radiating conductor film 42 in a circular closed loop shape making a turn horizontally along a circumference of an upper face with point 0 as center, is formed on the surface of a dielectric base body 41 in a cylindrical shape constituting an antenna device 40. Further, point A is a point for connecting to the radiating conductor film 42 with a pair of feeding conductor films, not shown, and points B, C and D are points at positions which are rotated clockwisely from point A by 90°, 180° and 270°, respectively, with point 0 as center.

According to the antenna device 40 constituted as described above, since the radiating conductor film 42 in a closed loop shape is formed, it has a single wavelength loop antenna structure and when current is supplied from point A to the radiating conductor film 42, a standing wave is generated in the radiating conductor film 42 and current flowing in the radiating conductor film 42 is maximized at point A and point C and becomes almost 0 at point B and point D. The direction of the current is in a direction along a line connecting point B and point D at point A and point C where the maximum current flows and polarized direction is in a direction along the line connecting point B and point D. Accordingly, when current is supplied from, for example, point B to the radiating conductor film 42 instead of supplying current from point A to the radiating conductor film 42, the polarized direction is in a direction along a line connecting point A and point C. When a case where current is supplied from point A to the radiating conductor film 42, is compared with a case where the current is supplied from point B to the radiating conductor film 42, the polarized directions become perpendicular to each other.

As described above, the pair of second feeding conductor films connected to the second radiating conductor film are formed via positions different from positions via which the above-described pair of feeding conductor films connected to the radiating conductor film are formed. Therefore, when the radiating conductor film is compared with the second radiating conductor film, points for supplying current are different from each other in respect of a horizontal plane. Accordingly, it is known from the explanation in reference to FIG. 4 that the polarized direction of electromagnetic waves transmitted and received by the radiating conductor film and polarized direction of electromagnetic waves transmitted and received by the second radiating conductor film, are different from each other. Accordingly, when the pair of feeding conductor films and the second pair of feeding conductor films are formed via positions on the side faces of the dielectric base body, which are different from each other, electromagnetic waves having the polarized directions different from each other can be transmitted and received by the single antenna device.

Here, according to the seventh antenna device of the present invention, a total of four pairs of feeding conductor films connected to the radiating conductor films at one of positions equally dividing by four an interval turning around the radiating conductor films and extending in the up and down direction in parallel with each other, may be formed including the pair of feeding conductor films.

Although an explanation has been given of the case where current is supplied from point A to the radiating conductor film 42 in reference to FIG. 4, when a case where currents having the same amplitude and the same phase are supplied from point A and point C to the radiating conductor film 42, is considered, similar to the case where current is supplied from point A to the radiating conductor film 42, the currents flowing in the radiating conductor film 42 are maximized at point A and point C and becomes almost 0 at point B and point D and the direction of current becomes a direction along a line connecting point B and point D at point A and point C where the maximum current flows. That is, the polarized direction becomes a direction along the line connecting point B and point D. Accordingly, when currents having the same amplitude and the same phase are supplied from point B and point D to the radiating conductor film 42 instead of supplying currents having the same amplitude and the same phase from point A and point C to the radiating conductor film 42, the polarized direction is in a direction along a line connecting point A and point C. When the case where currents having the same amplitude and the same phase are supplied from point A and point C to the radiating conductor film 42, is compared with the case where currents having the same amplitude and the same phase are supplied from point B and point D to the radiating conductor film 42, the polarized directions become perpendicular to each other.

As described above, since four pairs of the feeding conductor films are formed at positions equally dividing by four the radiating conductor films and accordingly, when the state where currents having the same amplitude and the same phase are supplied to two pairs of the feeding conductor films formed at positions equally dividing in two an interval turning around the radiating conductor films, and the state where currents having the same amplitude and the same phase are supplied to remaining two pairs of the feeding conductor films, can be switched freely, the antenna device having the gain capable of freely switching to polarized directions perpendicular to each other can be provided.

Further, in order to achieve the above-described object, an eighth antenna device of the present invention includes, (1) a dielectric base body having an upper face and a lower face and side faces partitioned by a side extending vertically, (2) a radiating conductor film in a loop-like shape formed on the upper face of the dielectric base body, (3) a grounding conductor film formed on the lower face of the dielectric base body and extending on the lower face, and (4) two feeding conductor films respectively formed on both sides of the side on the side faces of the dielectric base body, respectively connected to the radiating conductor film and extending in an up and down direction in parallel with each other, one of which is connected to the grounding conductor film.

FIG. 5 through FIG. 7 are explanatory views for explaining the function of the eighth antenna device of the present invention.

FIG. 5 is a perspective view showing an antenna device 60 where two feeding conductor films are formed on one side face of a dielectric base body having four side faces and FIG. 6 is a horizontal sectional view thereof.

The antenna device 60 is provided with a dielectric base body 61 in a rectangular parallelepiped shape. A radiating conductor film 62 having two ends 62*a* and 62*b* adjacent to each other and connecting the two ends 62*a* and 62*b* along four sides of the upper face in a looplike shape, is formed on the upper face of the dielectric base body 61 and the length of the radiating conductor film is adjusted to become the resonance wavelength of electromagnetic wave that is an object of transmission. A grounding conductor film 63 extending in a planar shape is formed on the lower face of the dielectric base body 61 and the grounding conductor film 63 is provided with a shape where a portion of a side is notched. As shown by FIG. 6, feeding conductor films 64 and 65 having a coplanar line structure are formed on the side face of the dielectric base body 61. The feeding conductor films 64 and 65 are respectively connected to the two ends 62*a* and 62*b* of the radiating conductor film 62 and extended in the up and down direction in parallel with each other. The feeding conductor film 65 that is one of the feeding conductor films 64 and 65, is connected also to the grounding conductor film 63 and the other one of the feeding conductor film 64 reaches the lower face of the dielectric base body 61.

Power is supplied from the two ends 62*a* and 62*b* (hereinafter, two ends 62*a* and 62*b* are referred to as feed points) to the radiating conductor film 62 of the antenna device 60 shown by FIG. 5 via the feeding conductor films. Generally, when the feed points of power in the radiating conductor film are points adjacent to each other in the case of a single wavelength loop antenna, the antenna is provided with high impedance of 100Ω or higher and therefore, it is difficult to efficiently supply power to the radiating conductor film. Accordingly, in order to efficiently supply power to the radiating conductor film by reducing impedance, if the antenna device is provided with the feeding conductor films having a coplanar line structure as shown by FIG. 5, a distance between the feed points of the radiating conductor film is adjusted, that is, the gap width between the feeding conductor films is adjusted.

By adjusting the gap width, the impedance is reduced and power can efficiently be supplied to the radiating conductor film. Further, the impedance of the radiating conductor film and the impedance of the feeding conductor films must be matched with each other. The impedance Z of the feeding conductor films having the coplanar line structure as shown by FIG. 5, can be represented by the following equation when the gap width of the feeding conductor films is designated by notation 2 W and the width of the feeding conductor film is designated by S.

$$Z \propto \left\{\sqrt{(1/\varepsilon_{reff})}\right\}k \tag{1}$$

where $\in_{reff}$ is an effective dielectric constant, $$k=W/(W+S) \tag{2}$$

Here, the effective dielectric constant $\in_{reff}$ is represented by the following equation by determining the dielectric constant of air as I since electric fields are generated from the feeding conductor film at the inside of the dielectric base body and in air.

$$\in_{reff}=(\in_r+1)/2 \tag{3}$$

where $\in_r$ is a dielectric constant of dielectric base body.

Meanwhile, in order to reduce the impedance to efficiently supply power to the radiating conductor film, there is a case where the gap length 2 W between the feeding conductor films must be widened. In this case, when the impedance Z of the feeding conductor films is intended to match with impedance of the radiating conductor film, since notation k in the equation of the impedance Z of the feeding conductor film represented by Equation (1), is defined by Equation (2), when the gap width 2 W is widened, the width S of the feeding conductor film must be widened in accordance therewith. Since a sum of the gap width of the feeding conductor film and the width of the two feeding conductor films is 2 W+2 S, when the width of the side face of the dielectric base body is smaller than 2 W+2 S, the impedance of the feeding conductor films cannot be matched with the impedance of the radiating conductor film. Accordingly, when the feeding conductor films are formed on the side face of the dielectric base body, the width S of the feeding conductor film is restricted, the impedance of the feeding conductor film may not be set to a desired value and impedance of the radiating conductor films may not be matched with the impedance of the feeding conductor film.

FIG. 7 is a horizontal sectional view of an antenna device where a feeding conductor film is formed at each of both sides of a side extending vertically on side faces of a dielectric base body.

An antenna device 70 shown by FIG. 7 is provided with a dielectric base body 71 in a rectangular parallelepiped shape and each of feeding conductor films 72 and 73 is formed at each of both sides of a side 71*a* among four sides extending in the up and down direction on side faces of the dielectric body. Accordingly, when a sum of a distance from the side 71*a* to the feeding conductor film 72 and a distance from the side 71*a* to the feeding conductor film 73, is designed to be equal to the distance between the feeding conductor films shown by FIG. 5 and FIG. 6, the antenna device shown by FIG. 7 has a shorter distance between the two feeding conductor films than that in the antenna device shown by FIG. 5 and FIG. 6 by which the effective dielectric constant $\in_{reff}$ defined by the above-described Equation (3) is increased. Accordingly, when the antenna device of FIG. 5 and FIG. 6 is compared with the antenna device of FIG. 7, in the case where the value of notation W in Equation (2) is equal, if both of the impedances Z of the feeding conductor films are adjusted to $Z = Z_1$, the value of notation k in Equation (1) must be increased, due to the fact that the effective dielectric constant $\in_{reff}$ is larger in the antenna device of FIG. 7. The increase in the value of k amounts to further narrowing the width S of the feeding conductor film of the antenna device shown by FIG. 7 than the width S of the feeding conductor film of the antenna device shown by Fig. and FIG. 6. Therefore, according to the antenna device of FIG. 7, impedance can be matched even if the width of the feeding conductor film is narrower than that of the antenna device shown by FIG. 5 and FIG. 6. That is, when the eighth antenna device of the present invention is used, even if the gap width of the feeding conductor film is wide, the impedance of the radiating conductor film can be matched with the impedance of the feeding conductor film.

Further, the eighth antenna device of the present invention has a single wavelength loop antenna structure since the radiating conductor film in a loop-like shape is formed on the upper face of the dielectric base body and electromagnetic waves radiated from the radiating conductor film have maximum gain in a direction perpendicular to a plane including the radiating conductor film. Further, since the grounding conductor film is formed on the lower face of the dielectric base body, electromagnetic waves progressing toward the grounding conductor film among the electromagnetic waves radiated from the radiating conductor film, are reflected by the grounding conductor film. That is, the electromagnetic waves radiated from the antenna device have maximum gain in a direction perpendicular to the plane including the radiating conductor film and directed from the grounding conductor film to the radiating conductor film. Accordingly, when the eighth antenna device of the present invention is attached to, for example, a portable telephone, if the grounding conductor film is disposed between a person and the radiating conductor film when the person uses the portable telephone, electromagnetic waves are not radiated to the side of the person, but instead, the radiated electromagnetic waves have maximum gain in the direction from the grounding conductor film to the radiating conductor film and are efficiently used in communication.

Further, according to the eighth antenna device of the present invention, it is not necessary in forming the radiating conductor film to form a through hole in the dielectric base body by which reduction in fabrication cost is achieved.

The radiating conductor film of the eight antenna device of the present invention may be provided with an open loop shape where points of connecting the two feeding conductor films to the radiating conductor film, are electrically opened or a closed loop shape where in respect of the radiating conductor film, a conductor film in a strip-like shape turns around.

DETAILED DESCRIPTION OF THE PREFERRED EMBODIMENTS

An explanation will be given of embodiments of the present invention as follows.

Figure 1:
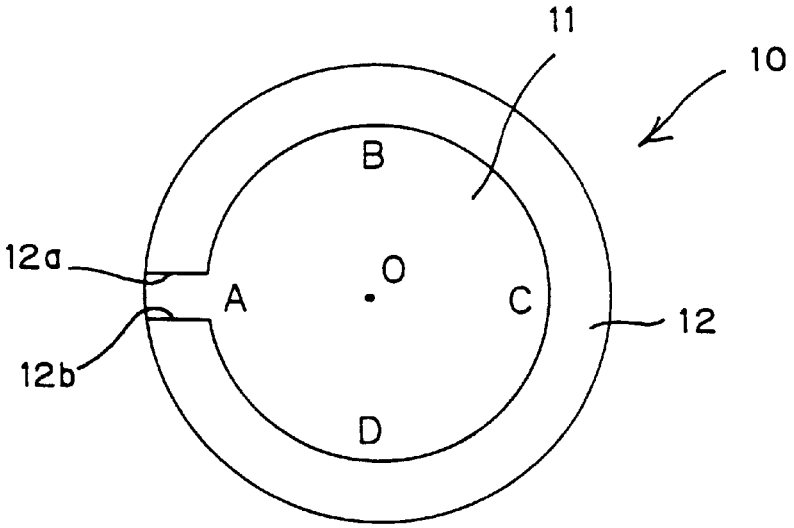
FIG. 1 is a top view of a loop antenna having one feed point.
Figure 2:
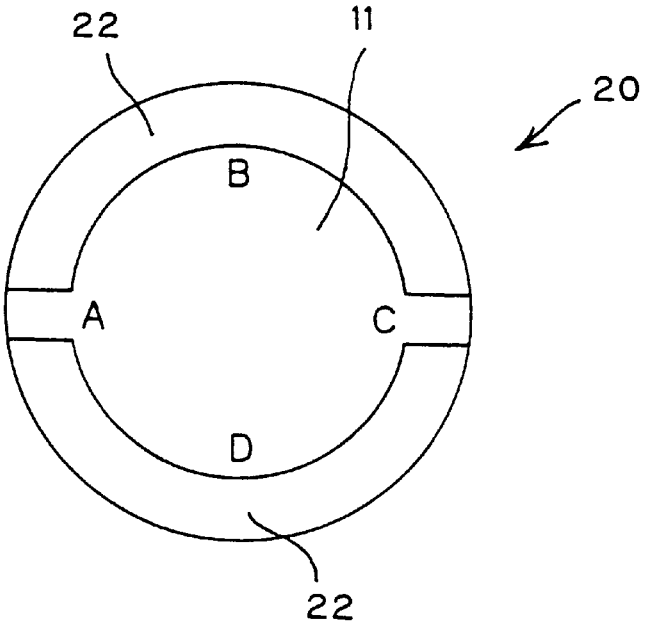
FIG. 2 is a top view of a loop antenna having two feed points.
Figure 3:
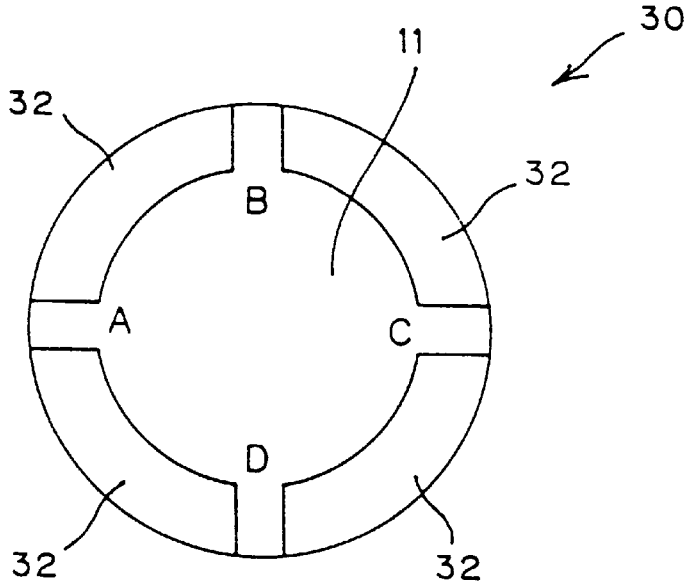
FIG. 3 is a top view of a loop antenna having four feed points.
Figure 4:
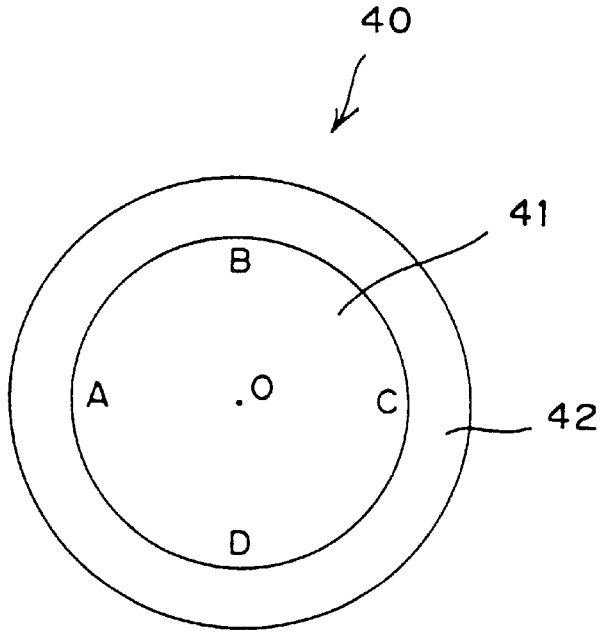
FIG. 4 is a top view of a loop antenna where a radiating conductor film having a closed loop shape is formed.
Figure 5:
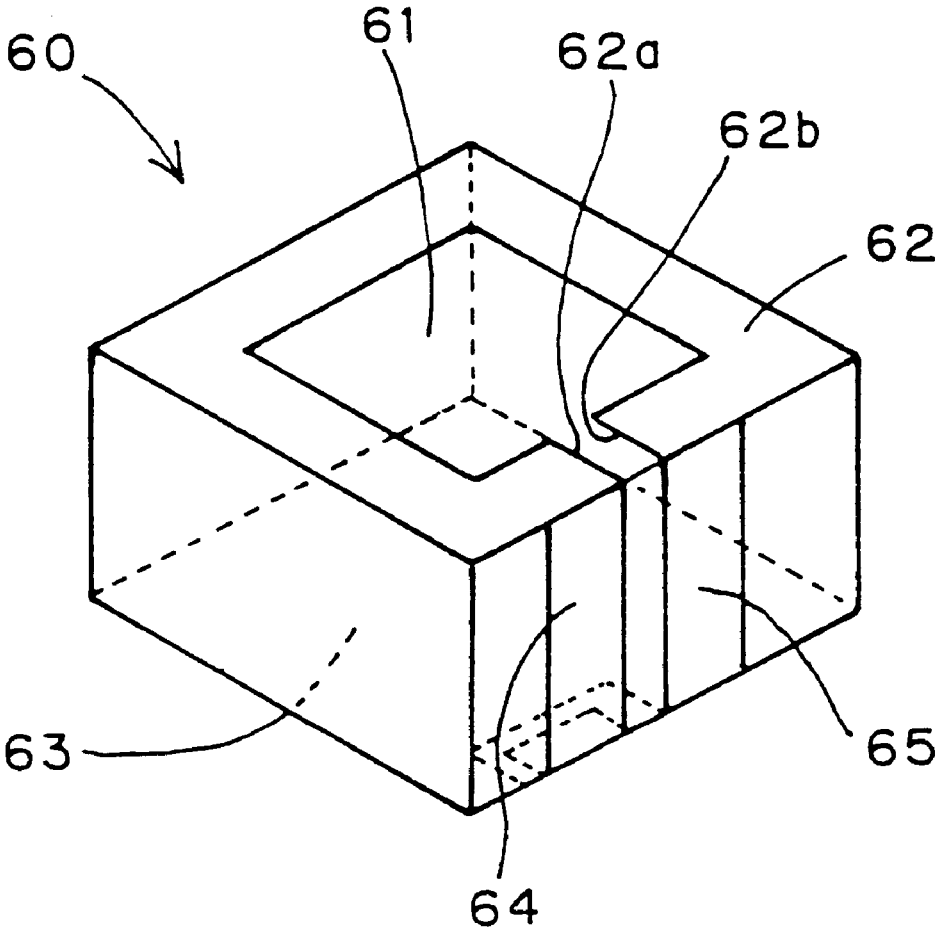
FIG. 5 is a perspective view showing an antenna device where feeding conductor films are formed on the same side face.
Figure 6:
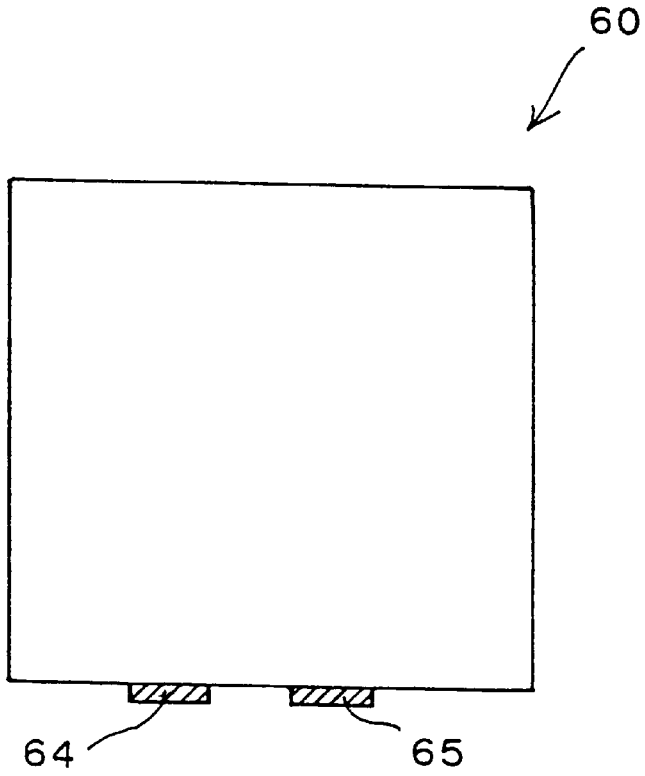
FIG. 6 is a horizontal sectional view of the antenna device as shown by FIG. 4.
Figure 7:
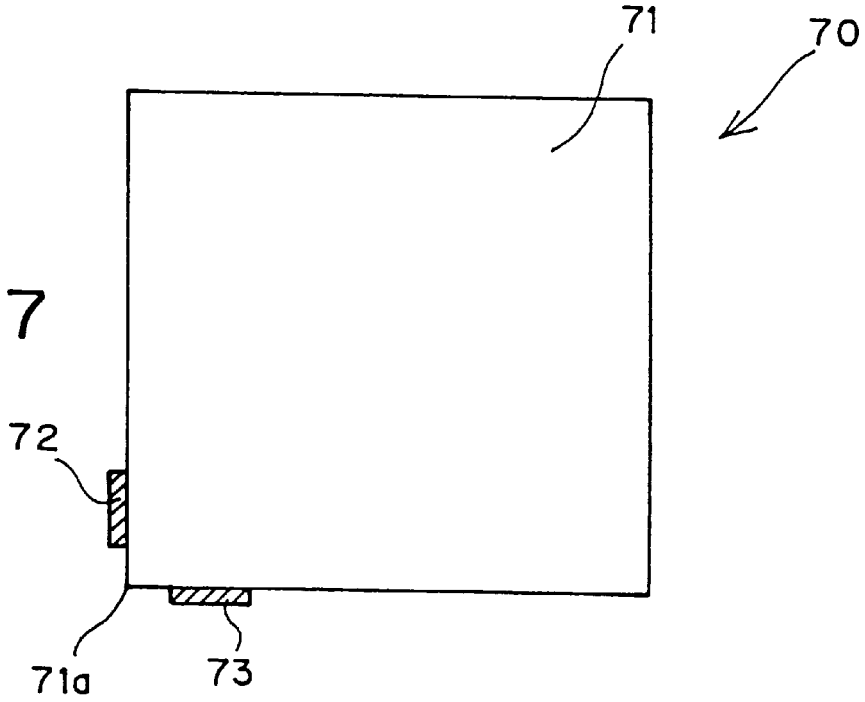
FIG. 7 is a horizontal sectional view of an antenna device where one feeding conductor film is formed at each of both sides of a side extending longitudinally on side faces of a dielectric base body.
Figure 8:
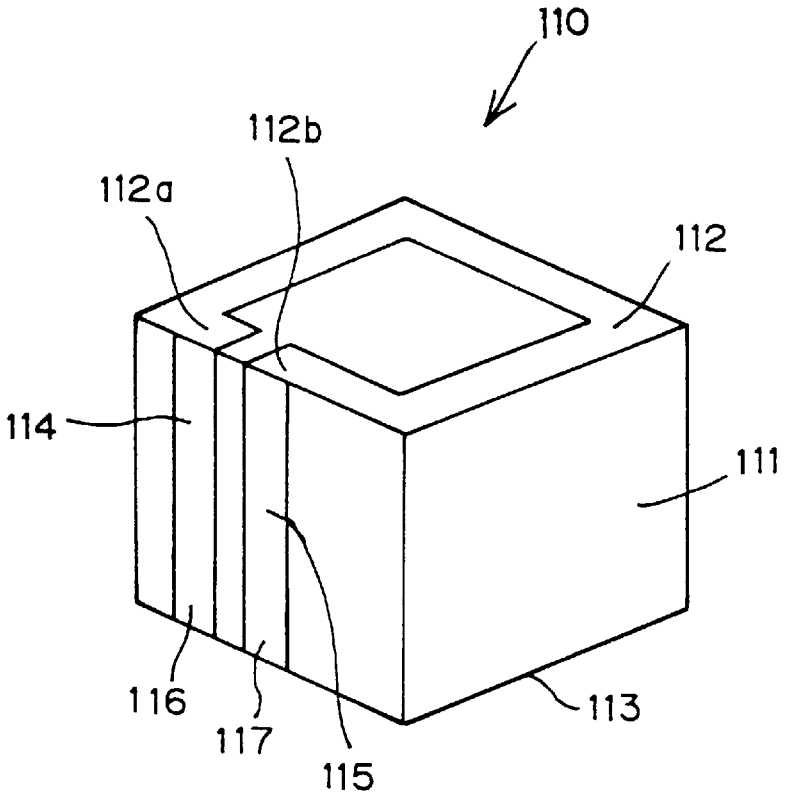
FIG. 8 is a view showing an antenna device according to Embodiment 1 of the present invention.
Figure 9:
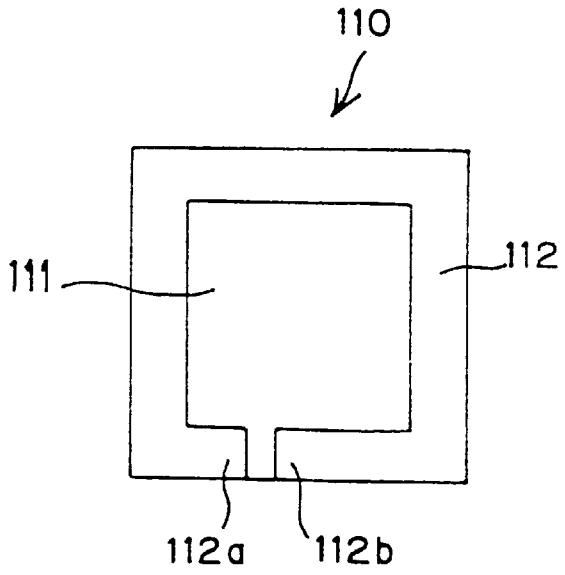
FIG. 9 is a top view of the antenna device as shown by FIG. 8.
Figure 10:
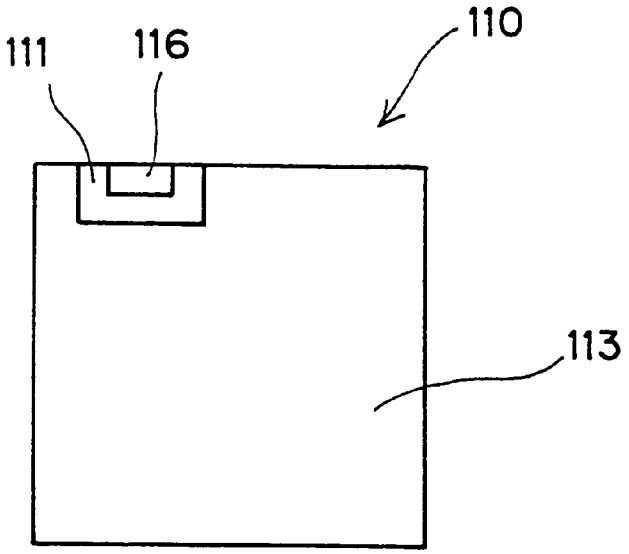
FIG. 10 is a side view of the antenna device as shown by FIG. 8.
Figure 11:
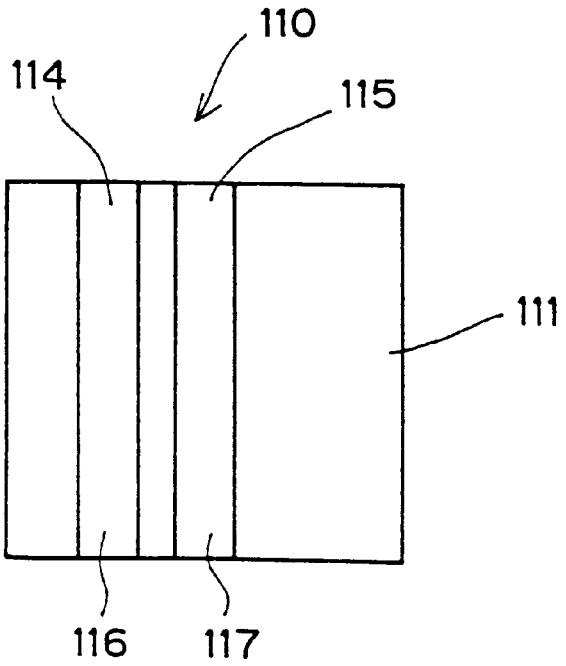
FIG. 11 is a bottom view of the antenna device as shown by FIG. 8.

FIG. 8 is a perspective view showing an antenna device according to Embodiment 1 of the present invention, FIG. 9 is a top view thereof, FIG. 10 is a bottom view thereof and FIG. 11 is a side view thereof.

An antenna device 110 shown by FIG. 8 is provided with a dielectric base body 111 in a shape of a rectangular parallelepiped having an upper face and a lower face in a square shape in parallel with each other. As shown by FIG. 9, a radiating conductor film 112 has two ends 112*a* and 112*b* adjacent to each other, is formed on an upper face of the dielectric base body 111 and extends along four sides of the upper face. The length of the radiating conductor film 112 is adjusted to constitute a resonance wavelength of electromagnetic waves to be transmitted.

As shown by FIG. 10, a grounding conductor film 113 is formed on the lower face of the dielectric base body 111 and the grounding conductor film 113 has a shape where a portion of one side is notched. As shown by FIG. 11, feeding conductor films 114 and 115 respectively connected to the two ends 112*a* and 112*b* of the radiating conductor film 112 and extending in the up and down direction in parallel, are formed on one side of the dielectric base body 111. The feeding conductor film 115 is also connected to the grounding conductor film 113 and the feeding conductor film 114 extends to the lower face of the dielectric base body 111. Further, portions of the feeding conductor films 114 and 115 on the side of the grounding conductor film 113, also serve as feeding electrodes 116 and 117 which are electrodes for mounting onto the surface of a circuit board.

The antenna device 110 constituted as described above has a structure of a single wavelength loop antenna since it has the radiating conductor film 112. A single wavelength standing wave is formed by supplying current to the radiating conductor film 112 via the feeding electrode 116 and the feeding conductor film 114, causing electromagnetic waves to be radiated from the radiating conductor film 112 in a direction perpendicular to the face of the dielectric base body 111 where the radiating conductor film 112 is formed, and electromagnetic waves progressing toward the grounding conductor film 113 are reflected by the grounding conductor film 113. Therefore, electromagnetic waves radiated from the antenna device 110 have maximum gain in a direction perpendicular to a plane including the radiating conductor film 112 and progressing from the grounding conductor film 113 to the radiating conductor film 112. Therefore, the antenna device 110 has high directivity and high gain and may be efficiently used in communications.

Further, the antenna device 110 does not require a through hole at the inside of the dielectric base body 111 and accordingly, reduction in fabrication cost can be achieved.

Incidentally, according to the antenna device 110 of Embodiment 1 of the present invention, the feeding conductor film 115 is grounded to the grounding conductor film 113, however, as an alternative, the feeding conductor film 115 may not be grounded.

Figure 12:
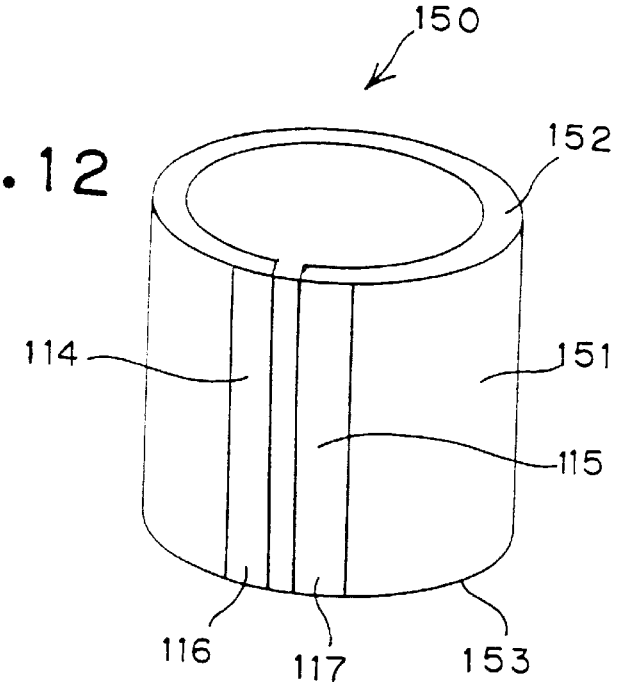
FIG. 12 is a view showing an antenna device according to Embodiment 2 of the present invention.

FIG. 12 is a view showing an antenna device according to Embodiment 2 of the present invention.

A dielectric base body 151 in a cylindrical shape is adopted in an antenna device 150 as shown by FIG. 12, in place of the dielectric base body Ill having a rectangular parallelepiped shape of the antenna device 110 shown by FIG. 8 through FIG. 11, a radiating conductor film 152 in a circular loop shape is formed on an upper face, and a circular grounding conductor film 153 is formed at a lower face of the dielectric base body 151.

In this way, the shape of the dielectric base body is arbitrary so far as it has an upper face and a lower face in parallel to each other.

Figure 13:
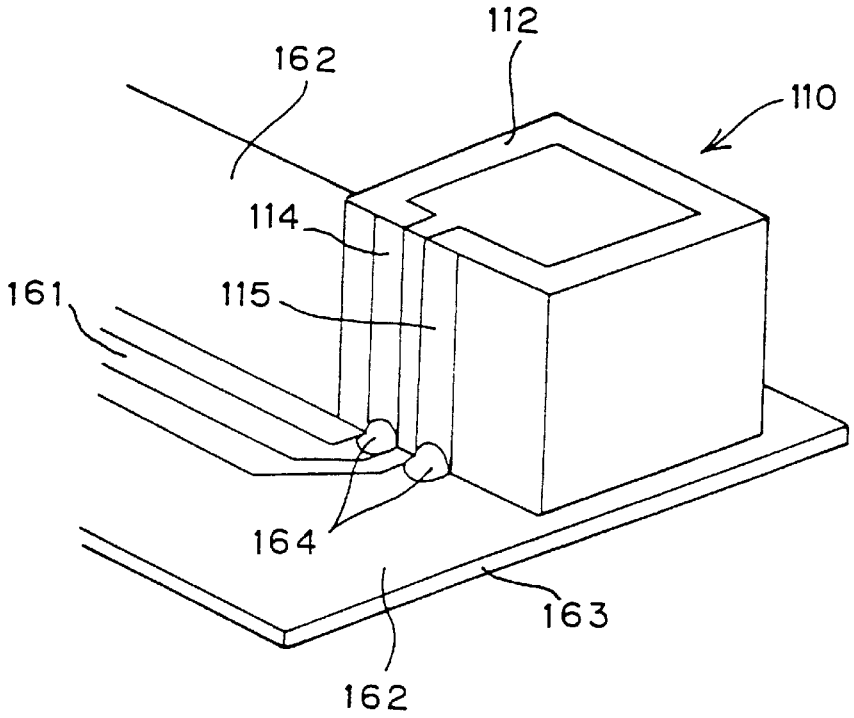
FIG. 13 is a view showing a state where the antenna device shown by FIG. 8 is mounted on a circuit board.

FIG. 13 is a view showing a state where the antenna device shown by FIG. 8 through FIG. 11 is mounted on a circuit board.

The antenna device 110 is mounted on a circuit board 163 where an electricity feed line 161 and a grounding conductor layer 162 are formed and respective pairs of the electricity feed line 161 and the feeding conductor film 114, and the grounding conductor layer 162 and the feeding conductor film 115 are soldered to each other by solders 164. In this way, the antenna device 110 is mounted on the circuit board 103.

An explanation will be given of a fabrication method of the antenna device 110 shown by FIG. 8 through FIG. 11 as follows.

First, a material of the dielectric base body 111 is selected. A material having a dielectric constant in a range of 10 through 100 in a frequency band of transmitted and received electromagnetic waves, is preferred. For example, a $Sr(Ni_{1/3}Nb_{2/3})O_3$ group ceramic is preferable. The material has the dielectric constant of 30 when the transmitted and received electromagnetic waves have a frequency of 6 GHz and a Q value of 1000.

Next, dimensions of the radiating conductor film 112 and the feeding conductor films 114 and 115 will be determined. The dimensions can be determined as follows.

When the length of radiating conductor film 112 is λ, λ can be expressed by the following equation.

$$\lambda = \lambda_0 \Big/ \sqrt{(\varepsilon_{reff})} \tag{4}$$

where $\lambda_0$ is a wavelength of an electromagnetic wave in a vacuum and $\in_{reff}$ is an effective dielectric constant.

Further, a direction of propagating of electromagnetic waves radiated from the radiating conductor film shown by FIG. 8, is a direction intersecting perpendicularly with the face of the dielectric base body where the radiating conductor film is formed. Since electric fields are present in both of the dielectric base body and air, the effective dielectric constant E reff can be represented by the following equation.

$$\in_{ref f}=(\in_r+1)/2 \tag{5}$$

where $\in_r$ is the dielectric constant of the dielectric base body.

Therefore, λ can be calculated by calculating the effective dielectric constant $\in_{reff}$ by using Equation (5) and substituting the calculated $\in_{reff}$ for Equation (4).

When the resonance frequency of transmitted and received electromagnetic waves is set to 1.9 GHz, λ=40.11 mm and accordingly, in order to form the radiating conductor film 112 shown by FIG. 8, the length of one side of the radiating conductor film 112 is determined as 10.03 mm. Further, impedance of a single wavelength loop antenna is generally as high as 100Ω or higher, however, the electricity feed efficiency of the antenna device 110 can be promoted by lowering the impedance by adjusting the width of the radiating conductor film or the interval between the two ends. For example, in order to set the impedance to 50Ω, the width of the radiating conductor film 112 is set to 2 mm and the interval between the two ends 112*a* and 112*b* is set to 1 mm.

It has been reported that a desired transmission impedance can be provided by adjusting the width of a feeding conductor film and the interval between feeding conductor films in "C.P. Wen: 'Coplanar Waveguide: A Surface Strip Transmission Line Suitable for Nonreciprocal Gyromagnetic Device Applications', IEEE Trans. MTT, Vol. MTT-17, No. 12, December. 1969". In this report, the width of the feeding conductor films 114 and 115 is set to 3.09 mm and the interval between the feeding conductor films is set to 1 mm in order to set the transmission impedance to 50Ω.

Next, the dielectric base body 111 is fabricated by setting both of the length and the width of the dielectric base body 111 to 12.03 mm in accordance with the radiating conductor film 112 the dimensions of which has determined as described above and setting the thickness to 7.21 mm corresponding to a quarter of the wavelength of the electromagnetic wave having the resonance frequency of 1.9 GHz in the dielectric base body 111.

Next, patterns of the radiating conductor film 112, the feeding conductor films 114 and 115 and the grounding conductor film 113 each having above-described dimensions, are printed by the thick film printing process by using a copper paste and sintered in a reducing atmosphere.

After being subjected to the fabrication procedure, the antenna device 110 shown by FIG. 8 is manufactured.

Figure 14:
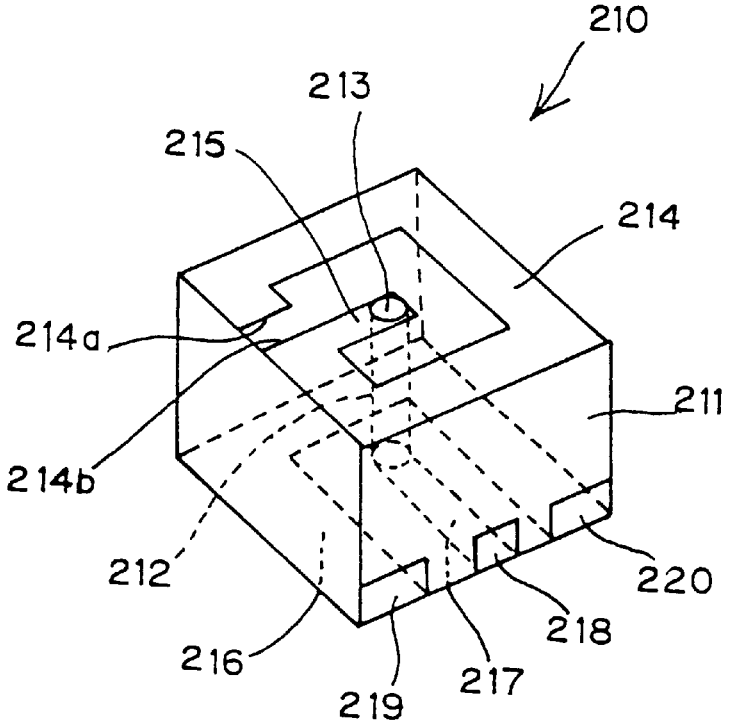
FIG. 14 is a perspective view showing an antenna device according to Embodiment 3 of the present invention.
Figure 15:
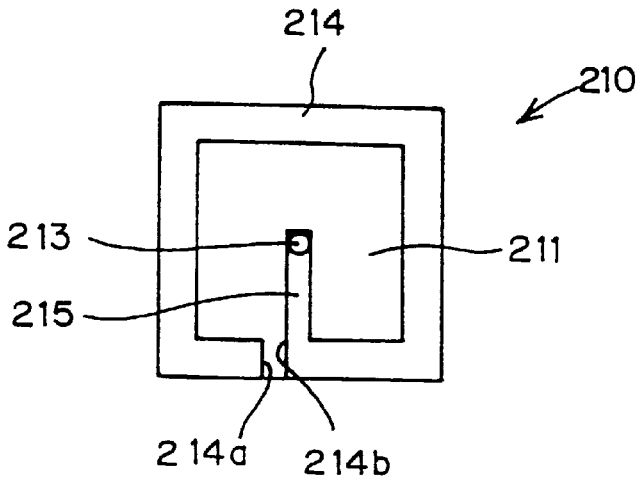
FIG. 15 is a top view of an antenna device as shown by FIG. 14.
Figure 16:
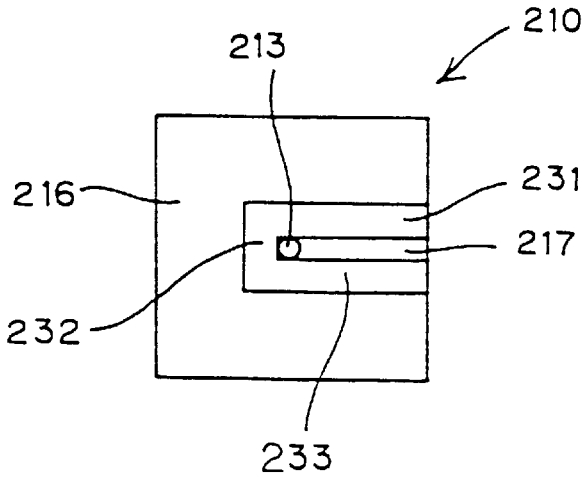
FIG. 16 is a bottom view of the antenna device as shown by FIG. 14.
Figure 17:
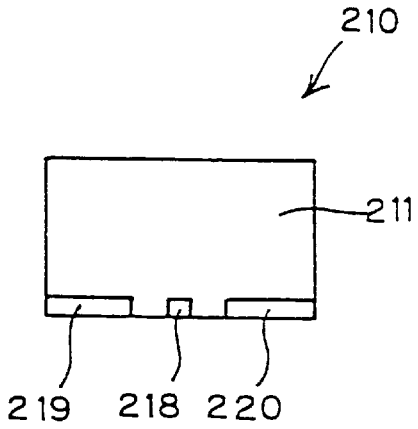
FIG. 17 is a side view of the antenna device as shown by FIG. 4.

FIG. 14 is a perspective view showing an antenna device according to Embodiment 3 of the present invention, FIG. 15 is a top view thereof, FIG. 16 is a bottom view thereof and FIG. 17 is a side view thereof.

An antenna device 210 shown by FIG. 14 is provided with a dielectric base body 211 and the dielectric base body 211 has an upper plane and a lower plane both in a square shape in parallel to each other and has a through hole 212 extending perpendicularly to the upper plane and the lower plane. The thickness of the dielectric base body 211 is adjusted to correspond to a quarter of the resonance wavelength of electromagnetic waves to be transmitted. A quarter wavelength monopole antenna structure is constituted by filling the through hole 212 with a monopole conductor 213.

A film-like loop conductor 214 having two mutually adjacent ends 214*a* and 214*b* and connecting the two ends 214*a* and 214*b* in a loop to extend along four sides of the upper face, is formed on the upper face of the dielectric base body 211 as shown by FIG. 15. The length of the loop conductor 214 is adjusted to constitute the resonance wavelength of the electromagnetic waves to be transmitted. A coupling line 215 is formed on the upper face to connect the end 214*b* of the loop conductor 214 to the monopole conductor 213.

As shown by FIG. 16, a film-like grounding conductor 216 extending in a channel-like shape to surround an end of the monopole conductor 213, is formed on the lower face of the dielectric base body 211. Further, a signal line 217 one end of which is connected to the monopole conductor 213 and which has gaps 231, 232, 233 at intermediaries with respect to the grounding conductor 216 and forms coplanar lines along with the grounding conductor 216, is formed on the lower face.

As shown by FIG. 17, a feed terminal 218 is formed at a side face of the dielectric base body 211 and the feed terminal 218 is connected to the signal line 217 (see FIG. 14). Ground terminals 219 and 220 connected to the grounding terminal 216 are formed on the same side face where the feed terminal 218 is formed, the feed terminal 218 between the ground terminals 219 and 220 (see FIG. 14).

The antenna device 210 constituted as described above, is provided with the film-like loop conductor 214 having a single wavelength loop antenna structure and has the monopole conductor 213 having a quarter length monopole antenna structure. Therefore, when electric current is supplied to the loop conductor 214 via the feed terminal 218, electromagnetic waves are radiated from the loop conductor 214 perpendicularly to a face of the dielectric base body 211 where the loop conductor 214 is formed and electromagnetic wave progressing toward the grounding conductor 216 are reflected by the grounding conductor 216. Meanwhile, electromagnetic waves radiated from the monopole conductor 213 have maximum gain in parallel with the face where the loop conductor 214 is formed. Accordingly, when the antenna device 210 is attached, for example, to a portable telephone, if it is attached such that the grounding conductor is disposed between a person and the loop conductor when the person uses the portable telephone, electromagnetic waves are not radiated to the side of the person but are effectively radiated to directions other than the direction toward the person.

Further, the antenna device 210 is provided with the signal line 217 forming coplanar lines along with the grounding conductor 216 and a desired line impedance is provided by fabricating the antenna device 210 where the width of the signal line 217 and the width of the gap between the signal line 217 and the grounding conductor 216 are adjusted. The antenna device 210 can be easily mounted to a circuit board by soldering or the like via the feed terminal 218 and the grounding terminals 219 and 220.

Figure 18:
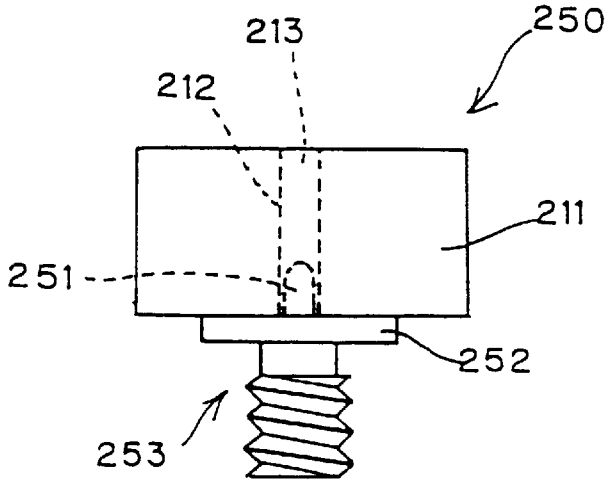
FIG. 18 is a side view showing an antenna device according to Embodiment 4 of the present invention.

FIG. 18 is a side view showing an antenna device according to Embodiment 4 of the present invention.

Elements corresponding to elements of Embodiment 3 shown by FIG. 14 through FIG. 17, are attached with the same notations.

On the upper face of the dielectric base body 211 constituting an antenna device, the loop conductor 214 and the coupling line 215 the same as those on the upper face (refer to FIG. 15) of the antenna device 210 shown by FIG. 14 through FIG. 17, are provided and the monopole conductor 213 is filled in the through hole 212 of the dielectric base body 211. Further, the grounding conductor 216 is extended on the lower face of the dielectric base body 211 except a portion of the lower end of the monopole conductor 213.

According to the antenna device 250, a coaxial connector 253 is fixed to the lower face of the dielectric base body 211. The coaxial connector 253 is provided with a central conductor 251 and a grounding conductor 252, the central conductor 251 is inserted into the through hole 212 of the dielectric base body 211 and is connected to the monopole conductor 213 and the grounding conductor 252 is extended in a planar shape and is connected to the grounding conductor 216 formed on the lower face of the dielectric base body 211.

Since the antenna device 250 is provided with the coaxial connector 253, the antenna device 250 is connected to a circuit board or the like via a coaxial cable (not illustrated) coupled to the coaxial connector 253.

Figure 19:
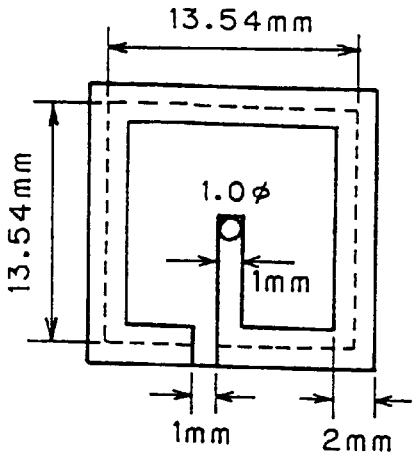
FIG. 19 is a view showing dimensions of a pattern printed on an upper face of a dielectric base body.
Figure 20:
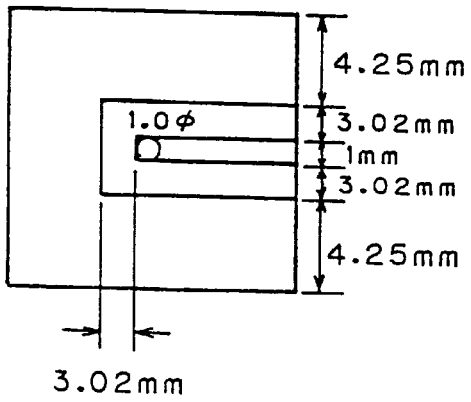
FIG. 20 is a view showing dimensions of a pattern printed on a lower face of the dielectric base body.
Figure 21:
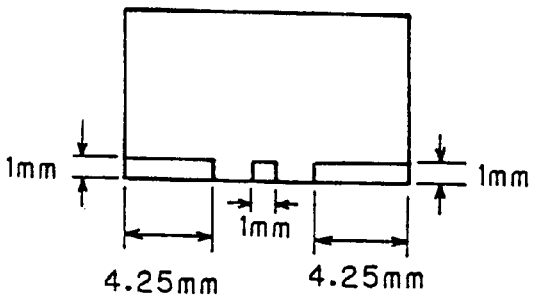
FIG. 21 is a view showing dimensions of a pattern printed on a side face of the dielectric base body.

An explanation will be given of a procedure of fabricating the antenna device 210 shown by FIG. 14 through FIG. 17 in reference to FIG. 14, FIG. 19, FIG. 20 and FIG. 21. FIG. 19, FIG. 20 and FIG. 21 show dimensions of patterns printed on an upper face, a bottom face and a side face of a dielectric substrate, respectively. An explanation will be given thereafter of a result provided by measuring the gain of the antenna device 210.

First, a material of dielectric base body 211 is selected. A material having dielectric constant in a range of 10 through 100 in a frequency band of transmitted and received electromagnetic waves is preferred. For example, $Sr(Ni_{1/3}Nb_{2/3})O_3$ group ceramic may be selected. This material has a dielectric constant of 31 when a frequency of transmitted and received electromagnetic waves is 3.8 GHz and the Q value is 1800.

Next, the dimensions of the film-like loop conductor 214, the dimensions of the signal line 217 and the width of the gaps 231, 232 and 233 between the signal line 217 and the grounding conductor 216, are determined. These values are determined as follows.

When the length of the loop conductor 214 is designated by notation $\lambda$,$\lambda$ can be represented by Equation (4). Equation (4) is shown below.

$$\lambda = \lambda_0 \Big/ \sqrt{(\varepsilon_{reff})} \tag{5}$$

where $\lambda_0$ is wavelength of transmitted or received electromagnetic waves in vacuum and $\in_{reff}$ is effective dielectric constant.

Further, the effective dielectric constant $\in_{reff}$ can be represented by the following equation in consideration of the fact that the electromagnetic waves radiated from the film-like loop conductor 214 as shown by FIG. 14, is propagated perpendicularly to the face of the dielectric base body 211 where the film-like loop conductor 214 is formed and electric fields are generated on the inner side and the outer side of the loop conductor 214.

$$\in_{reff} (\in_r+3)/4 \tag{6}$$

where $\in_r$ is a dielectric constant of dielectric substrate.

Accordingly, $\lambda$ can be calculated by calculating the effective dielectric constant $\in_{reff}$ by using Equation (6) and substituting the calculated value of $\in_{reff}$ for Equation (5).

In this case, the resonance frequency of transmitted and received electromagnetic waves is set to 1.9 GHz and accordingly, $\lambda$ is determined as $\lambda$=54.11 mm and in order to form the loop conductor 214 as shown by FIG. 14, the length of a side of the loop conductor 214 is determined to be 13.54 mm as shown by FIG. 19. The broken lines shown in FIG. 19 designate center lines of the respective sides of the loop conductor 214. Although the impedance of a single wavelength loop antenna is generally as high as 100Ω or higher, impedance of the antenna device 210 can be lowered by adjusting the width of the loop conductor and an interval between the two ends of the loop conductor, thereby promoting electrical feed efficiency to the antenna.

In order to set the impedance to 50Ω, the width of the loop conductor 214 is determined to be 2 mm and the interval between two ends 214*a* and 214*b* is determined to be 1 mm as shown by FIG. 19. Further, as shown by FIG. 14, the signal line and the grounding conductor constitute the coplanar lines and therefore, line impedance can be adjusted by adjusting the width of the signal line and the width of the gap between the signal line and the grounding conductor. in this case, in order to set the line impedance to 50Ω, the width of the signal line is set to 1 mm and all of the widths of the gaps 231, 232 and 233 are determined to be 3.02 mm as shown by FIG. 20.

Next, both of the length and the width of the dielectric base body 211 are determined to be 15.54 mm in accordance with the dimensions of the loop conductor 214 determined as described above. The thickness of the dielectric base body 211 is determined to be 7.09 mm corresponding to a quarter of a length of an electromagnetic wave having the resonance frequency of 1.9 GHz in the dielectric base body 211. Thereby, the dielectric base body 211 having the above-described dimensions and having the through hole 212 having the diameter of 1 mm in the thickness direction of the dielectric base body, is fabricated.

Next, respective patterns of the film-like loop conductor 214, the signal line 218, the coupling line 215, the grounding conductor 216, the feed terminal 218 and the ground terminals 219 and 220 are printed by a thick film printing process by using a copper paste. The film-like loop conductor is printed to have the above-described dimensions whereas the coupling line 215 is printed with the width of 1 mm as shown by FIG. 19, the grounding conductor 216 is printed with the width of 4.25 mm as shown by FIG. 20, the feed terminal 218 is printed with the width and the length of 1 mm as shown by FIG. 21, and the ground terminals 219 and 220 are printed with the width and the length of 1 mm and 4.25 mm, respectively, as shown by FIG. 21. Further, a copper paste is filled in the through hole 212 of the dielectric base body 211.

Next, the dielectric base body 211 where a copper paste is printed and filled as mentioned above, is sintered in a reducing atmosphere.

In this way, the antenna device 210 shown by FIG. 14 was fabricated.

Figure 22:
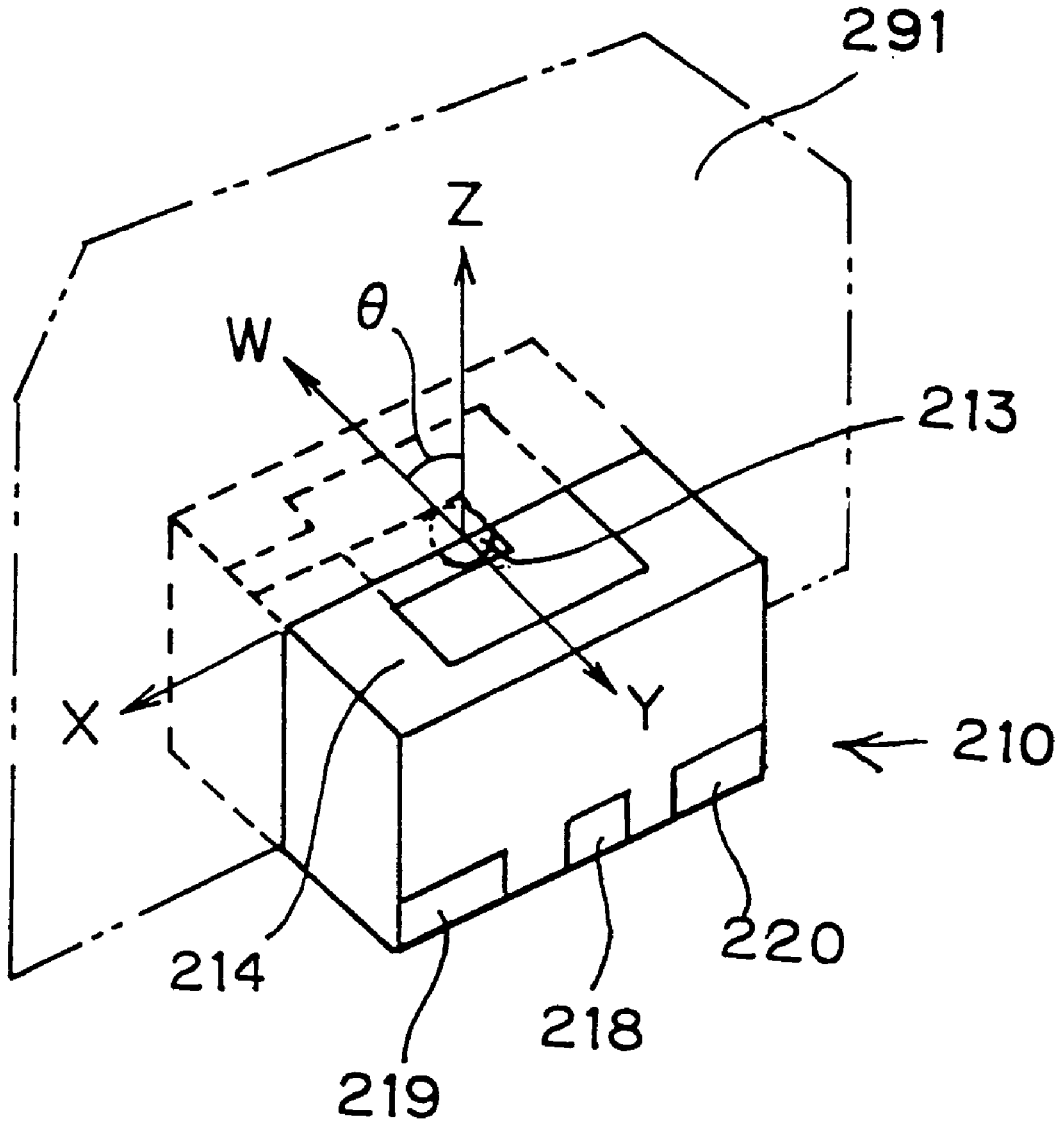
FIG. 22 is a view used in explaining the gain characteristic of an antenna device.

Next, an explanation will be given of the gain characteristic of the antenna device 210 fabricated as described above in reference to FIG. 22 and FIG. 23. Here, as the gain characteristic of the antenna device 210, as shown by FIG. 22, the gain characteristic in a plane 291 in parallel with the side face of the antenna device 210 where the feed terminal 218, and the ground terminals 219 and 220 are formed, and including the monopole conductor 213, is obtained. Further, X-axis, Y-axis and Z-axis shown by FIG. 22 intersect with each other by 90°, X-axis is an axis included in the plane 291 and in parallel with the loop face of the loop conductor 214, Y-axis is an axis perpendicular to the face 291 and Z-axis is an axis included in the plane 291 and directed in a direction the same as a direction of extending the monopole conductor 213. Further, an arrow mark W is an arrow mark with a point of intersection of X-axis, Y-axis and Z-axis as an origin and included in the plane 291 and angle θ is an angle made by the arrow mark W and Z-axis. X-axis, Z-axis and angle θ shown in FIG. 23, explained below, respectively correspond to X-axis, Z-axis and angle θ shown by FIG. 22. Further, a direction from the center of FIG. 23 perpendicularly to paper face on which FIG. 23 is printed and directed upward, corresponds to the Y-axis shown by FIG. 22.

Figure 23:
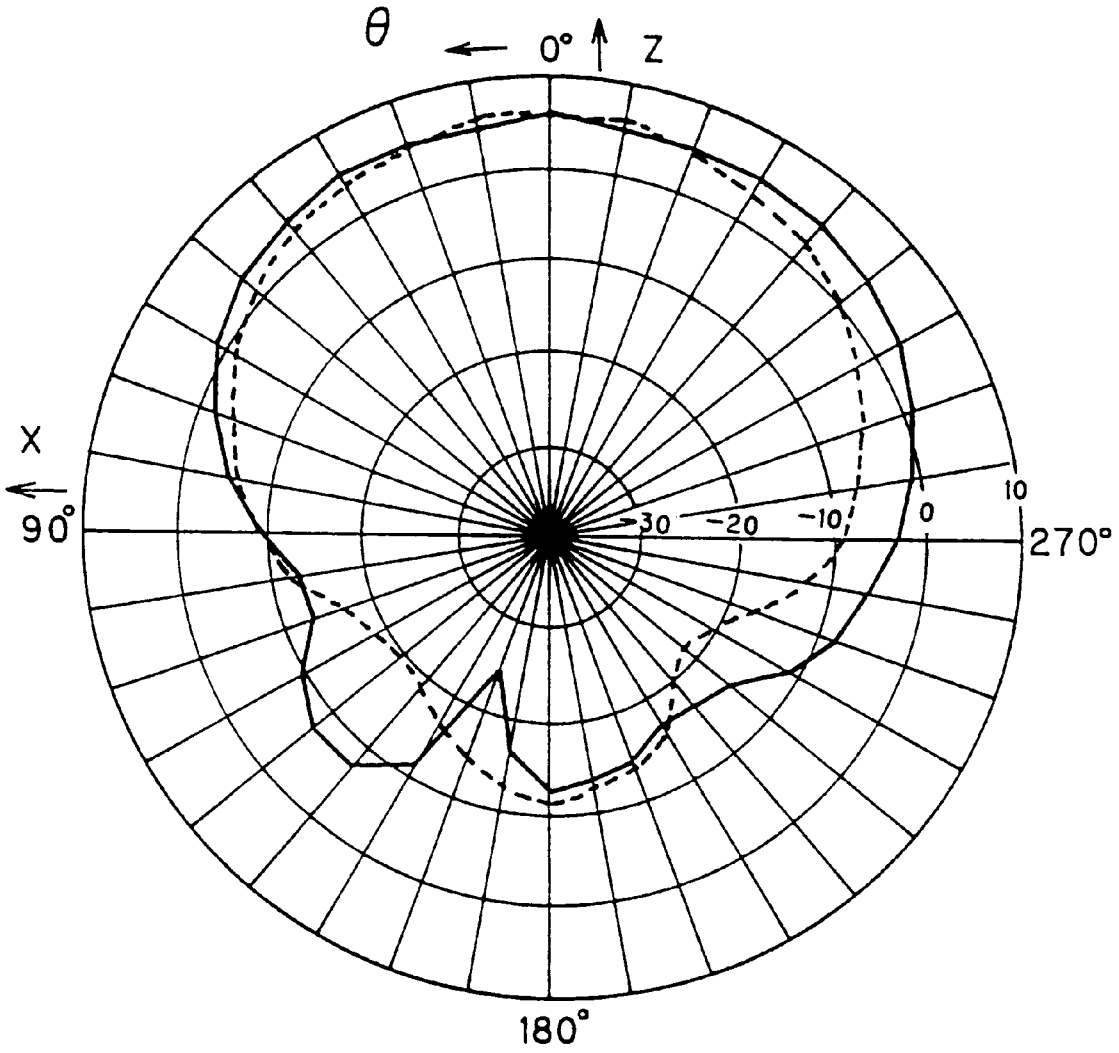
FIG. 23 is a view showing the gain characteristic of an antenna device.

FIG. 23 is a diagram showing the gain characteristic of the antenna device and the bold line designates the gain in a direction designated by the arrow mark in a range of $0° \leqq \theta \leqq 360°$ in the face 291 of the antenna device 210 fabricated after being subjected to the above-described fabrication procedure. The broken line shows the gain in a direction the same as the direction designated by the arrow mark W in the range of $0° \leqq \theta \leqq 360°$ of an antenna device having only the single wavelength loop antenna structure.

As shown by FIG. 23, maximum gain of 26 dB is indicated when θ=0° in either of the antenna devices, however, in the range of θ of 30° through 90° or 270° through 330°, the antenna device shown by FIG. 14 has a higher gain and particularly, in the range of θ of 270° through 300°, the antenna device shown by FIG. 14 has a gain 5 dB or more higher than the gain of the antenna device having only the single wavelength loop antenna structure.

In this way, it is known that the antenna device 210 shown by FIG. 14 is provided with the gain higher than that of the antenna device having only the single wavelength loop antenna structure.

Figure 24:
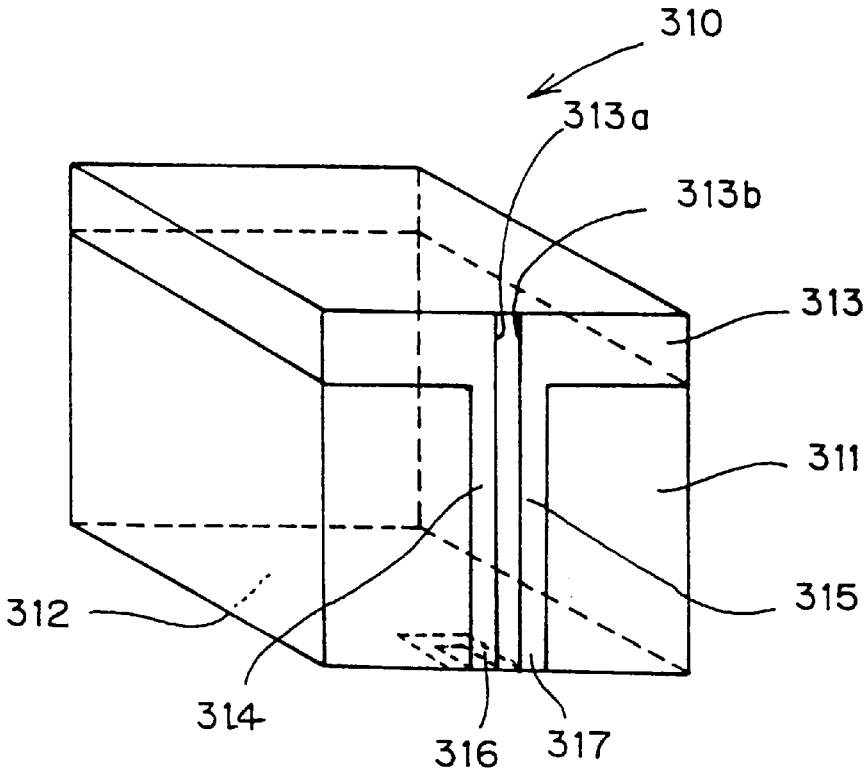
FIG. 24 is a perspective view showing an antenna device according to Embodiment 5 of the present invention.
Figure 25:
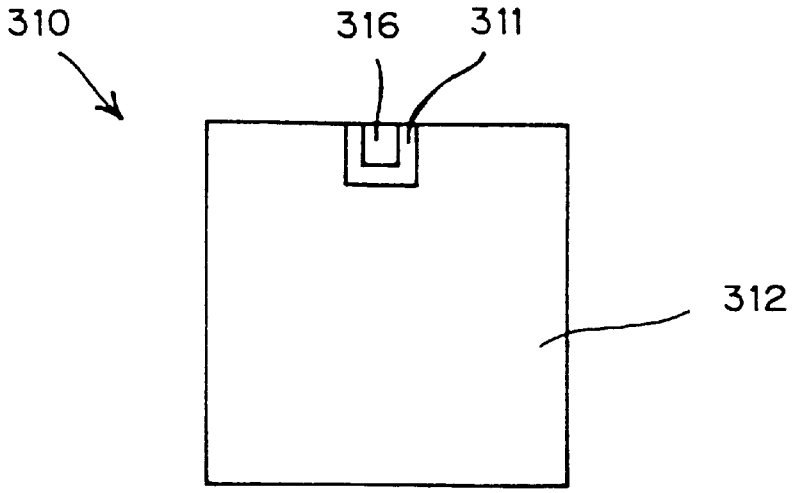
FIG. 25 is a bottom view showing the antenna as shown by FIG. 24.

FIG. 24 is a perspective view showing an antenna device 310 according to Embodiment 5 of the present invention and FIG. 25 is a bottom view thereof.

The antenna device 310 shown by FIG. 24 is provided with the dielectric base body 311 in a rectangular parallelepiped shape having an upper face of a square shape and a lower face of a square shape, a grounding conductor film 312 extending in a planar shape is formed on the lower face of the dielectric base body 311, and the grounding conductor film 312 is provided with the shape where a portion of a side is notched. Two adjacent left and right ends 313*a* and 313*b* are provided on a side face of the dielectric base body 311 and a radiating conductor film 313 connecting the two ends 313*a* and 313*b* by making a turn on side faces along four sides of the upper face of the dielectric base body 311. The length of the radiating conductor film 313 is adjusted to a length the same as the resonance wavelength of electromagnetic waves to be transmitted.

In addition, FIG. 24 illustrates two feeding conductor films 314 and 315 which are extended in the up and down direction in parallel to each other, one of which is connected to the left end 313*a* and the other one of which is connected to the right end 313*b*. The feeding conductor film 315 is connected to the grounding conductor film 312 and the feeding conductor film 314 reaches the lower face of the dielectric base body 311 as shown by FIG. 25. Further, portions of the feeding conductor films 314 and 315 on the side of the grounding conductor film 312, also serve as feed electrodes 316 and 317 which are electrodes for mounting to the surface of a circuit board.

Since the antenna device 310 constituted as described above, is provided with the radiating conductor film 313 having a single wavelength loop antenna structure, when electric current is supplied to the radiating conductor film 313 via the feed electrode 316, electromagnetic waves are radiated from the radiating conductor film 313 have maximum gain oriented perpendicularly to the upper face of the dielectric base body 311 and electromagnetic waves progressing toward the grounding conductor film 312 are reflected by the grounding conductor film 312. That is, the electromagnetic waves radiated from the antenna device 310 have a maximum gain perpendicular to the plane including the radiating conductor film 313 and in a direction from the grounding conductor film 312 toward the radiating conductor film 313. Accordingly, the antenna device 310 is capable of efficiently radiating high gain electromagnetic waves used in communication.

Further, it is not necessary to form a through hole in the dielectric base body 311 and accordingly, a reduction in fabrication cost can be achieved.

An explanation will be given of the fabrication method of the antenna device 310 having the structure shown by FIG. 24 and FIG. 25 in reference to FIG. 26 indicating dimensions of the dielectric base body, the radiating conductor film and the feeding conductor film.

First, a material of the dielectric base body 311 is selected. A material having a dielectric constant in a range of 10 through 100 in a frequency band of transmitted and received electromagnetic waves, is preferred. For example, a $Sr(Ni_{1/3}Nb_{2/3})O_3$ group ceramic may be utilized. The dielectric constant of this material is 31 when the transmitted and received electromagnetic waves have a frequency of 4 GHz and a Q value is 1000.

Next, dimensions of the radiating conductor film 313, the feeding conductor films 314 and 315, and the dielectric base body 313 are determined. These dimensions can be determined as follows.

When the length of the radiating conductor film 313 is designated by notation λ, λ can be represented by Equation (4) mentioned above. Equation (4) is shown as follows.

$$\lambda = \lambda_0 \Big/ \sqrt{(\varepsilon_{reff})} \tag{7}$$

where $\lambda_0$ is wavelength of electromagnetic wave in vacuum and $\in_{reff}$ is effective dielectric constant.

Figure 26:
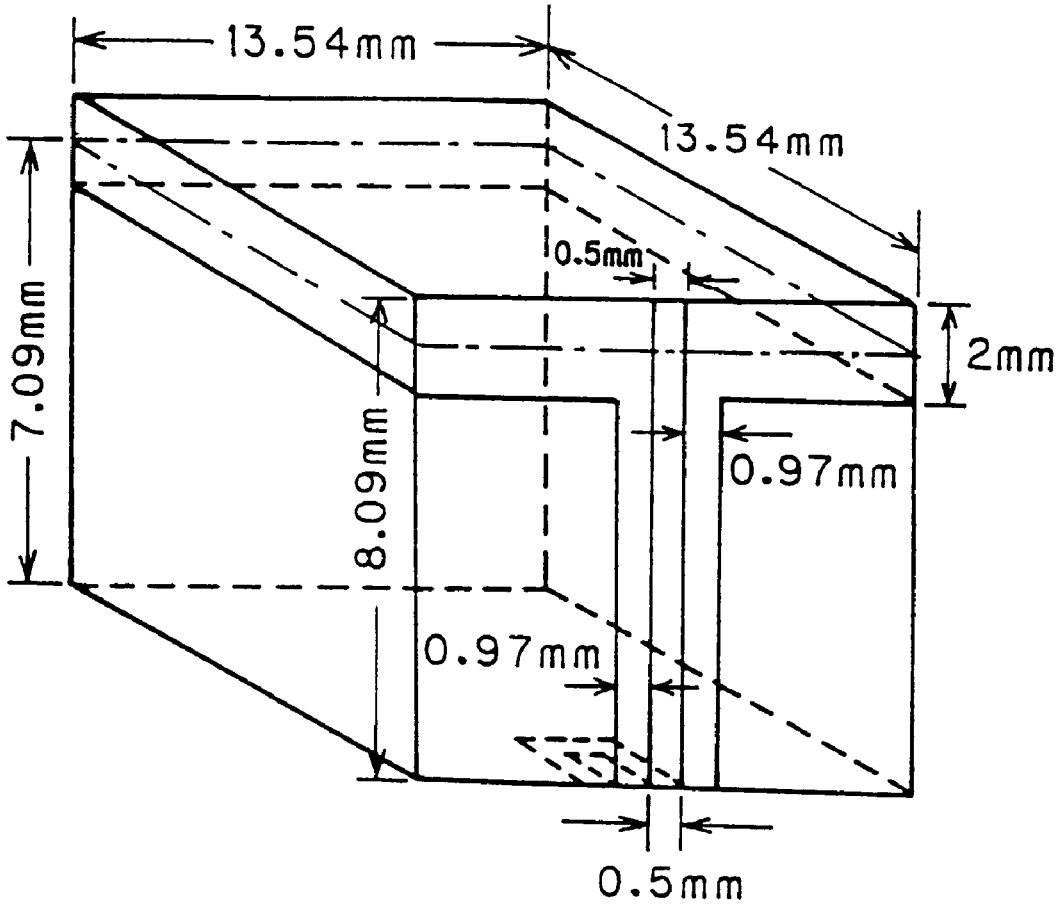
FIG. 26 is a view showing dimensions of a dielectric base body, a radiating conductor film and feeding conductor films.

Further, the effective dielectric constant $\in_{reff}$ can be represented by the following equation in consideration of the fact that electromagnetic wave radiated from the radiating conductor film 313 as shown by FIG. 26 is propagated perpendicularly to the upper face of the dielectric base body 311 and electric fields are generated on the inner side and the outer side of the radiating conductor film 313.

$$\in_{reff} = (\in_r + 3)/4 \tag{8}$$

where $\in_{reff}$ is a dielectric constant of dielectric base body.

Accordingly, λ can be calculated by calculating the effective dielectric constant $\in_{reff}$ by Equation (8) and substituting the calculated value of $\in_{reff}$ for Equation (7)

When the resonance frequency of transmitted and received electromagnetic waves is set to 1.9 GHz, λ is determined as λ=54.16 mm and the length of a side of the radiating conductor film 313 is set to 13.54 mm in order to form the radiating conductor film extending along four sides of the upper face in a square shape of the dielectric base body 311 as shown by FIG. 26. Further, although the impedance of a single wavelength loop antenna is generally as high as 100Ω or higher, the impedance can be lowered by adjusting the width of the radiating conductor film and the interval between two ends of the radiating conductor film, thereby promoting electrical feed efficiency. For example, in order to set impedance to 50Ω, a width of the radiating conductor film 313 is set to 2 mm and the interval between the two ends is set to 0.5 mm as shown by FIG. 26.

Both of the length and the width of the dielectric base body 311 is set to 13.54 mm in accordance with the dimensions of the radiating conductor film 313 determined as described above. Further, thickness of the dielectric base body 311 is determined as follows.

The efficiency of the antenna device having the loop antenna structure as shown by FIG. 26, is maximized when the distance between the radiating conductor film and the grounding conductor film formed on the lower face of the conductor base body, is a distance corresponding to a quarter of the resonance wavelength of electromagnetic waves in the dielectric base body. Accordingly, when the resonance frequency of electromagnetic wave is set to 1.9 GHz, the distance between the radiating conductor film and the grounding conductor film for maximizing the efficiency of the antenna device, is set to 7.09 mm corresponding to a quarter of the resonance wavelength of electromagnetic wave having the resonance frequency of 1.9 GHz in the dielectric base body. Here, the one-dotted chain line as shown by FIG. 26 designates centers of respective sides of radiating conductor film 313. Further, since the width of the radiating conductor film 313 is set to 2 mm as shown by FIG. 26, the thickness of the dielectric base body 311 is determined as 8.09 mm. Accordingly, the length, the width and the thickness of the dielectric base body 311 are respectively 13.54 mm, 13.54 mm and 8.09 mm.

Further, the desired transmission impedance is obtained by adjusting the width of the feeding conductor film and the interval between the feeding conductor films. In this case, both of the widths of the feeding conductor films 314 and 315 are set to 0.97 mm and the interval between the feeding conductor films 314 and 315 is set to 0.5 mm as shown by FIG. 26 in order to set the transmission impedance to 50Ω.

Next, the dielectric base body 311 having the above described dimensions is fabricated, patterns of the grounding conductor film 312, and the radiating conductor film 313 and the two feeding conductor films 314 and 315 both having the above-described dimensions, are printed on the dielectric base body 311 by the thick film printing process by using a copper paste and sintered in a reducing atmosphere, thus fabricating the antenna device 310.

Figure 27:
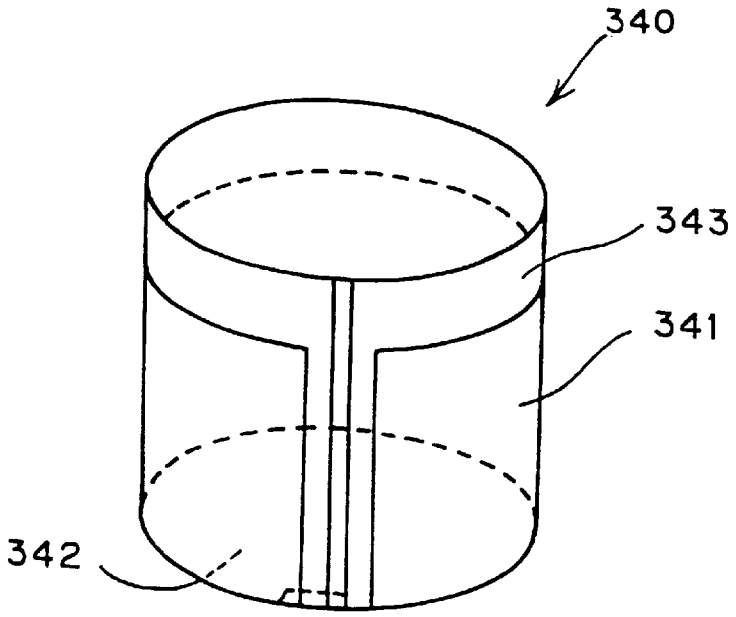
FIG. 27 is a perspective view showing an antenna device according to Embodiment 6 of the present invention.

FIG. 27 is a view showing an antenna device 340 according to Embodiment 6 of the present invention. A dielectric base body 341 having a cylindrical shape is adopted in an antenna device 340 in place of the dielectric base body 311 in a rectangular parallelepiped shape of the antenna device 310 shown by FIG. 24 and FIG. 25 whereby with respect to a radiating conductor film, a radiating conductor film 343 in a circular loop shape is formed and with respect to a grounding conductor film, a circular grounding conductor film 342 is formed.

As described above, the dielectric base body may be in a cylindrical shape.

Figure 28:
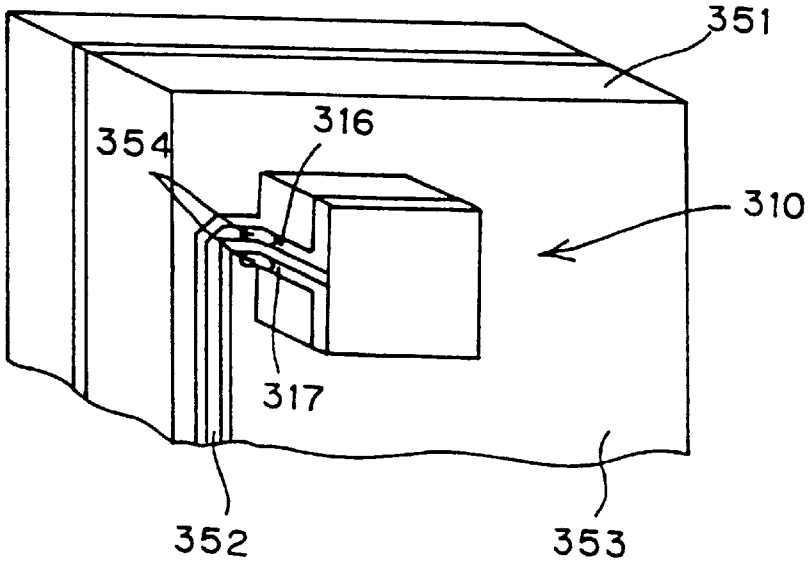
FIG. 28 is a view showing a state where the antenna device shown by FIG. 24 is mounted on a circuit board.

FIG. 28 is a view showing a state where the antenna device shown by FIG. 24 and FIG. 25 is mounted on a circuit board. A feed line 352 and a grounding conductor layer 353 are formed on the surface of a circuit board 351 and pairs of the feed line 352 and the feed electrode 316 of the antenna device 310, and the grounding conductor layer 353 and the feed electrode 317 of the antenna device 310, are connected to each other respectively by solders 354.

Figure 29:
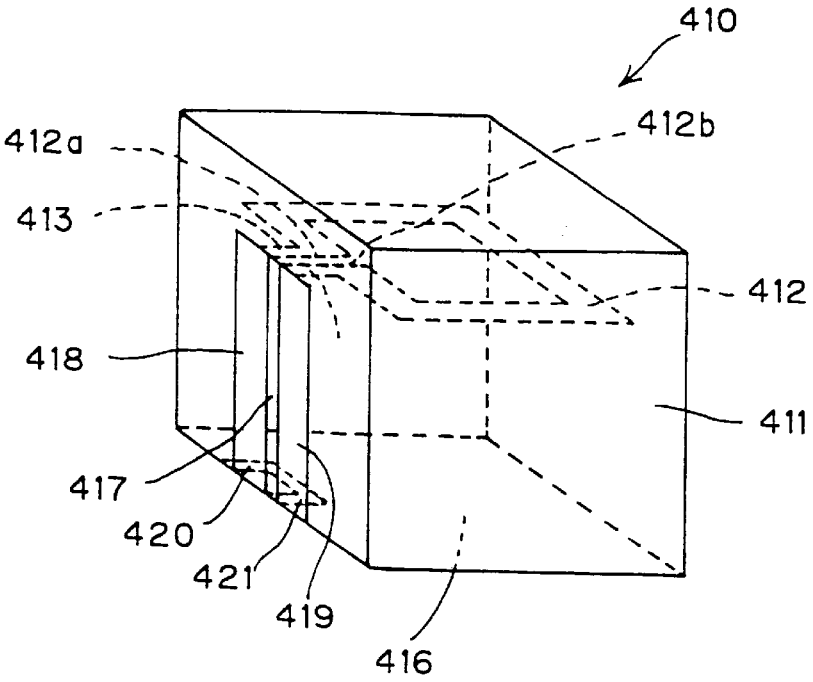
FIG. 29 is a perspective view showing an antenna device according to Embodiment 7 of the present invention.
Figure 30:
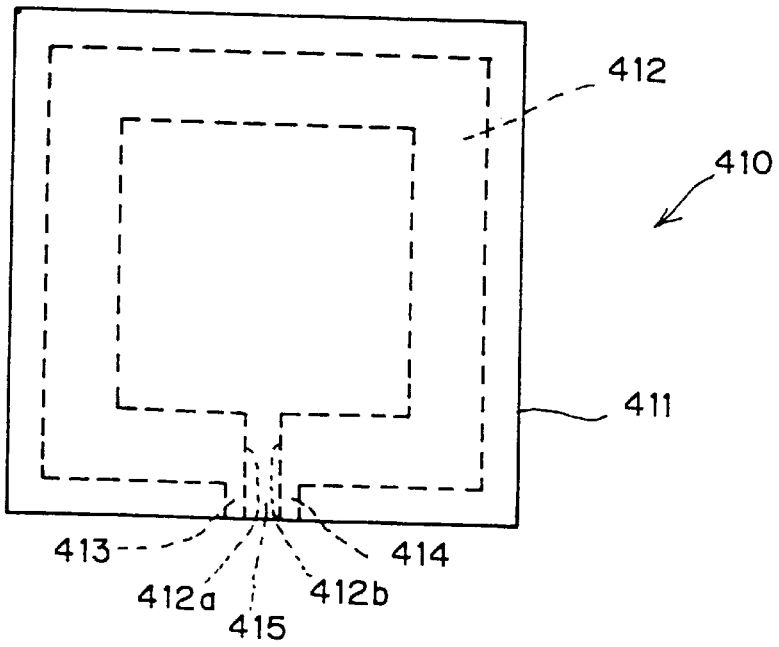
FIG. 30 is a top view of the antenna device as shown by FIG. 29.
Figure 31:
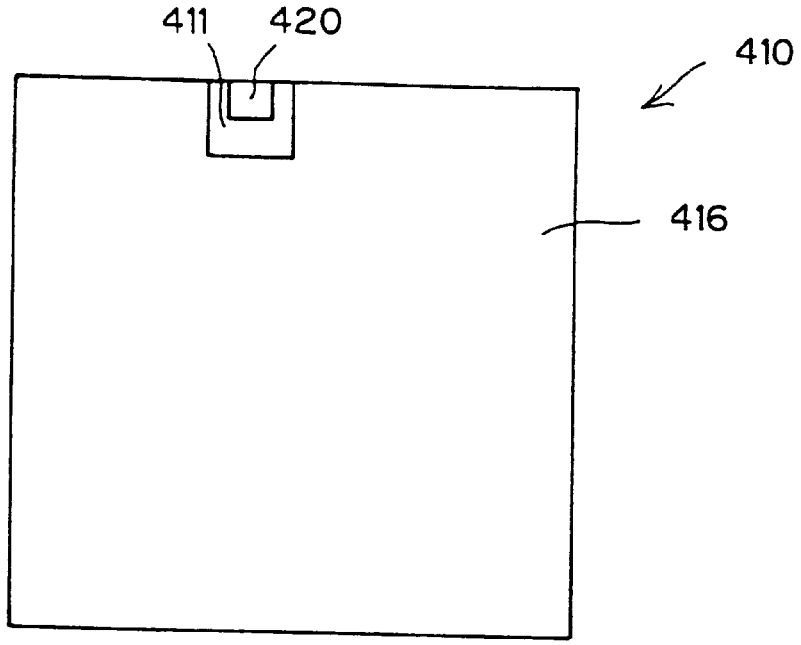
FIG. 31 is a bottom view of the antenna device as shown by FIG. 29.
Figure 32:
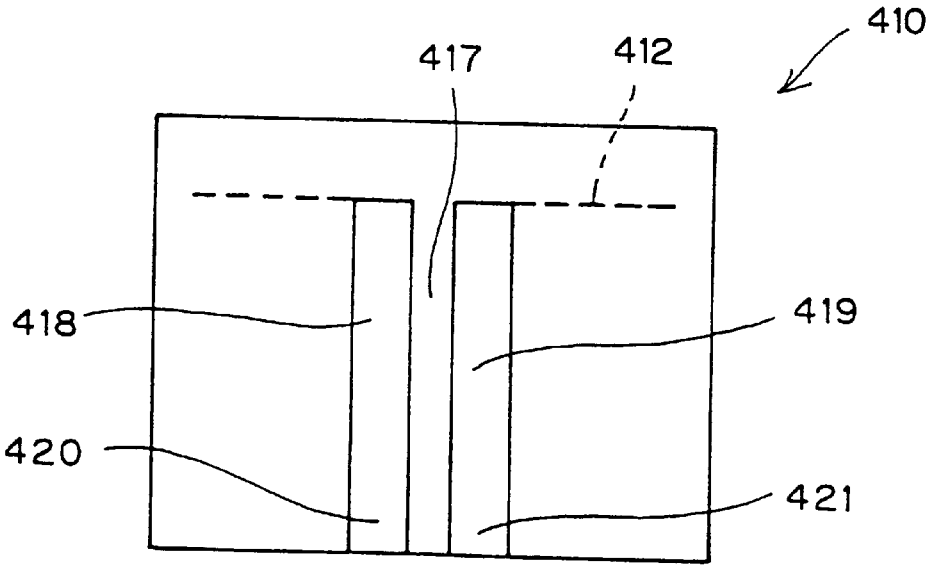
FIG. 32 is a side view of the antenna device as shown by FIG. 29.

FIG. 29 is a perspective view showing Embodiment 7 of an antenna device according to the present invention, FIG. 30 is a top view thereof, FIG. 31 is a bottom view thereof and FIG. 32 is a side view thereof.

A radiating conductor film 412 having two left and, right adjacent ends 412*a* and 412*b* and connecting the two ends 412*a* and 412*b* by making a turn in a loop-like shape on a horizontal face as shown by FIG. 30, is formed at the inside of a dielectric base body 411 in a rectangular parallelepiped shape constituting an antenna device 410 shown by FIG. 29. The length of the radiating conductor film 412 is adjusted to a length the same as the resonance wavelength of electromagnetic waves to be transmitted. Further, inner feeding conductor films 413 and 414 connected respectively to the two ends 412*a* and 412*b* of the radiating conductor film 412 and exposed on a side face of the dielectric base body 411, are formed in a plane including the radiating conductor film 412 at the inside of the dielectric base body 411. A gap 415 is provided between the inner feeding conductor films 413 and 414 and coplanar lines are formed therebetween.

As shown by FIG. 31, a grounding conductor film 416 is formed on the lower face of the dielectric base body 411 and the grounding conductor film 416 is provided with a shape where a portion of a side is notched. As shown by FIG. 32, side feeding conductor films 418 and 419 forming coplanar lines therebetween, which are extended in the up and down direction in parallel to each other to constitute a gap 417 therebetween and which are respectively connected to portions of the inner feeding conductor films 413 and 414 exposed on the side face as shown by FIG. 29, are formed on the side face of the dielectric base body 411.

One of the side face feeding conductor films 418 and 419, or the side face feeding conductor film 419 is connected also to the grounding conductor film 416 and the other one thereof, or the side face feeding conductor film 418 reaches the lower face of the dielectric base body 411. Further, portions of the side face feeding conductor films 418 and 419 on the side of the grounding conductor film 416, also serve as feed electrodes 420 and 421 which are electrodes utilized in mounting the antenna device 410 to the surface of a circuit board.

The antenna device 410 constituted as described above, is provided with the radiating conductor film 412 having a single wavelength loop antenna structure and therefore, when electric current is supplied to the radiating conductor film 412 via the feed electrode 420, electromagnetic waves radiated from the radiating conductor film 412 have maximum gain in a direction perpendicular to a plane including the radiating conductor film 412, and electromagnetic waves progressing toward the grounding conductor film 416 are reflected by the grounding conductor film 416. That is, electromagnetic waves are radiated from the antenna device 410 have a maximum gain in a direction from the grounding conductor film 416 to the radiating conductor film 412. Accordingly, the antenna device 410 is capable of efficiently radiating high gain electromagnetic waves for communication.

Further, the antenna device 410 is provided with the inner feeding conductor films 413 and 414 forming coplanar lines therebetween and the side face feeding conductor films 418 and 419 forming coplanar lines therebetween and a desired transmission impedance can be provided by fabricating the antenna device 410 where the widths of the respective inner feeding films 413 and 414, the widths of the side face feeding conductor films 418 and 419, the gap width of the gap 415 between the inner feeding conductor films 413 and 414, and the gap width of the gap 417 between the side face feeding conductor films 418 and 419 are adjusted.

According to the antenna device 410, the radiating conductor film 412 is formed at the inside of the dielectric base body 411 whereby downsizing can be realized. Also, the portions of the feeding conductor films 418 and 419 on the side of the grounding conductor film 416, also serve as feed electrodes 420 and 421, respectively, and therefore, the antenna device 410 is easily mounted onto a circuit board by soldering or otherwise.

Figure 33:
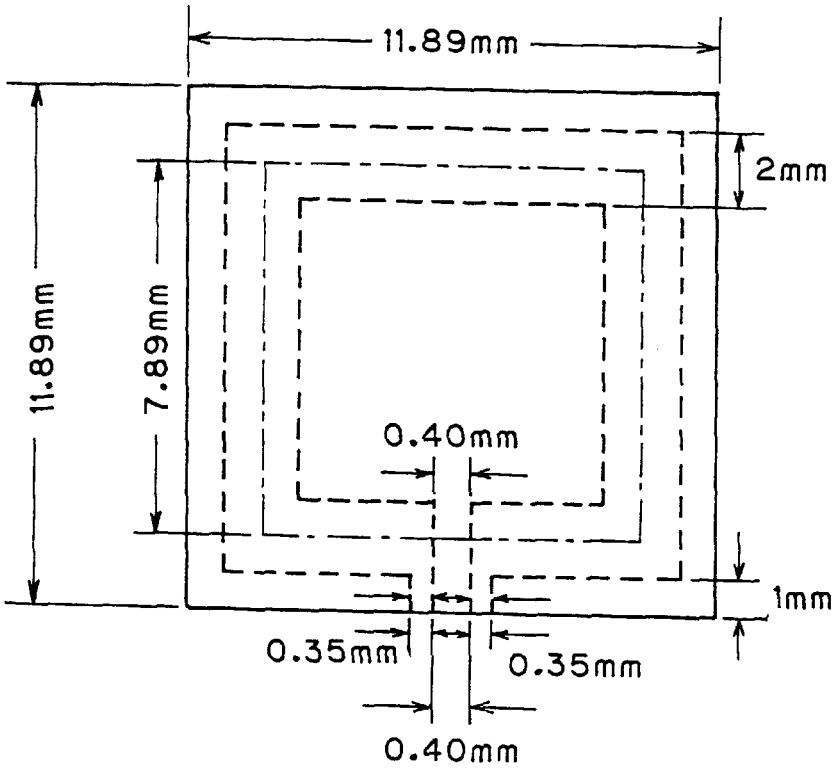
FIG. 33 is a view showing a length and a width of a dielectric base body and dimensions of radiating conductor film and inner feeding conductor films.
Figure 34:
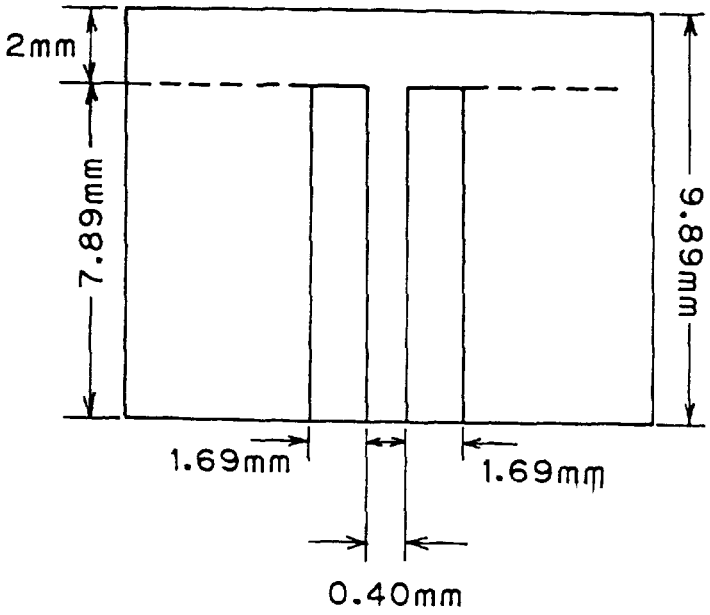
FIG. 34 is a view showing a thickness of the dielectric base body and dimensions of side feeding conductor films.

An explanation will be given of the fabrication method of the antenna device 410 shown by FIG. 29 in reference to FIG. 29, FIG. 33 and FIG. 34. FIG. 33 is a top view of the antenna device 410 showing the length and the width of the dielectric base body 411 and the dimensions of the radiating conductor film and the inner feeding conductor films. FIG. 34 is a side view of the antenna device 410 showing the thickness of the dielectric base body and the dimensions of the side face feeding conductor films.

First, the material of the dielectric base body 411 is selected. A material having a dielectric constant in a range of 10 through 100 in a frequency band of transmitted and received electromagnetic waves, is preferred. Further, according to the antenna device 410, the radiating conductor film 412 is formed at the inside of the dielectric base body 411 as shown by FIG. 29 and therefore, a material capable of being sintered at low temperatures is preferable. For example, a material of a $Sr(Ni_{1/3}Nb_{2/3})O_3$ group ceramic added with glass may be utilized. This material has a dielectric constant of 25 when the transmitted and received electromagnetic waves have a frequency of 6 GHz, a Q value 1000, and a sintering temperature of 1000° C.

Next, the dimensions of the radiating conductor film 412, the inner feeding conductor films 413 and 414, the side face feeding conductor films 418 and 419 and the dielectric base body 411 are determined. These dimensions are determined as follows.

When the length of the radiating conductor film 412 is designated by notation λ, λ can be represented by the above-described Equation (4). Equation (4) is shown below.

$$\lambda = \lambda_0 \Big/ \sqrt{(\varepsilon_{reff})} \tag{9}$$

where $\lambda_0$ is wavelength of electromagnetic wave in vacuum and $\in_{reff}$ is effective dielectric constant.

According to the antenna device 410, $\in_{reff}$ coincides with the dielectric constant $\in_{reff}$ the dielectric base body 411 since the radiating conductor film 412 is formed at the inside of the dielectric base body 411. Accordingly, k is represented by the following equation.

$$\lambda = \lambda_0 \Big/ \sqrt{(\varepsilon_{reff})} \tag{10}$$

When the resonance frequency of electromagnetic wave is set to 1.9 GHz, λ is determined as λ=31.56 mm and in order to form the radiating conductor film 412 shown by FIG. 33, the length of one of sides of the radiating conductor film 412 is set to 7.89 mm. Here, the one-dotted chain line shown by FIG. 33 designates center lines of the respective sides of the radiating conductor film 412. Further, although impedance of a single wavelength loop antenna is generally as high as 100Ω or higher, the impedance may be lowered by adjusting the width of the radiating conductor film and the interval between the two ends of the radiating conductor film by which the electricity feed efficiency can be promoted. For example, in order to set the impedance to 50Ω, the width of the radiating conductor film is set to 2 mm and the interval between the two ends is set to 0.4 mm as shown by FIG. 33.

In order to form the radiating conductor film of which dimensions have been determined as described above such that, for example, a distance from the side face of the dielectric base body 411 to an outer peripheral edge of the radiating conductor film 412 is set to 1 mm as shown by FIG. 33, both of the length and the width of the dielectric base body 411 are set to 11.89 mm. Further, the thickness of dielectric base body is determined as follows.

The gain of the antenna device having the loop antenna structure as shown by FIG. 29, is maximized when a distance between the radiating conductor film and the grounding conductor film formed on the lower face of the dielectric base body, is a distance corresponding to a quarter of the resonance wavelength of electromagnetic waves to be transmitted and received. Accordingly, when the resonance frequency of the electromagnetic wave is set to 1.9 GHz, in order to maximize the gain of the antenna device, the distance between the radiating conductor film and the grounding conductor film is set to 7.89 mm. When the radiating conductor film 412 is formed such that, for example, the distance between the radiating conductor film 412 to the upper face of the dielectric base body 411 is set to 2 mm, the thickness of the dielectric base body is set to 9.89 mm as shown by FIG. 34. That is, the length, the width, and the thickness of the dielectric base body 411 are respectively set to 11.89 mm, 11.89=and 9.89 mm.

Further, a desired transmission impedance is obtained by adjusting the width of the inner feeding conductor film, the gap width of the gap between the inner feeding conductor films, the width of the side face feeding conductor film, and the gap width of the gap between the side face feeding conductor films. For example, in order to set the transmission impedance to 50Ω, both of the widths of the inner feeding conductor films 413 and 414 are set to 0.35 mm and the gap width of the gap 415 is set to 0.40 mm as shown by FIG. 33 and both of the widths of the side face feeding conductor films 418 and 419 are set to 1.69 mm and the gap width of the gap 417 is set to 0.40 mm as shown by FIG. 34.

Next, patterns of the radiating conductor film 412 and the inner feeding conductor films 413 and 414 having the above-described dimensions are printed at the inside of the dielectric base body 411 having the above-described dimensions by the thick film printing process by using a copper paste, patterns of the side face feeding conductor films 418 and 419 having the above-described dimensions are printed on the side face of the dielectric base body 411 by the thick film printing process by using a copper paste, and patterns of the feed electrode 420 and the grounding conductor film 416 are printed on the lower face of the dielectric base body 411 by the thick film printing process by using a copper paste. The entire assemblage is sintered in a reducing atmosphere, thus fabricating the antenna device 410.

Figure 35:
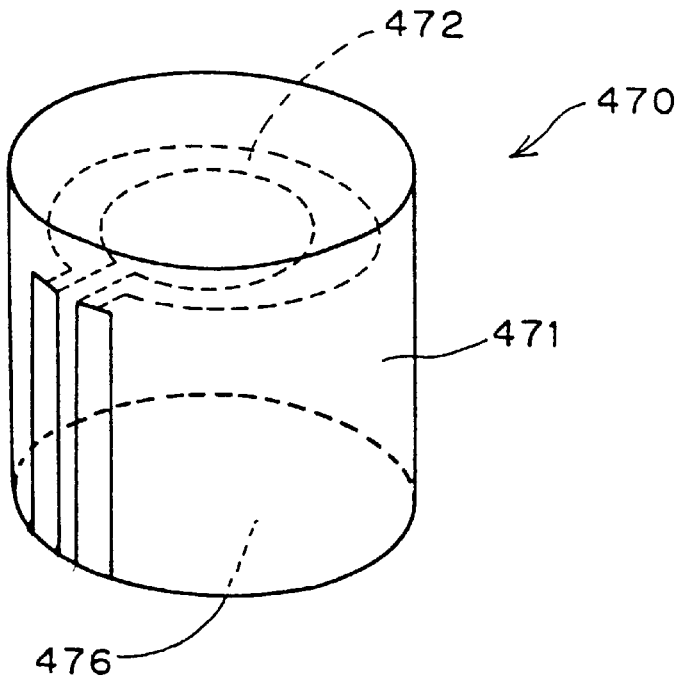
FIG. 35 is a view showing an antenna device according to Embodiment 8 of the present invention.

FIG. 35 is a view showing an antenna device 470 according to Embodiment 8 of the present invention. A dielectric base body 471 in a cylindrical shape is adopted in an antenna device 470 shown by FIG. 35 in place of the dielectric base body 411 in a rectangular parallelepiped shape of the antenna device 410 shown by FIG. 29 through FIG. 32 whereby with respect to a radiating the conductor film, a radiating conductor film 472 in a circular loop shape is formed and with respect to a grounding conductor film, a circular grounding conductor film 476 is formed.

Figure 36:
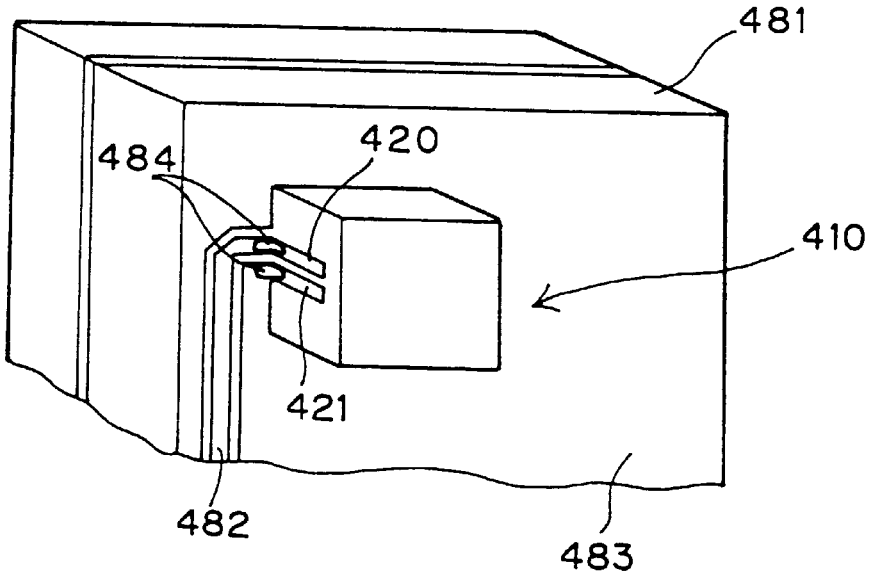
FIG. 36 is a view showing a state where the antenna device shown by FIG. 29 is mounted on a circuit board.

FIG. 36 is a view showing a state where the antenna device shown by FIG. 29 through FIG. 32 is mounted on a circuit board. A feed line 482 and a grounding conductor layer 483 are formed on the surface of a circuit board 481 and pairs of the feed line 482 and the feed electrode 420 of the antenna device 410, and the grounding conductor layer 483 and the feed electrode 421 of the antenna device 410 are respectively connected to each other by solders 484. In this way, the antenna device 410 is mounted onto the circuit board 481.

Figure 37:
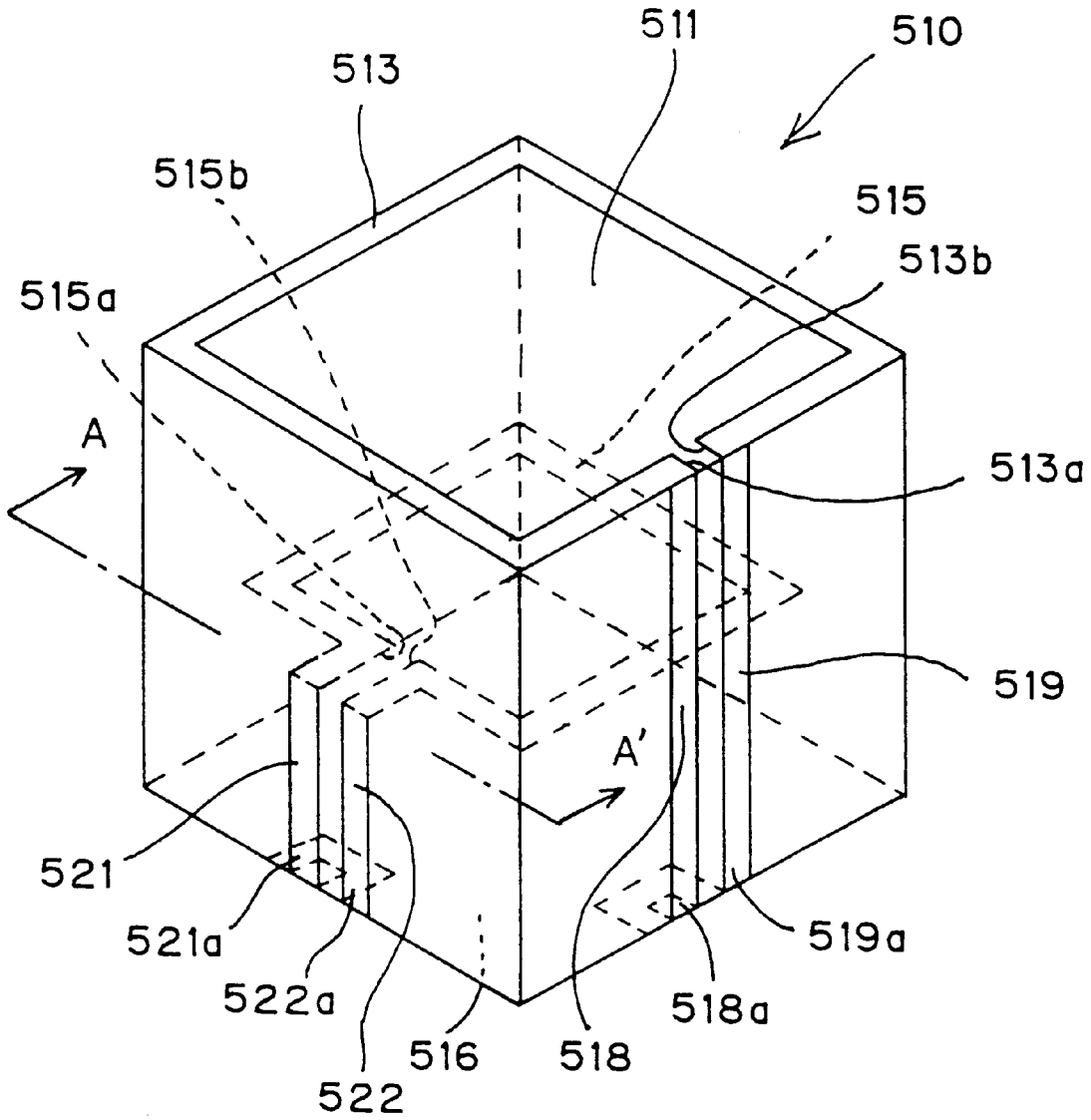
FIG. 37 is a perspective view of an antenna device according to Embodiment 9 of the present invention.
Figure 38:
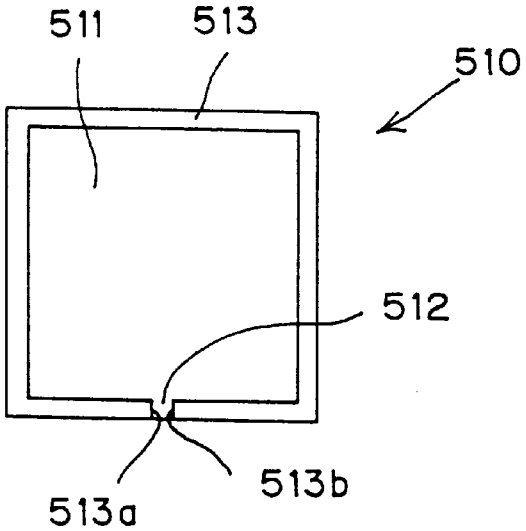
FIG. 38 is a top view of the antenna device as shown by FIG. 37.
Figure 39:
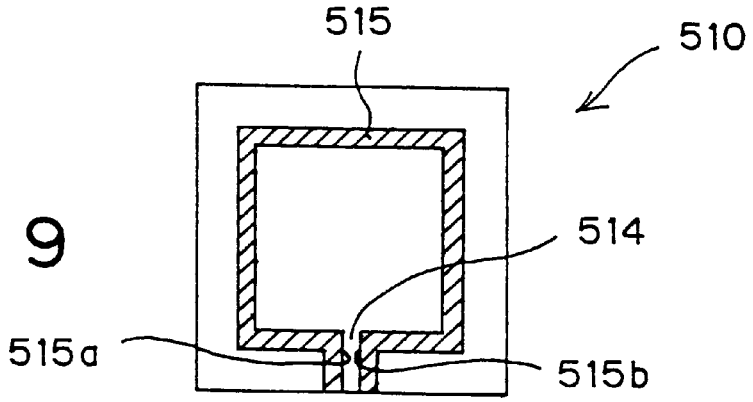
FIG. 39 is a sectional view taken from a line A-A' of the antenna device as shown by FIG. 37.
Figure 40:
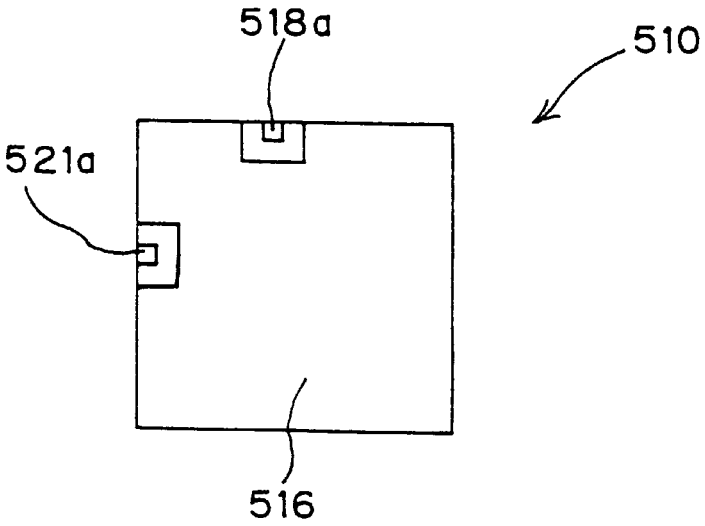
FIG. 40 is a bottom view of the antenna device as shown by FIG. 37.
Figure 41:
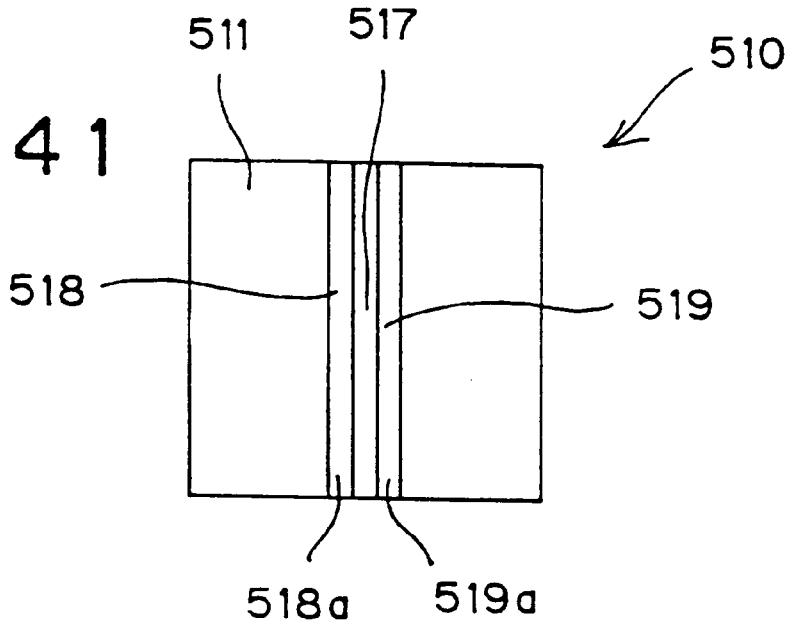
FIG. 41 is a view showing a side face of the antenna device as shown by FIG. 37 where first feeding conductor films are formed.
Figure 42:
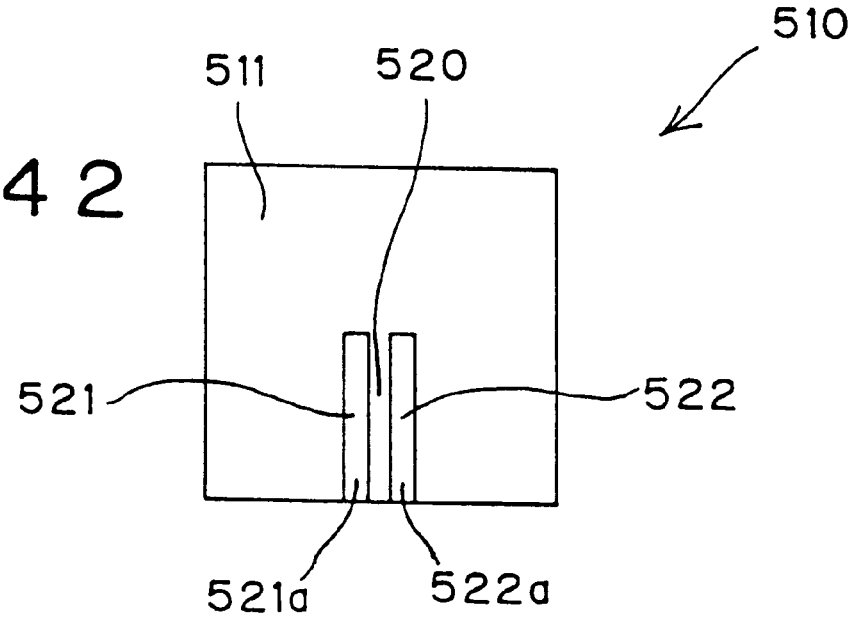
FIG. 42 is a view showing a side face of the antenna device as shown by FIG. 37 where second feeding conductor films are formed.

FIG. 37 is a perspective view showing an antenna device 510 according to Embodiment 9 of the present invention, FIG. 38 is a top view thereof, FIG. 39 is a sectional view taken from a line A-A' of FIG. 37, FIG. 40 is a bottom view thereof, FIG. 41 is a view showing a side face of the antenna device shown by FIG. 37 where first feeding conductor films are formed and FIG. 42 is a view showing a side face of the antenna device 510 where second feeding conductor films are formed.

Antenna device 510 is provided with a dielectric base body 511 in a rectangular parallelepiped shape having an upper face and a lower face in a square shape. A first loop radiating conductor film 513 is formed on the upper face of the dielectric base body 511 to extend along four sides of the upper face. The first loop radiating conductor film 513 makes a turn on the upper face to form two ends 513*a* and 513*b* opposed to each other via a first gap 512 as shown by FIG. 38 and the length of the loop is adjusted to a length the same as the resonance wavelength of electromagnetic waves to be transmitted and received.

Further, a second loop radiating conductor film 515 which makes a turn on a horizontal face in a square shape, is formed at the inside of the dielectric base body 511. As shown by FIG. 39, the second loop radiating conductor film 515 makes a turn on a horizontal plane to form two ends 515*a* and 515*b* opposed to each other via a gap 514. As shown by FIG. 37, the direction of the second gap 514 in respect of the loop of the second loop radiating conductor film 515, is adjusted in a direction that is different from the direction of the first gap 512 in respect of the loop of the first loop radiating film 513 by 90° in the horizontal plane. Further, the length of the second loop radiating conductor film 515 is adjusted to a length the same as the resonance wavelength of electromagnetic waves to be transmitted and received.

As shown by FIG. 40, a grounding conductor film 516 is formed on the lower face of the dielectric base body 511 and is provided with a shape where portions of respective two sides in the four sides of the film are notched. As shown by FIG. 41, two of first feeding conductor films 518 and 519 opposed to each other via a gap 517, are formed on one of four side faces of the dielectric base body 511. As shown by FIG. 42, two of second feeding conductor films 521 and 522 opposed to each other via a gap 520 are formed on another one of the four side faces.

As shown by FIG. 37, the two first feeding conductor films 518 and 519 are respectively connected to the two ends 513*a* and 513*b* of the first loop radiating conductor film 513, and extended parallel to each other via the side face of the dielectric base body 511. The feeding conductor film 519 that is one of the two feeding conductor films 518 and 519, is connected to the grounding conductor film 516 and the other one of the feeding conductor film 518 reaches the lower face of the dielectric base body 511. Further, portions of the two feeding conductor films 518 and 519 on the side of the grounding conductor film 516, also serve as feed electrodes 518*a* and 519*a* which are electrodes that may be utilized for mounting antenna device 510 to the surface of a circuit board.

Similar to the first feeding conductor films 518 and 519, the two second feeding conductor films 521 and 522 shown by FIG. 42, are respectively connected to two ends 515*a* and 515*b* of the second loop radiating conductor film 515 and extended in parallel with each other via another side face of the dielectric base body 511. The feeding conductor film 522, is connected to the grounding conductor film 516 and feeding conductor film 521 reaches the lower face of the dielectric base body 511. Also, portions of the two feeding conductor films 521 and 522 on the side of the grounding conductor film 516 serve as feed electrodes 521*a* and 522*a* which are electrodes that may also be utilized for mounting onto the surface of a circuit board.

According to the antenna device 510 constituted as described above, the first loop radiating conductor film 513 and the second loop radiating conductor film 515, the directions of the gaps of which are different from each other by 90° with respect to a horizontal face, are formed and therefore, polarized wave directions of electromagnetic waves received by the first and the second loop radiating conductor films 513 and 515, are different from each other by 90° on the horizontal plane. Accordingly, electromagnetic waves can efficiently be received by the antenna device 510 irrespective of whether the electromagnetic waves are of vertical or horizontal polarization.

Also, according to the antenna device 510, portions of the first feeding conductor films 518 and 519 at a vicinity of the grounding conductor film 516 and portions of the second feeding conductor films 521 and 522 at a vicinity of the grounding conductor film 516, also serve as feed electrodes and therefore, the antenna device 510 can easily be mounted on a circuit board by soldering or other connecting means.

Incidentally, although according to the antenna device 510, with respect to the first and the second loop radiating conductor films 513 and 515, the direction of the gap of the first loop radiating conductor film 513 and the direction of the gap of the second loop radiating conductor film 515 are different from each other by 90° in respect of a horizontal face, the directions of the gaps may be different from each other by, for example, 45°. When the directions of the gaps are different from each other, electromagnetic waves having different polarized wave directions can be efficiently received by a single antenna.

Figure 43:
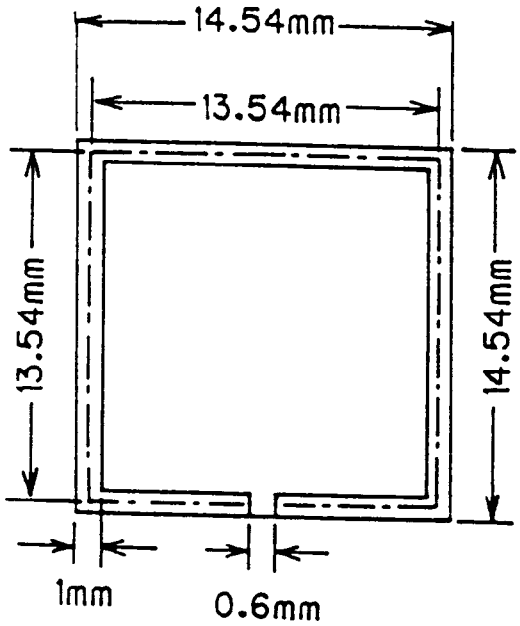
FIG. 43 is a view showing a length and a width of the dielectric base body and dimensions of a first loop radiating conductor film.
Figure 44:
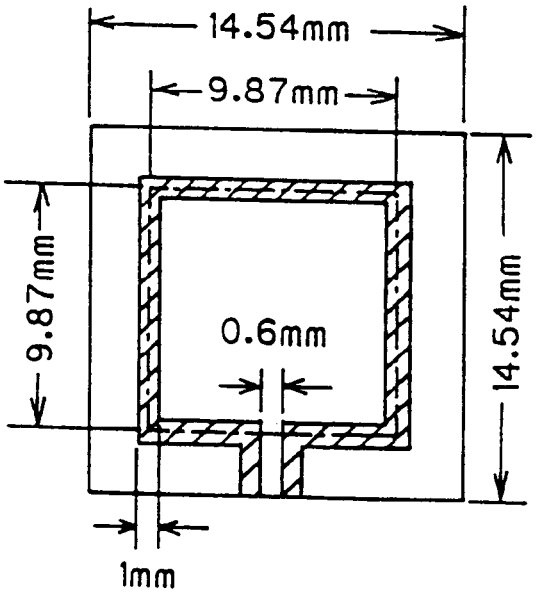
FIG. 44 is a view showing dimensions of a second loop radiating conductor film.
Figure 45:
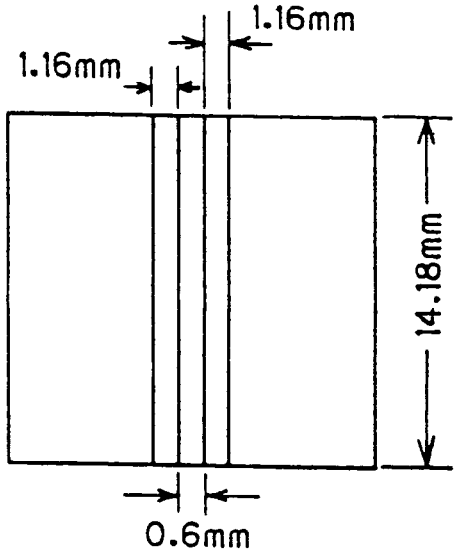
FIG. 45 is a view showing a thickness of the dielectric base body and dimensions of first feeding conductor films.
Figure 46:
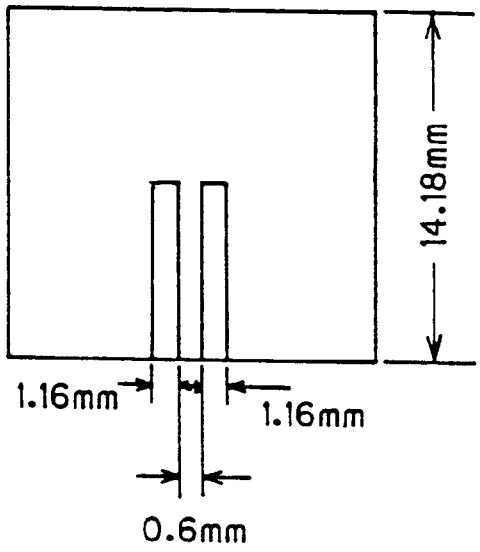
FIG. 46 is a view showing a thickness of the dielectric base body and dimensions of a second feeding conductor film.

An explanation will be given of a fabrication method of an antenna device 510 shown by FIG. 37 through FIG. 42 in reference to FIG. 37 and FIG. 43 through FIG. 46. FIG. 43 is a top view of the antenna device 510 shown by FIG. 37 and is a view showing the length and the width of the dielectric base body and the dimensions of the first loop radiating conductor film. FIG. 44 is a sectional view taken from a line A-Al of the antenna device 510 shown by FIG. 37 and is a view showing the length and the width of the dielectric base body and the dimensions of the second loop radiating conductor film. FIG. 45 is a view showing a side face of the antenna device 510 where the first feeding conductor films are formed and is a view showing the thickness of the dielectric base body and the dimensions of the first feeding conductor films. FIG. 46 is a view showing a side face of the antenna device 510 where the second feeding conductor films are formed and is a view showing the thickness of the dielectric base body and the dimensions of the second feeding conductor film.

First, the material of the dielectric base body 511 is selected. A material having a dielectric constant in a range from 10 through 100 in a frequency band of transmitted and received electromagnetic waves is preferred. For example, a $Sr(Ni_{1/3}Nb_{2/3})O_3$ group ceramic may be utilized. This material has a dielectric constant of 31 when the transmitted and received electromagnetic waves have a frequency of 3.8 GHz and a Q value of 1800.

Next, the dimensions of the first and the second loop radiating conductor films, the first and the second feeding conductor films and the dielectric base body, are determined. The dimensions can be determined as follows.

When the lengths of the loops of the first and the second loop radiating conductor films 513 and 515 are respectively designated by notation $\lambda_1$ and $\lambda_2$, $\lambda_1$ and $\lambda_2$ can be represented by Equation (4) described above, respectively. Equations for calculating respectively $\lambda_1$ and $\lambda_2$ are shown below.

$$\lambda_1 = \lambda_0 \Big/ \sqrt{(\varepsilon_{reff-1})} \tag{11}$$

$$\lambda_2 = \lambda_0 \Big/ \sqrt{(\varepsilon_{reff-2})} \tag{12}$$

where $\lambda_0$ is wavelength of electromagnetic wave in vacuum and $\in_{reff-1}$, and $\in_{reff-2}$ are effective dielectric constants.

Here, the effective dielectric constant $\in_{reff-1}$ in Equation (11) can be represented by the following equation in consideration of the fact that the first loop radiating conductor film 513 is formed on the upper face of the dielectric base body 511, electromagnetic wave radiated from the first loop radiating conductor film 513 is radiated perpendicularly to a face of the dielectric base body 511 where the first loop radiating conductor film 513 is formed and electric fields are generated at the inside and the outside of the first loop radiating conductor film 513.

$$\in reff-1=(\in_r+3)/4 \tag{13}$$

where $\in_r$ is a dielectric constant of dielectric base body.

Further, the effective dielectric constant $\in_{reff-2}$ in Equation (12) can be represented by the following equation in consideration of the fact that the second loop radiating conductor film 515 is formed at the inside of the dielectric base body 511, electromagnetic wave radiated from the second loop radiating conductor film 515 is radiated perpendicularly to a face of the dielectric base body 511 where the first loop radiating conductor film 513 is formed and electric fields are generated at the inside and the outside of the second loop radiating conductor film 515.

$$\in reff-2=(\in_r+1)/2 \tag{14}$$

where $\in_r$ is a dielectric constant of dielectric base body.

Accordingly, by substituting respectively the effective dielectric constants $\in_{reff-1}$ and $\in_{reff-2}$ calculated by Equation (13) and Equation (14) for Equation (11) and Equation (12), the lengths $\lambda_1$ and $\lambda_2$ of the first and the second loop radiating conductor films 513 and 515 can be calculated.

When the resonance frequency of transmitted and received electromagnetic waves is set to 1.9 GHz, $\lambda_1$ and $\lambda_2$ are determined as $\lambda_1$=54.16 mm and $\lambda_2$39.47 mm. As shown by FIG. 43 and FIG. 44, in forming the first and the second loop radiating conductor films 513 and 515, the length of each side of the first loop radiating conductor film 513 is determined to be 13.54 mm and the length of each side of the second loop radiating conductor film 515 is determined to be 9.87 mm. Here, the one-dotted chain lines shown in FIG. 43 and FIG. 44 designate center lines of the respective sides of the first and the second loop radiating conductor films 513 and 515.

Further, although impedance of a single wavelength loop antenna is generally as high as 100Ω or higher, the impedance of the antenna device 510 can be lowered by adjusting the width of the loop radiating conductor film and the gap width of the gap between two ends of the loop radiating conductor film, thereby promoting electrical feed efficiency. For example, in order to set the impedance to 50Ω as shown by FIG. 43 and FIG. 44, the widths of the loop radiating conductor films are set to 1 mm and the gap widths are set to 0.6 mm.

As shown by FIG. 43 and FIG. 44, both of the length and the width of the dielectric base body 511 are set to 14.54 mm in accordance with the dimensions of the radiating conductor films which have been determined as described above. Further, with respect to the thickness of the dielectric base body 511, the thickness of the dielectric base body 511 is set to 14.18 mm as shown by FIG. 45 and FIG. 46 in order to set both of a distance from the first loop radiating conductor film 513 to the second loop radiating conductor film 515 and a distance from the second loop radiating conductor film 515 to the grounding conductor film 516, to 7.09 mm corresponding to a quarter of the resonance wavelength of electromagnetic wave having the resonance frequency of 1.9 GHz in the dielectric base body.

Further, a desired line impedance can be provided by adjusting the widths of the feeding conductor films and the gap widths of the gap between the feeding conductor films. For example, in order to set the line impedance to 50Ω, as shown by FIG. 45 and FIG. 46, the widths of the feeding conductor films are set to 1.16 mm and the gap lengths are set to 0.6 mm.

Next, the dielectric base body 511 having the above described dimensions is fabricated. The loop radiating conductor film 515 is formed also at the inside of the dielectric base body 511 as shown by FIG. 37 and therefore, two pieces of dielectric materials each having the length, the width and the thickness of 14.54 mm, 14.54 mm and 7.09 mm, respectively, are fabricated.

Next, a pattern of the first loop radiating conductor film 513 having the dimensions shown by FIG. 43, is printed on an upper face of one of the fabricated two dielectric materials by the thick film printing process by using a copper paste. Further, a pattern of the second loop radiating conductor film 515 having the dimensions shown by FIG. 44 is printed on an upper face of the other dielectric material by the thick film printing process by using a copper paste and further, a pattern of the grounding conductor film 516 is printed on a lower face of the other dielectric material by the thick film printing process by using a copper paste. Furthermore, patterns of the first and the second feeding conductor films having the dimensions shown by FIG. 45 and FIG. 46 are printed on the side faces of the respective dielectric materials by the thick film printing process by using a copper paste. Thereafter, the dielectric materials printed with the respective patterns are laminated, dried and sintered in a reducing atmosphere, thus fabricating the antenna device 510.

Figure 47:
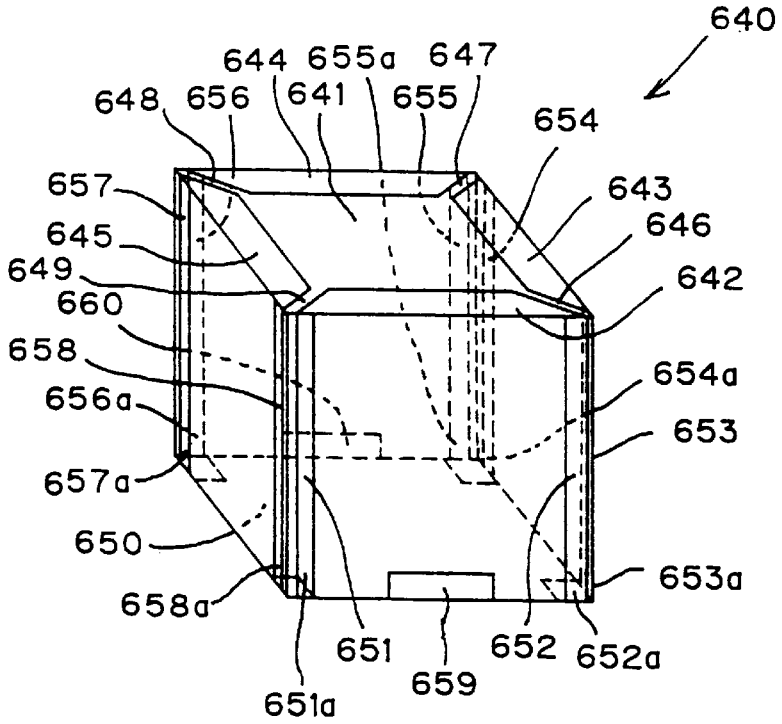
FIG. 47 is a perspective view showing an antenna device according to Embodiment 10 of the present invention.

FIG. 47 is a perspective view showing an antenna device according to Embodiment 10 of the present invention.

FIG. 47 illustrates an antenna device 640 provided with a dielectric base body 641 in a rectangular parallelepiped shape having an upper face and a lower face in a square shape. Four radiating conductor films 642, 643, 644 and 645 are formed on the upper face of the dielectric base body 641 to extend along the respective sides of the upper face. The radiating conductor films 642, 643, 644 and 645 are extended in the horizontal direction, contiguous ends thereof are opposed to each other via gaps 646, 647, 648 and 649 and the radiating conductor films make a turn as a whole by forming the four gaps 646, 647, 648 and 649 at equal intervals. The length of a total of the radiating conductor films 642, 643, 644 and 645 is adjusted to a length the same as the resonance wavelength of electromagnetic waves to be transmitted and received. Further, a grounding conductor film 650 is formed on the lower face of the dielectric base body 641 and the grounding conductor film 650 has a shape where the respective corners are notched. Feeding conductor films 651, 652, 653, 654, 655, 656, 657 and 658 are formed on side faces of the dielectric base body 641 along sides of the side faces extending in the up and down direction. The feeding conductor films 651 and 652 are connected to respective ends of the radiating conductor film 642, the feeding conductor films 653 and 654 are connected to respective ends of the radiating conductor film 643, the feeding conductor films 655 and 656 are connected to respective ends of the radiating conductor films 644, and the feeding conductor films 657 and 658 are connected to respective ends of the radiating conductor film 645. Portions of the respective feeding conductor films 651, 652, 653, 654, 655, 656, 657 and 658 on the lower end sides, respectively serve as feed electrodes 651*a*, 652*a*, 653*a*, 654*a*, 655*a*, 656*a*, 657*a* and 658*a*. Further, two ground electrodes 659 and 660 are formed at the lower portions of the side faces of the dielectric base body 641 and both of the ground electrodes 659 and 660 are connected to the grounding conductor film 650.

According to the antenna device 640 constituted as described above, the four radiating conductor films 642, 643, 644 and 645 having a single wavelength loop antenna structure as a whole, are formed. Therefore, when electric currents having the same amplitude and the same phase are supplied to the radiating conductor films 642, 643, 644 and 645 via the feed electrodes 656*a*, 657*a*, 652*a* and 653*a*, electromagnetic waves having a directivity in a direction perpendicular to the upper face of the dielectric base body 641 and polarized in a direction in which a straight line connecting the gap 649 and the gap 647 is extended, are radiated from the four radiating conductor films 642, 643 644 and 645. Meanwhile, when electric currents having the same amplitude and the same phase are supplied to the radiating conductor films 642, 643, 644 and 645 via the feed electrodes 658*a*, 651*a*, 654*a* and 655*a*, electromagnetic waves having a directivity in a direction perpendicular to the upper face of the dielectric base body 641 and polarized in a direction in which a straight line connecting the gap 648 and the gap 646 is extended, are radiated from the four radiating conductor films 642, 643, 644 and 645.

Accordingly, the antenna device 640 is capable of freely switching the polarizing direction is provided.

According to the antenna device 640, the four radiating conductor films 642, 643, 644 and 645 having a single wavelength loop antenna structure as a whole, are formed and therefore, the electromagnetic waves radiated from the four radiating conductor films 642, 643, 644 and 645, have maximum gain in a direction perpendicular to a plane including the four radiating conductor films 642, 643, 644 and 645. Further, the grounding conductor film 650 is formed on the lower face of the dielectric base body 641 and therefore, radiated electromagnetic waves progressing toward the grounding conductor film 650, are reflected by the grounding conductor film 650. That is, electromagnetic waves having maximum gain in a direction from the grounding conductor film 650 toward the four radiating conductor films 642, 643, 644 and 645 are radiated from antenna 640. Accordingly, when the antenna device 640 is attached to, for example, a portable telephone, if the grounding conductor film 650 is disposed between a person and the four radiating conductor films 642, 643, 644 and 645 when the person uses the portable telephone, electromagnetic waves are not radiated toward the side of the person. Thus, electromagnetic waves can efficiently be used in communication with maximum gain in a direction from the grounding conductor film 650 to the four radiating conductor films 642, 643, 644 and 645.

An explanation will be given of the fabrication method of the antenna device 640 shown by FIG. 47.

First, the material of the dielectric base body 641 is selected. A material having a dielectric constant in the range of 10 through 100 in a frequency band of transmitted and received electromagnetic waves is preferred. For example, an $Sr(Ni_{1/3}Nb_{2/3})O_3$ group ceramic may be utilized. This material has a dielectric constant of 31 when the transmitted and received electromagnetic waves have a frequency of 4 GHz and a Q value of 1000.

Next, the dimensions of the radiating conductor films 642, 643, 644 and 645 are determined. The dimensions are determined as follows.

When the length of the loop formed by the four radiating conductor films 642, 643, 644 and 645 is designated by notation $\lambda$, $\lambda$ can be represented by Equation (4). Equation (4) is shown as follows.

$$\lambda = \lambda_0 \Big/ \sqrt{(\varepsilon_{reff})} \tag{15}$$

where $\lambda_0$ is wavelength of electromagnetic wave in vacuum and $\in_{reff}$ is effective dielectric constant.

Further, the effective dielectric constant $\in_{reff}$ can be represented by the following equation in consideration of the fact that electromagnetic waves radiated from the four radiating conductor films 642, 643, 644 and 645 as shown by FIG. 47, are radiated perpendicularly to the face where the four radiating conductor films 642, 643, 644 and 645 are formed and electric fields are generated on the inner sides and the outer sides of the four radiating conductor films 642, 643, 644 and 645.

$$\in_{reff}=(\in_r+3)/4 \tag{16}$$

here $\in_r$ is a dielectric constant of dielectric base body.

Accordingly, the effective dielectric constant $\in_{reff}$ is calculated by Equation (16) and $\lambda$ can be calculated by substituting the calculated value of $\in_{reff}$ for Equation (15).

When the resonance frequency of electromagnetic wave is set to 1.9 GHz, $\lambda$ is determined as $\lambda$=54.16 mm and in order to form the radiating conductor films as shown by FIG. 47, the lengths of the respective radiating conductor films 642, 643, 644 and 645 are set to 13.54 mm. Further although the impedance of a single wavelength loop antenna is generally as high as 100Ω or higher, impedance of the antenna device 640 can be lowered by adjusting the widths of the radiating conductor films and the gap widths of the gaps between the respective radiating conductor films, thereby promoting electrical feed efficiency. For example, in order to set the impedance to 50Ω, the widths of the respective radiating conductor films are set to 2 mm and the gap widths of the respective gaps are set to 0.5 mm.

Next, in respect of the dimensions of the dielectric base body 641, both of the length and the width are set to 15.54 mm from the dimensions of the radiating conductor films which have been determined as described above and the thickness is set to 7.09 mm corresponding to a quarter of the wavelength of electromagnetic waves having the resonance frequency of 1.9 GHz in the dielectric base body, thereby fabricating the dielectric base body.

Next, patterns of the feeding conductor films, the grounding conductor film, the ground electrodes and the radiating conductor films having the above-described dimensions, are printed by the thick film printing process by using a copper paste and are sintered in a reducing atmosphere, thus fabricating the antenna device 640.

Figure 48:
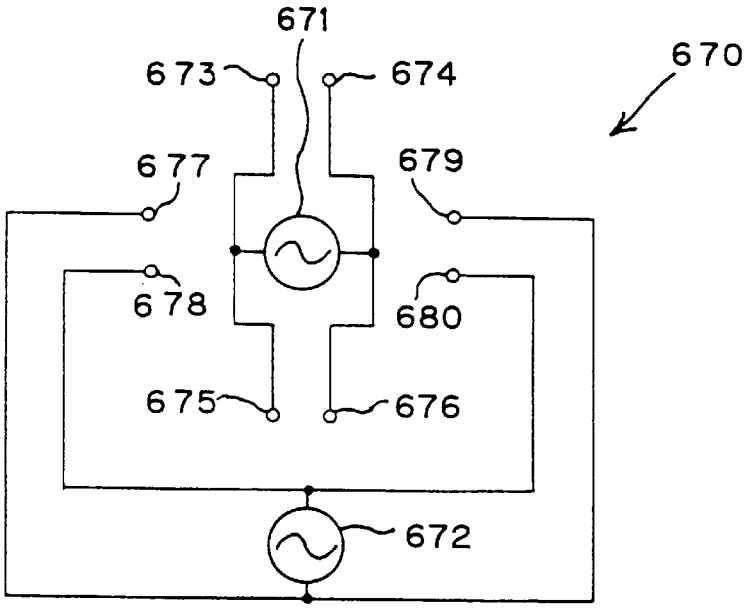
FIG. 48 is a view showing a drive circuit for driving the antenna device as shown by FIG. 47.

FIG. 48 is a view showing a drive circuit driving the antenna device shown by FIG. 47. A drive circuit 670 is provided with two power sources 671 and 672, the power source 671 supplies current to four terminals 673, 674, 675 and 676 and the power source 672 supplies current to four terminals 677, 678, 679 and 680.

When the terminals 673, 674, 675 and 676 of the drive circuit 670 are connected to the feed electrodes 656*a*, 657*a*, 652*a*, 653*a* of the antenna device 640 shown by FIG. 47, respectively whereas the terminals 677, 678, 679 and 680 of the drive circuit 670 are respectively connected to the feed electrodes 658*a*, 651*a*, 654*a* and 655*a* of the antenna device 640, the antenna capable of freely switching the polarized directions is obtained by deactivating the power source 672 when the power source 671 is operated and deactivating the power source 671 when the power source 672 is operated.

Figure 49:
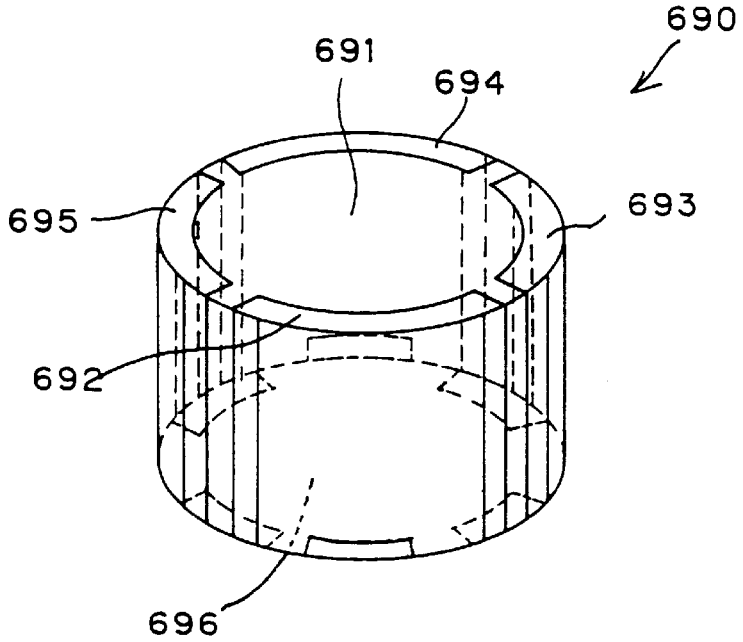
FIG. 49 is a perspective view showing an antenna device according to Embodiment 11 of the present invention.

FIG. 49 is a perspective view showing an antenna device 690 according to Embodiment 11 of the present invention. A dielectric base body 691 having a cylindrical shape is adopted in place of the dielectric base body 641 in a rectangular parallelepiped shape of the antenna device 640 shown by FIG. 47 whereby radiating conductor films 692, 693, 694 and 695 having a circular loop shape as a whole, are formed and a circular grounding conductor film 696 is formed for the grounding conductor film.

Figure 50:
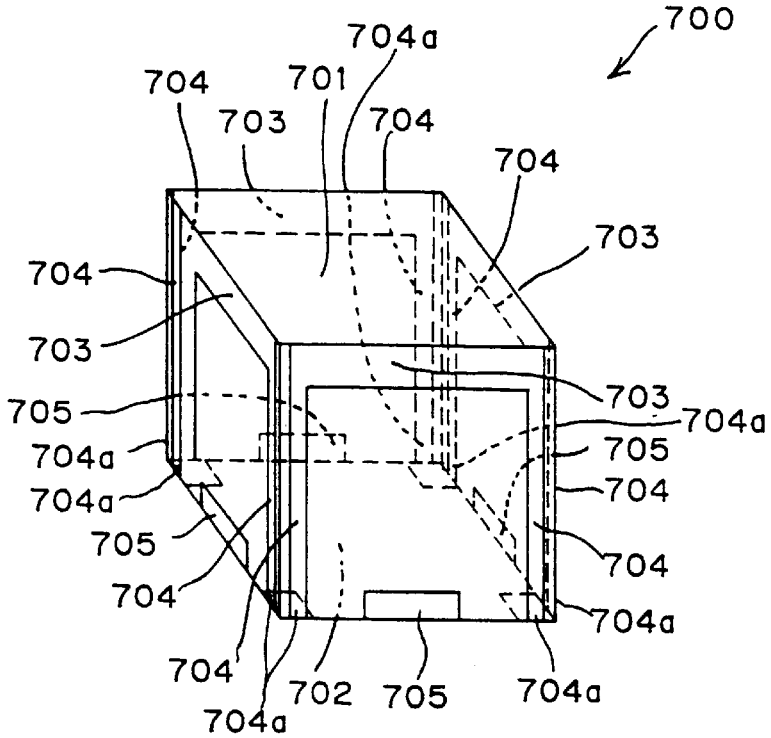
FIG. 50 is a perspective view showing an antenna device according to Embodiment 12 of the present invention.

FIG. 50 is a perspective view showing an antenna device 700 according to Embodiment 12 of the present invention.

A dielectric base body 701 in a rectangular parallelepiped shape having an upper face and a lower face in a square shape is provided. A grounding conductor film 702 is formed on the lower face of the dielectric base body 701 and the grounding conductor film 702 is provided with a shape where the respective corners are notched. Four radiating conductor films 703 are formed at the upper portions of side faces of the dielectric base body 701 along respective sides of the top face of the dielectric base body 701. The radiating conductor films 703 are extended in the horizontal direction, contiguous ends thereof are opposed to each other via gaps and the radiating conductor films make a turn by forming the four gaps at equal intervals. The length of a total of the four radiating conductor films 703 is adjusted to a length the same as the resonance wavelength of transmitted and received electromagnetic waves.

Eight feeding conductor films 704 are formed on side faces of the dielectric base body 701 along respective sides extending in the up and down direction and the respective feeding conductor films 704 are connected to respective ends of the radiating conductor films 703. Also, portions of the respective feeding conductor films 704 on the lower end sides, also serve as feed electrodes 704*a*. Ground electrodes 705 are formed to connect to the grounding conductor film 702 at the lower portions of the respective side faces of the dielectric base body 701.

The radiating conductor films may be formed on the side faces of the dielectric base body in this way.

Figure 51:
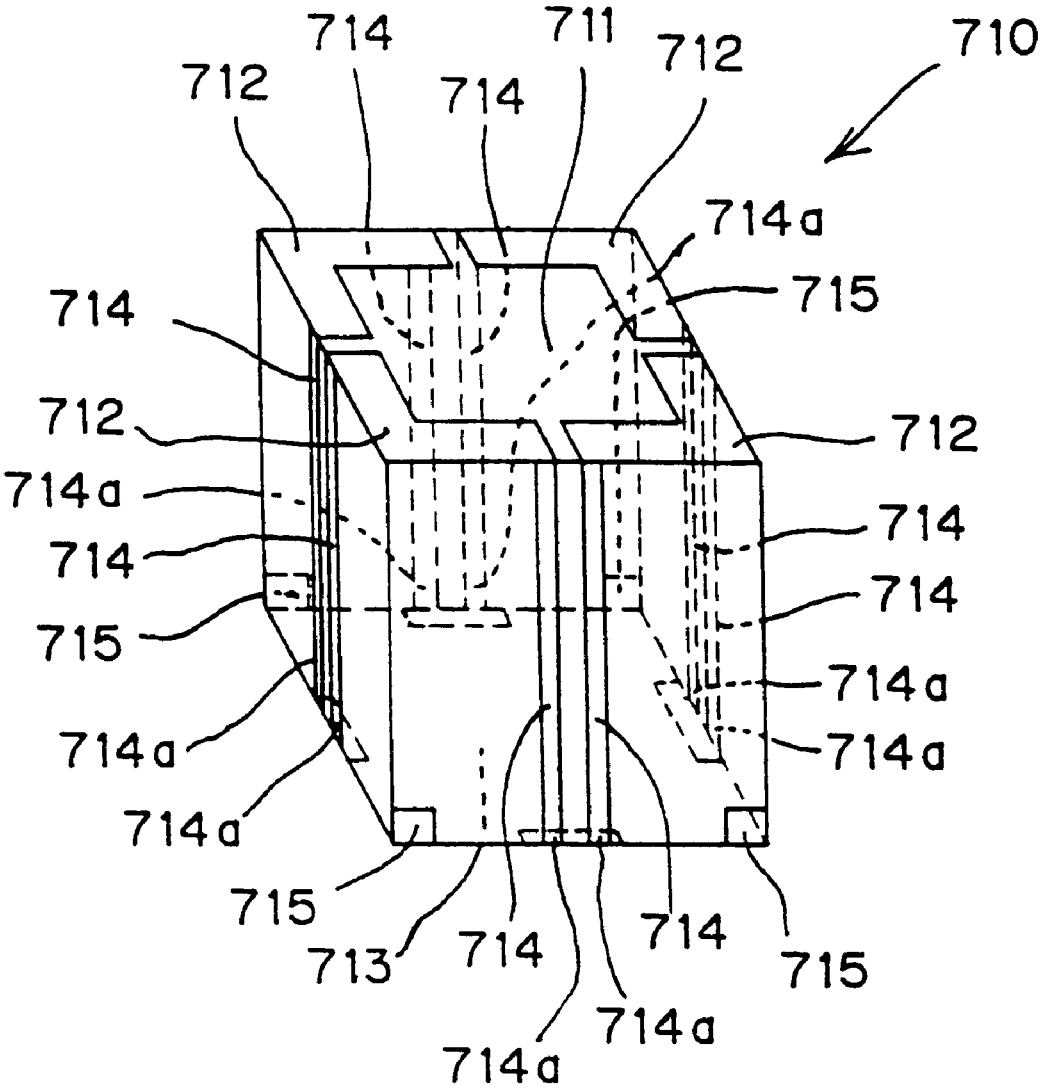
FIG. 51 is a perspective view showing an antenna device according to Embodiment 13 of the present invention.

FIG. 51 is a perspective view showing an antenna device 710 according to Embodiment 13 of the present invention. A dielectric base body 711 in a rectangular parallelepiped shape having an upper face and a lower face in a square shape is provided. Four radiating conductor films 712 in an L-like shape are formed on the upper face of the dielectric base body 711 along sides of the upper face. The four radiating conductor films 712 make a turn by forming gaps at central portions of the respective sides of the top face of the dielectric base body 711. The length of a total of the four radiating conductor films 712 is adjusted to a length the same as the resonance wavelength of electromagnetic waves to be transmitted and received. A grounding conductor film 713 is formed on the lower face of the dielectric base body 711 and the grounding conductor film 713 is provided with a shape where central portions of respective sides are notched.

Eight feeding conductor films 714 extending in the up and down direction are formed at side faces of the dielectric base body 711 and the respective feeding conductor films 714 are connected to respective ends of the radiating conductor films 712. Further, portions of the respective feeding conductor films 714 on the lower end sides, also serve as feed electrodes 714*a*. Ground electrodes 715 are formed to connect to the grounding conductor film 713 at corners of two parallel side faces on the side of the grounding conductor film 713 among four side faces of the dielectric base body 711.

The feeding conductor films and the radiating conductor films may be connected to each other at central portions of the respective sides of the top face of the dielectric base body in this way.

Figure 52:
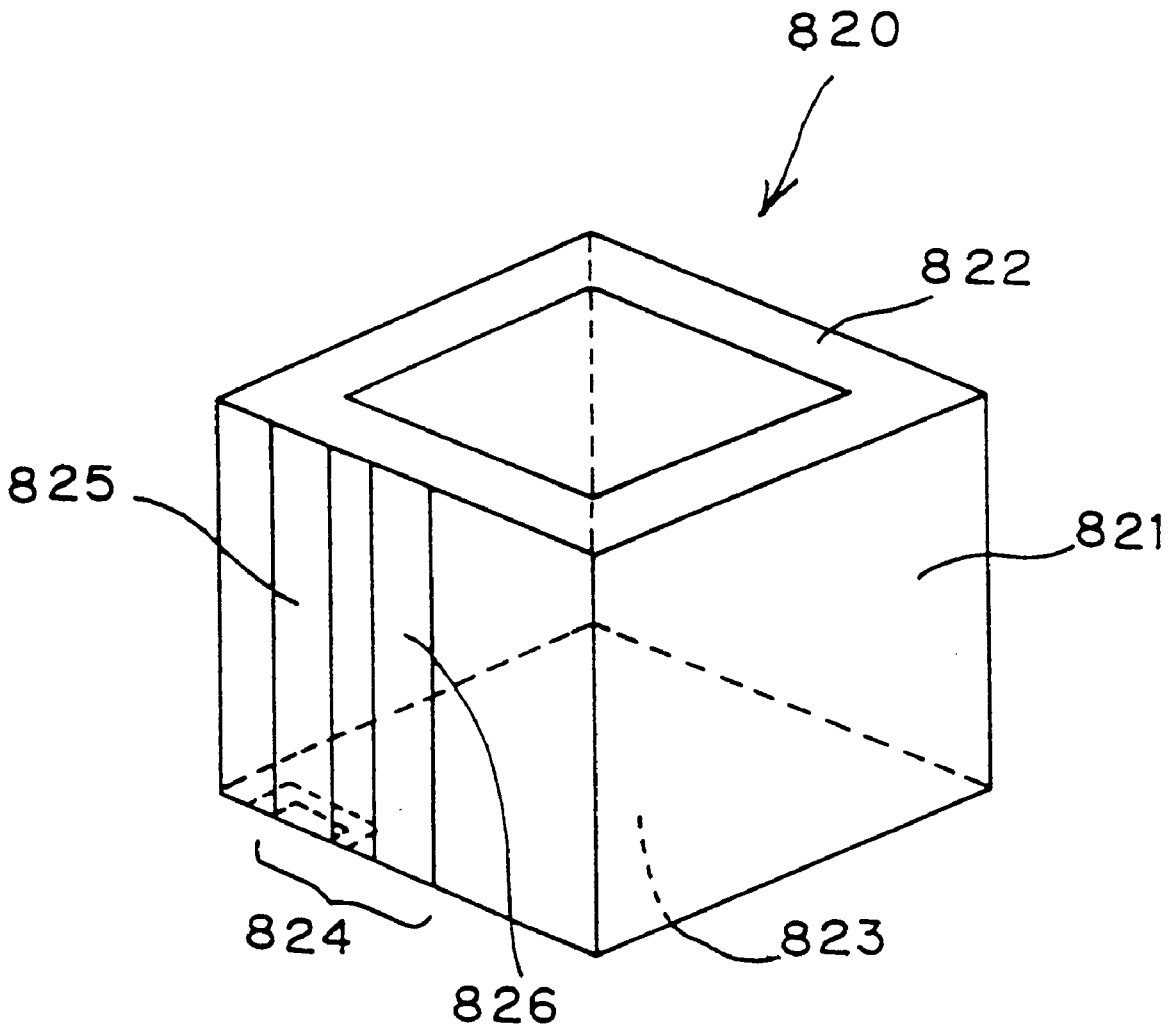
FIG. 52 is a view showing an antenna device according to Embodiment 14 of the present invention.
Figure 53:
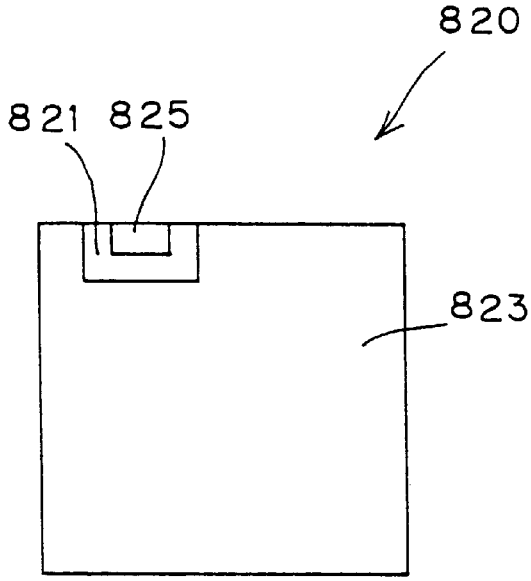
FIG. 53 is a bottom view of the antenna device as shown by FIG. 52.

FIG. 52 is a view showing an antenna device 820 according to Embodiment 14 of the present invention and FIG. 53 is a bottom view of the antenna device 820. A dielectric base body 821 in a rectangular parallelepiped shape having a top face and a bottom face in a square shape is provided. A radiating conductor film 822 in a closed loop shape making a turn horizontally along four sides of the top face, is formed on the top face of the dielectric base body 821 and the length of the radiating conductor film 822 is adjusted to be the resonance wavelength of electromagnetic waves to be transmitted and received. Further, a grounding conductor film 823 extending horizontally is formed on the lower face of the dielectric base body 821 as shown by FIG. 53 and the grounding conductor film 823 is provided with a shape where a portion of one side is notched. A pair of feeding conductor films 824 extending in the up and down direction in parallel with each other and connected to the radiating conductor film 822, are formed on a side face of the dielectric base body 821, a feeding conductor film 826 that is one of the pair of the feeding conductor films 824, is also connected to the grounding conductor film 823 and a feeding conductor film 825 that is the other of the pair of feeding conductor films 824, extends to the lower face of the dielectric base body 821 as shown by FIG. 53.

According to the antenna device 820 constituted as described above, the radiating conductor film 822 in a closed loop shape is formed on the upper face of the dielectric base body 821 and accordingly, it has a single wavelength loop antenna structure. Electromagnetic waves radiated from the radiating conductor film 822 have a maximum gain in a direction perpendicular to a plane including the radiating conductor film 822. Further, the grounding conductor film 823 extending horizontally is formed on the lower face of the dielectric base body 821 and therefore, electromagnetic waves progressing toward the grounding conductor film 823 among electromagnetic waves radiated from the radiating conductor film 822, are reflected by the grounding conductor film 823. Therefore, electromagnetic waves having maximum gain in a direction perpendicular to a plane including the radiating conductor film and progressing from the grounding conductor film to the radiating conductor film are radiated from the antenna device 820.

Accordingly, when the antenna device 820 is attached to, for example, a portable telephone, if the grounding conductor film 823 is disposed between a person and the radiating conductor film 822 when the person uses the portable telephone, electromagnetic waves are not radiated to the side of the person, and electromagnetic waves radiated from the antenna device 820 can be efficiently used in communications. The antenna device 820 does not require formation of a through hole in the radiating conductor film 822, thereby reducing fabrication cost.

An explanation will be given of a fabrication method of the antenna device 820 as follows.

First, the material of the dielectric base body is selected. A material having a dielectric constant in the range of 10 through 100 in a frequency band of electromagnetic waves to be transmitted and received, is preferred. For example, a $Sr(Ni_{1/3}Nb_{2/3})O_3$ group ceramic may be utilized. This material has a dielectric constant of 30 when the transmitted and received electromagnetic waves have a frequency of 6 GHz and a Q value of 1000.

Next, dimensions of the radiating conductor film and the feeding conductor film are determined. The dimensions can be determined as follows.

When the length of the loop of the radiating conductor film is designated by notation $\lambda$, $\lambda$ can be represented by Equation (4). Equation (4) is shown below.

$$\lambda = \lambda_0 \Big/ \sqrt{(\varepsilon_{reff})} \tag{17}$$

where $\lambda_0$ is wavelength of electromagnetic wave in vacuum and $\in_{reff}$ is effective dielectric constant.

Here, the direction of propagating electromagnetic waves radiated from the radiating conductor film in a loop shape shown by FIG. 52, is in a direction intersecting perpendicularly with a face of the dielectric base body where the radiating conductor film is formed and the effective dielectric constant $\in_{reff}$ can be represented by the following equation in consideration of the fact that electric fields are generated from the radiating conductor film both at the inside of the dielectric base body and in air.

$$\in_{reff}=(\in_r+1)/2 \tag{18}$$

where $\in_r$ is a dielectric constant of dielectric base body.

Accordingly, the effective dielectric constant $\in_{reff}$ is calculated by Equation (18) and $\lambda$ can be calculated by substituting the calculated value of $\in_{reff}$ for Equation (17).

When the resonance frequency of electromagnetic wave is set to 1.9 GHz, $\lambda$ is determined as $\lambda$=40.11 mm and the length of one side of the radiating conductor film is set to 10.03 mm when the radiating conductor film is formed as shown by FIG. 52. Although the impedance of a single wavelength loop antenna is generally as high as 100Ω or higher, the impedance of antenna device 820 can be lowered by adjusting the width of the radiating conductor film and an interval between a portion of the radiating conductor film that is connected to one of the feeding conductor films and a portion of the radiating conductor film that is connected to the other one of the feeding conductor films, thus promoting electrical feed efficiency. For example, in order to set the impedance to 50Ω the width of the radiating conductor film is set to 2 mm and the interval between the feeding conductor films is set to 1 mm.

It has been reported that a desired transmission impedance is obtained by adjusting a width of a feeding conductor film and an interval between feeding conductor films in "C.P. Wen: 'Coplanar Waveguide: A Surface Strip Transmission Line Suitable for Nonreciprocal Gyromagnetic Device Applications', IEEE Trans. MTT, Vol. MTT-17, No. 12, December. 1969". In order to set the interval between the feeding conductor films to 1 mm, the width of the feeding conductor film is set to 3.09 mm for setting the transmission impedance to 50Ω.

Next, with respect to dimensions of the dielectric base body, both of the length and the width are determined to be 12.03 mm in accordance with the radiating conductor film of which dimensions have been determined as described above and the thickness is determined to be 7.21 mm corresponding to a quarter of the wavelength of electromagnetic wave having the resonance frequency of 1.9 GHz in the dielectric base body by which the dielectric base body is fabricated.

Next, a pattern of the grounding conductor film and patterns of the radiating conductor film and the feeding conductor films having the above-described dimensions, are printed by the thick film printing process by using a copper paste and are sintered in a reducing atmosphere, thus fabricating the antenna device 820.

Figure 54:
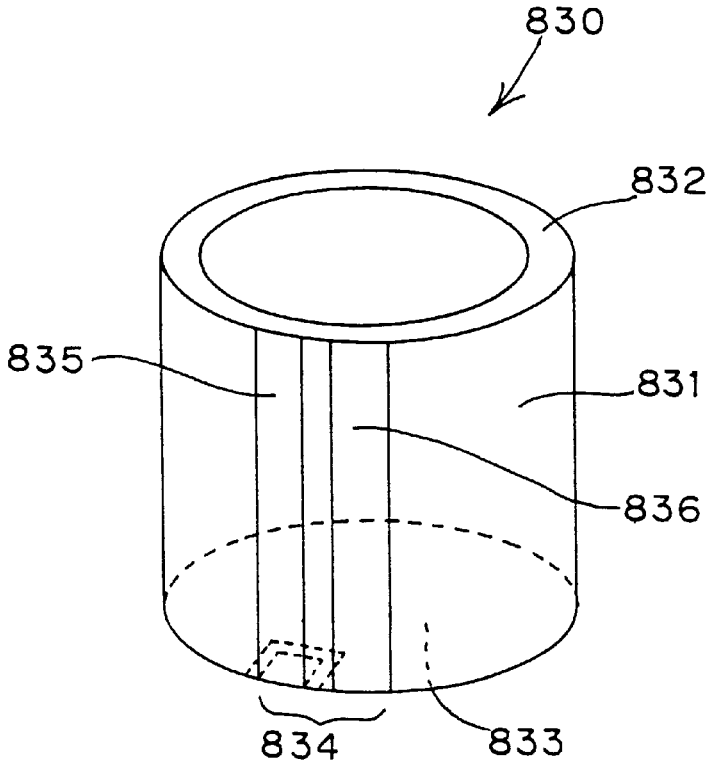
FIG. 54 is a view showing an antenna device according to Embodiment 15 of the present invention.

FIG. 54 is a perspective view showing Embodiment 15 of an antenna device 830 according to the present invention. A dielectric base body 831 in a cylindrical shape, a radiating conductor film 832 in a closed loop shape making a turn horizontally along the circumference of an upper face is formed on the upper face of the dielectric base body 831 and the length of the radiating conductor film 832 adjusted to be the resonance wavelength of electromagnetic wave that is an object of transmission is provided. Further, a circular grounding conductor film 833 extending horizontally is formed on the lower face of the dielectric base body 831 and the grounding conductor film 833 is provided with a shape where a portion of the circumference is notched. A pair of feeding conductor films 834 extending in the up and down direction in parallel with each other and connected to the radiating conductor film 832, are formed on the side face of the dielectric base body 831. The feeding conductor film 836 that is one of the pair of feeding conductor films 834, is also connected to the grounding conductor film 833 and a feeding conductor film 835 which is the other one thereof reaches the lower face of the dielectric base body 831.

Figure 55:
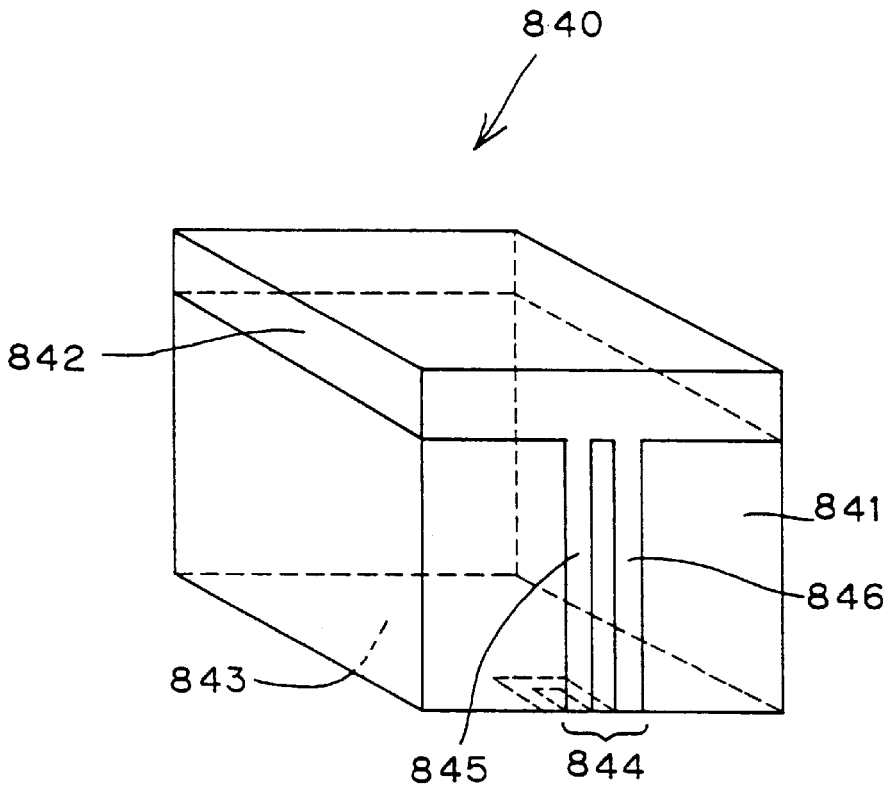
FIG. 55 is a view showing an antenna device according to Embodiment 16 of the present invention.

FIG. 55 is a perspective view showing an antenna device 840 according to Embodiment 16 of the present invention. A dielectric base body 841 having a rectangular parallelepiped shape and a radiating conductor film 842 in a closed loop shape turning horizontally around side faces along four sides of the upper face of the dielectric base body 841, is formed on the upper portions of the side faces of the dielectric base body 841 is provided. The length of the radiating conductor film 842 is adjusted to a length the same as the resonance wavelength of electromagnetic waves to be transmitted. A grounding conductor film 843 extending horizontally is formed on the lower face of the dielectric base body 841 and the grounding conductor film 843 is provided with a shape where a portion of a side is notched. Further, a pair of feeding conductor films 844 extending in the up and down direction in parallel with each other and connected to the radiating conductor film 842 are formed on a side face of the dielectric base body 841. A feeding conductor film 846 that is one of the pair of feeding conductor films 844 is also connected to the grounding conductor film 843 and a feeding conductor film 845 that is the other one thereof extends to the lower face of the dielectric base body 841.

Figure 56:
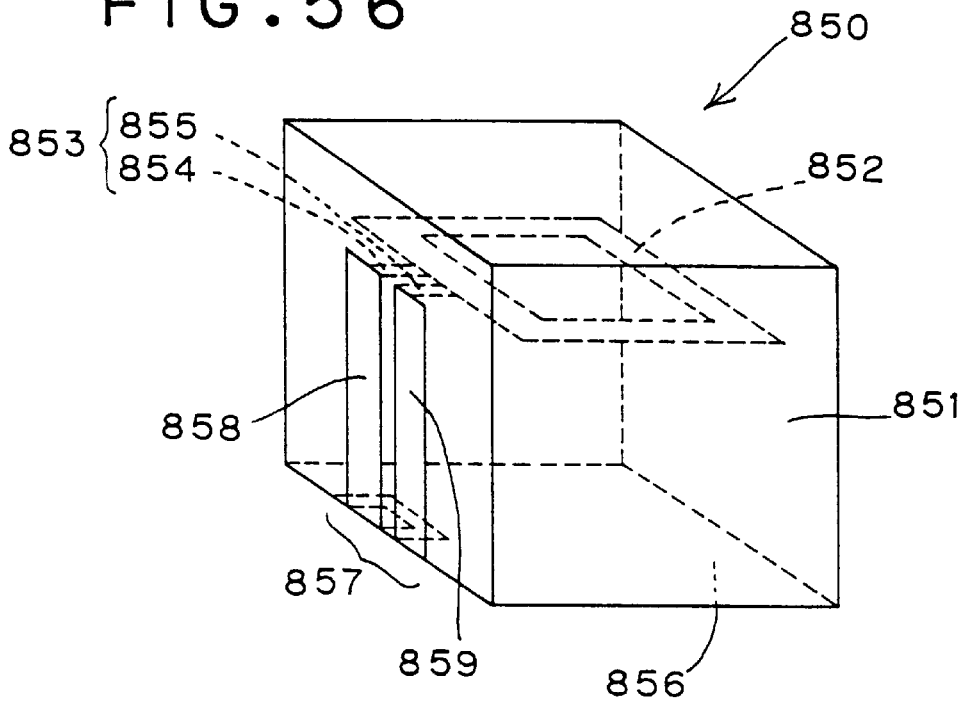
FIG. 56 is a view showing an antenna device according to Embodiment 17 of the present invention.

FIG. 56 is a perspective view showing an antenna device 850 according to Embodiment 17 of the present invention.

A dielectric base body 851 in a rectangular parallelepiped shape, a radiating conductor film 852 in a closed loop shape making a turn on a horizontal face at an inner portion of the dielectric base body 851 is formed, and the radiating conductor film 852 is adjusted to a length the same as the resonance wavelength of electromagnetic waves to be transmitted at the inside of the dielectric base body 851. Further, a pair of inner feeding conductor film 853 extending in a horizontal direction in parallel with each other, connected to the radiating conductor film 852 and exposed on a side face of the dielectric base body 851, are formed on a plane including the radiating conductor film 852 formed at the inner portion of the dielectric base body 851. A grounding conductor film 856 extending horizontally is formed on the lower face of the dielectric base body 851 and the grounding conductor film 856 is provided with a shape where a portion of a side is notched. A pair of side face feeding conductor films 857 extending in the up and down direction in parallel with each other are formed on the side face of the dielectric base body 851. An upper end and a lower end of a side face feeding conductor film 859 of the pair of side face feeding conductor films 857, are respectively connected to the feeding conductor film 855 and the grounding conductor film 856. An upper end of a side face feeding conductor film 858 that is the other one thereof is connected to the inner feeding conductor film 854 and a lower end thereof extends to the lower face of the dielectric base body 851.

According to the antenna device 850 constituted as described above, the radiating conductor film 852 is formed at the inside of the dielectric base body 851. When the antenna device 850 is compared with an antenna device in which a radiating conductor film is formed on the surface of a dielectric base body, in the case where the respective antenna devices transmit and receive electromagnetic waves of the same frequency, since the wavelength of the electromagnetic waves is shorter at the inside of a dielectric base body than at the outside of the dielectric base body, the length of the loop of the radiating conductor film can be shortened if the radiating conductor film is formed at the inside of the dielectric base body. Accordingly, dimensions of the dielectric base body can be reduced to achieve downsizing of the antenna device.

Figure 57:
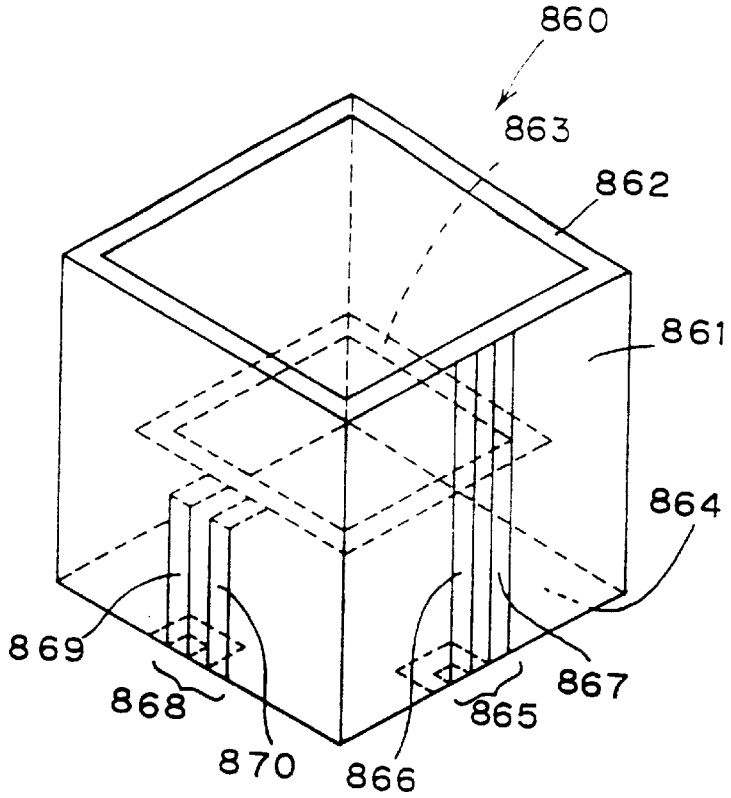
FIG. 57 is a view showing an antenna device according to Embodiment 18 of the present invention.

FIG. 57 is a perspective view showing an antenna device 860 according to Embodiment 18 of the present invention. A dielectric base body 861 in a rectangular parallelepiped shape is provided. A first radiating conductor film 862 in a closed loop shape making a turn horizontally along four sides of the upper face of the dielectric base body 861 is formed on the upper face of the dielectric base body 861. Also, a second radiating conductor film 863 in a closed loop shape making a turn on a horizontal face in a square shape at the inside of the dielectric base body 861 is formed at an inner portion of the dielectric base body 861. A grounding conductor film 864 is formed on the lower face of the dielectric base body 861 and the grounding conductor film 864 is provided with a shape where respective portions of two sides among four sides are notched.

A pair of first feeding conductor films 865 extending in the up and down direction in parallel with each other and connected to the radiating conductor film 862 are formed on one side face among four side faces of the dielectric base body 861. A feeding conductor film 867 that is one of the pair of first feeding conductor films 865, is also connected to the grounding conductor film 864 and a feeding conductor film 866 that is the other one thereof reaches the lower face of the dielectric base body 861. Further, a pair of second feeding conductor films 868 extending in the up and down direction in parallel with each other and connected to the second radiating conductor film 863, are formed on a side face contiguous to the side face where the pair of first feeding conductor films 865 are formed. A feeding conductor film 870 is one of the pair of second feeding conductor films 868, is connected to the grounding conductor film 864 and a feeding conductor film 869 that is the other one thereof reaches the lower face of the dielectric base body 861.

According to the antenna device 860 constituted as described above, the pair of first feeding conductor films 865 and the pair of second feeding conductor films 868 are formed on the side faces contiguous to each other, the direction of the contact point where the first radiating conductor film 862 and the pair of first feeding conductor films 865 are brought into contact with each other, with respect to a loop of the first radiating conductor film 862, and the direction of the contact point where the second radiating conductor film 863 and the pair of second feeding conductor films 868 are brought into contact with each other, in respect of a loop of the second radiating conductor film 863, are different from each other by 90° in respect of a horizontal plane. Accordingly, polarizing directions of electromagnetic waves received by the first and the second radiating conductor films 862 and 863 are different from each other by 90° in respect of a horizontal plane by which the antenna device 860 can receive electromagnetic waves efficiently irrespective of whether the received electromagnetic waves are vertically or horizontally polarized.

Figure 58:
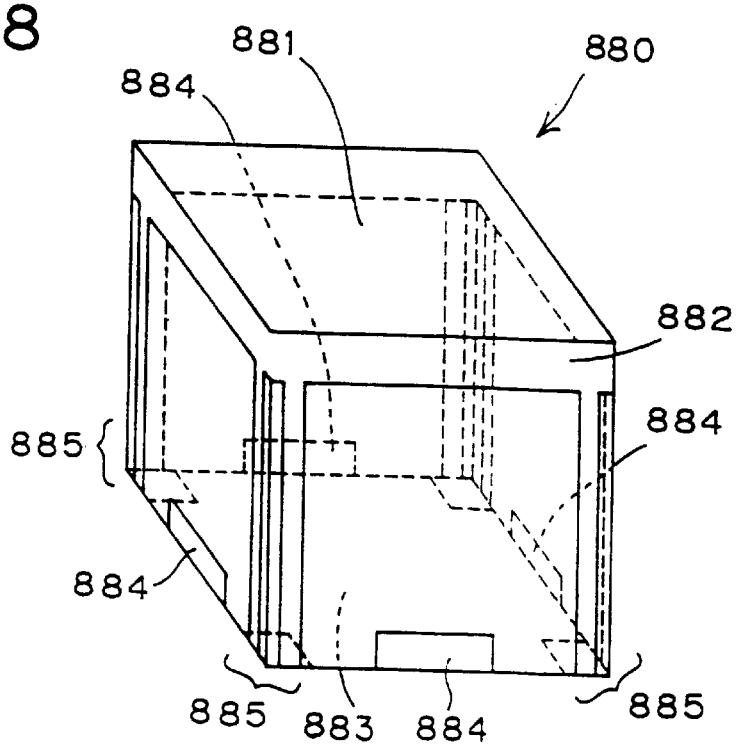
FIG. 58 is a view showing an antenna device according to Embodiment 19 of the present invention.

FIG. 58 is a perspective view showing an antenna device 880 according to Embodiment 19 of the present invention. A dielectric base body 881 in a rectangular parallelepiped shape is provided. A radiating conductor film 882 in a closed loop shape turning around side faces horizontally along four sides of the upper face of the dielectric base body 881, is formed at the upper portion of the side faces of the dielectric base body 881. Further, a grounding conductor film 883 is formed on the lower face of the dielectric base body 881 and the grounding conductor film 883 is provided with a shape where the respective corners are notched. Further, ground electrodes 884 are formed to connect to the grounding conductor film 883 at the lower portions of the respective side faces of the dielectric base body 881. A total of four pairs of feeding conductor films 885 extending in the up and down direction in parallel with each other, each of which is formed on both sides of each of sides of four sides on side faces are formed at positions of the side faces of the dielectric base body 881 dividing equally by four a periphery turning around the radiating conductor film 882 by four sides of the side faces extending in the up and down direction.

According to the antenna device 880 constituted as described above, a total of the four pairs of feeding conductor films 885 are formed at positions equally dividing the radiating conductor film 882. Therefore, when a state where currents having the same amplitude and the same phase are supplied to two pairs of the feeding conductor films formed at positions equally dividing by two the periphery turning around the radiating conductor film 882, and a state where currents having the same amplitude and the same phase are supplied to residual two pairs of the feeding conductor films, are switched freely, an antenna device having gains which can be freely switched between perpendicular polarizing directions is provided.

Figure 59:
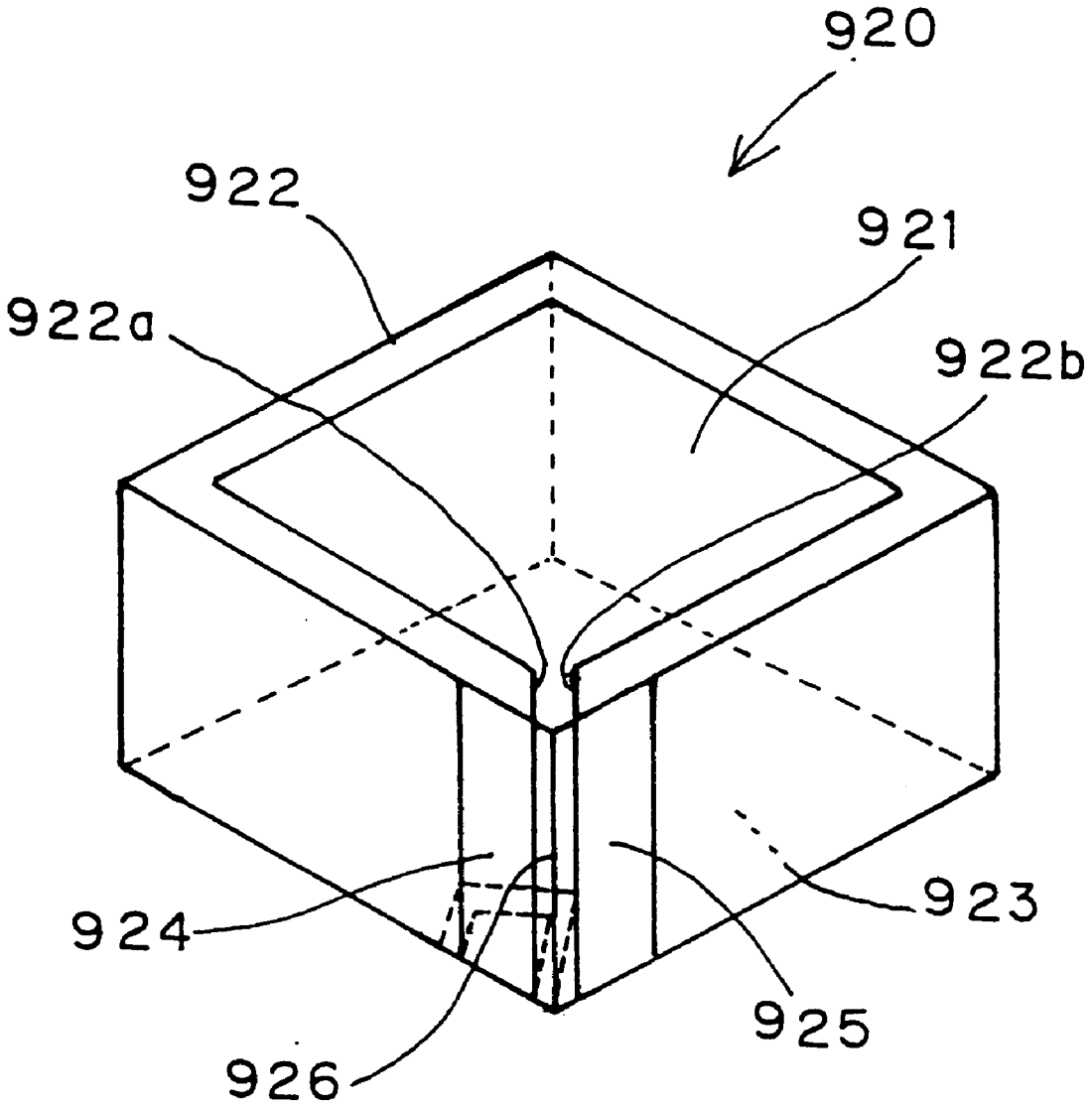
FIG. 59 is a view showing an antenna device according to Embodiment 20 of the present invention.
Figure 60:
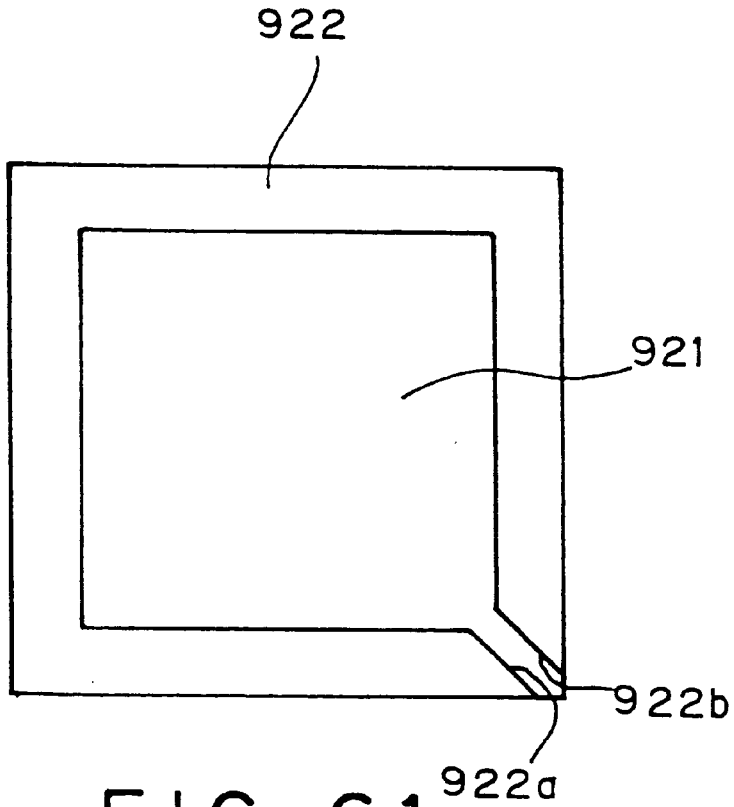
FIG. 60 is a top view of the antenna device as shown by FIG. 59.
Figure 61:
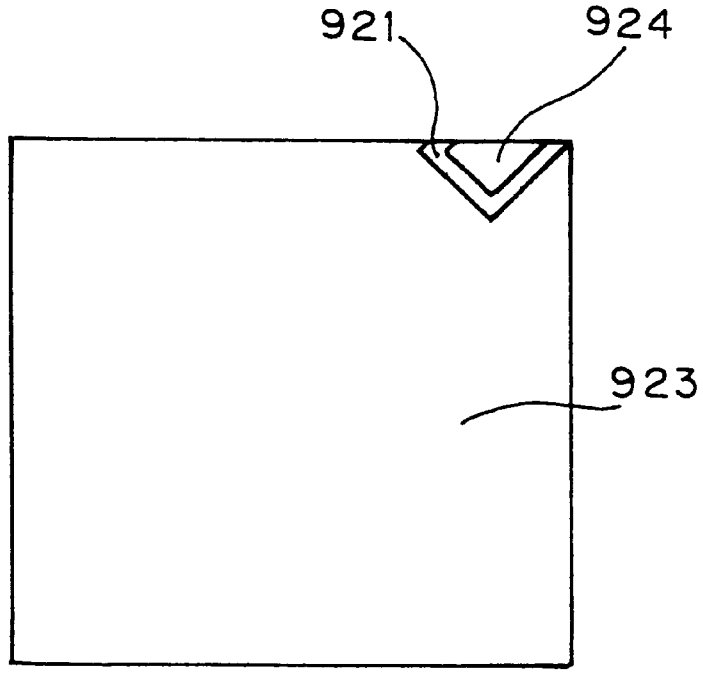
FIG. 61 is a bottom view of the antenna device as shown by FIG. 59.
Figure 62:
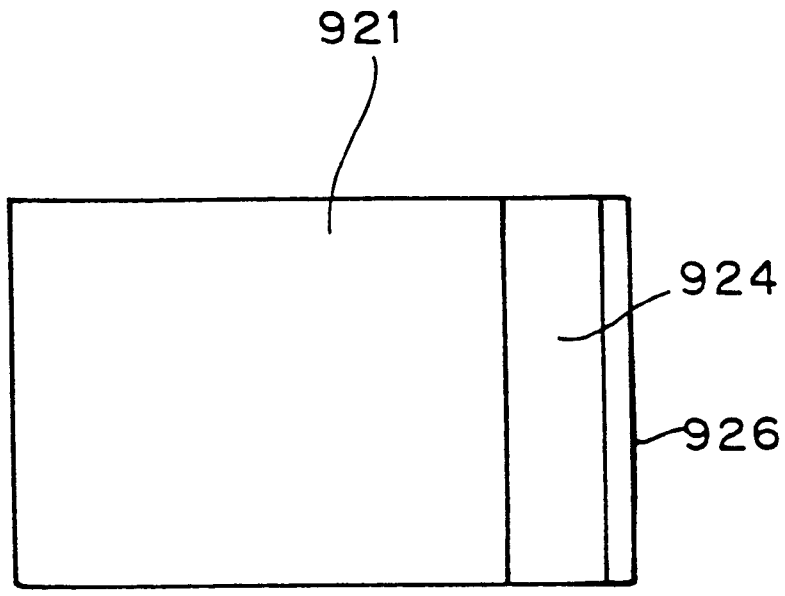
FIG. 62 is a view showing a side face of the antenna device as shown by FIG. 59 where one of two feeding conductor films is formed.
Figure 63:
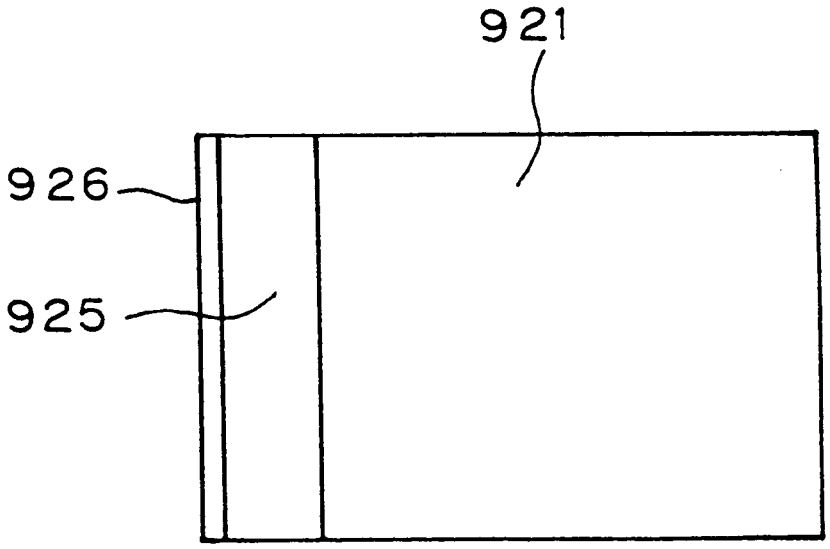
FIG. 63 is a view showing a side face of the antenna device as shown by FIG. 59 where a feeding conductor film different from the feeding conductor film shown by FIG. 62 is formed.

FIG. 59 is a perspective view showing an antenna device 920 according to Embodiment 20 of the present invention, FIG. 60 is a top view thereof, FIG. 61 is a bottom view thereof, FIG. 62 is a view showing a side face of an antenna device shown by FIG. 59 where one of two feeding conductor films is formed and FIG. 63 is a view showing a side face of the antenna device shown by FIG. 59 where the other one of the feeding conductor films is formed.

An antenna device 920 shown by FIG. 59 is provided with a dielectric base body 921 in a rectangular parallelepiped shape having an upper face and a lower face in a square shape. Two ends 922*a* and 922*b* adjacent to each other as shown by FIG. 60 are provided on the upper face of the dielectric base body 921 and a radiating conductor film 922 connecting two ends 922*a* and 922*b* in a loop-like shape are formed along four sides of the upper face. The radiating conductor film 922 is of an open loop shape where the two ends 922*a* and 922*b* are electrically opened and the length of the loop is adjusted to a length of the resonance wavelength of electromagnetic wave that is an object of transmission. A grounding conductor film 923 extending on the lower face as shown by FIG. 61 is formed on the lower face of the dielectric base body 921 and the grounding conductor film 923 is provided with a shape where a portion of one side is notched. Further, as shown by FIG. 62 and FIG. 63, two feeding conductor films 924 and 925 are formed on the side faces of the dielectric base body 921. As shown by FIG. 59, the two feeding conductor films 924 and 925 are formed to extend in the up and down direction in parallel with each other respectively on both sides of a side 926 that is shown on this side of FIG. 59 among four sides partitioning vertically the side faces. The feeding conductor films 924 and 925 are respectively connected to the ends 922*a* and 922*b* of the radiating conductor film 922. The feeding conductor film 925 is connected to the grounding conductor film 923 and the feeding conductor film 924 extends to the lower face of the dielectric base body 921 as shown by FIG. 61.

The antenna device 920 constituted as described above, is provided with a single wavelength loop antenna structure since it has the radiating conductor film 922. Therefore, electromagnetic waves radiated from the radiating conductor film 922 have maximum gain oriented perpendicularly to the upper face of the dielectric base body 921. The radiating conductor film 922 is formed on the upper face of the dielectric base body 921 and the grounding conductor film 923 is formed on the lower face of the dielectric base body 921. Therefore, electromagnetic waves progressing toward the grounding conductor film 923 among the electromagnetic waves radiated from the radiating conductor film 922, are reflected by the grounding conductor film 923. Accordingly, the electromagnetic waves having maximum gain in a direction from the grounding conductor film 923 to the radiating conductor film 922 can be efficiently used in communications.

Further, according to the antenna device 920, the two feeding conductor films 924 and 925 are formed respectively on both sides of the side 926 of the side faces of the dielectric base body 921 and accordingly, a distance between the feeding conductor films becomes shorter than that between two feeding conductor films formed on the same side face by which the effective dielectric constant can be enhanced. Accordingly, in respect of the antenna device 920, compared with an antenna device where two feeding conductor films are formed on the same side face, the width S of the feeding conductor film in Equation (2) can be narrowed whereby even in the case where the gap width between the two feeding conductor films 924 and 925 is wide, the impedance of the radiating conductor film can be matched with the impedance of the feeding conductor films.

An explanation will be given of the fabrication method of the antenna device 920 shown by FIG. 59 through FIG. 63.

First, the material of the dielectric base body 921 is selected. A material having a dielectric constant in a range from 10 through 100 in a frequency band of transmitted and received electromagnetic waves, is preferred. For example, a $Sr(Ni_{1/3}Nb_{2/3})O_3$ group ceramic may be utilized. This material has a dielectric constant of 31 when the transmitted and received electromagnetic waves have a frequency of 3.8 GHz and a Q value of 1800.

Next, dimensions of the radiating conductor film 922, the two feeding conductor films 924 and 925 and the dielectric base body 921 are determined. The dimensions can be determined as follows. When the length of the loop of the radiating conductor film 922 is designated by notation λ, λ can be represented by Equation (4). Equation (4) is shown below.

$$\lambda = \lambda_0 \Big/ \sqrt{(\varepsilon_{reff})} \tag{19}$$

where $\lambda_0$ is wavelength of electromagnetic wave in vacuum and $\in_{reff}$ is effective dielectric constant.

Here, the effective dielectric constant $\in_{reff}$ in Equation (19) can be represented by the following equation in consideration of the fact that the radiating conductor film 922 is formed on the upper face of the dielectric base body 921, electromagnetic wave radiated from the radiating conductor film 922 is radiated perpendicularly to the upper face of the electromagnetic base body 921 and electric fields are generated at the inside and the outside of the radiating conductor film 922.

$$\in_{reff}=(\in_r+3)/4 \tag{20}$$

where $\in_r$ is a dielectric constant of dielectric base body.

Therefore, the length λ of the radiating conductor film 922 can be calculated by substituting the effective dielectric constant $\in_{reff}$ calculated by Equation (20) for Equation (19).

Here, in order to set a resonance frequency of electromagnetic wave to 1.9 GHz, the length λ of the loop of the radiating conductor film 922 is determined as λ=54.16 mm. Further, although impedance of a single wavelength loop antenna is generally as high as 100Ω or higher, the impedance of antenna device 920 can be lowered by adjusting the width of a radiating conductor film and the gap width between two ends of the radiating conductor film, thereby promoting electrical feed efficiency. In this case, in order to set the impedance to 50Ω, the width of the radiating conductor film 922 is set to 1.5 mm and the gap width is set to 0.75 mm.

Both of the length and the width of the dielectric base body 921 are set to 14.54 mm in accordance with the dimensions of the radiating conductor film which has been determined as described above. With respect to the thickness of the dielectric base body 921, a distance from the radiating conductor film 922 to the grounding conductor film 923 is set to 7.09 mm corresponding to a quarter of the resonance wavelength of electromagnetic wave having the resonance frequency of 1.9 GHz in the dielectric base body.

Further, a desired impedance of the feeding conductor film can be provided by adjusting the width of the feeding conductor film and the gap width between the feeding conductor films. In this case, the width of the feeding conductor film is set to 2.0 mm and the gap width is set to 0.75 mm.

Next, the dielectric base body 921 having the above described dimensions are fabricated and a pattern of the grounding conductor film 923 and patterns of the radiating conductor film 922 and the two feeding conductor films 924 and 925 having the above-described dimensions, are printed on the dielectric base body 921 by the thick film printing process by using a copper paste and sintered in a reducing atmosphere.

Figure 64:
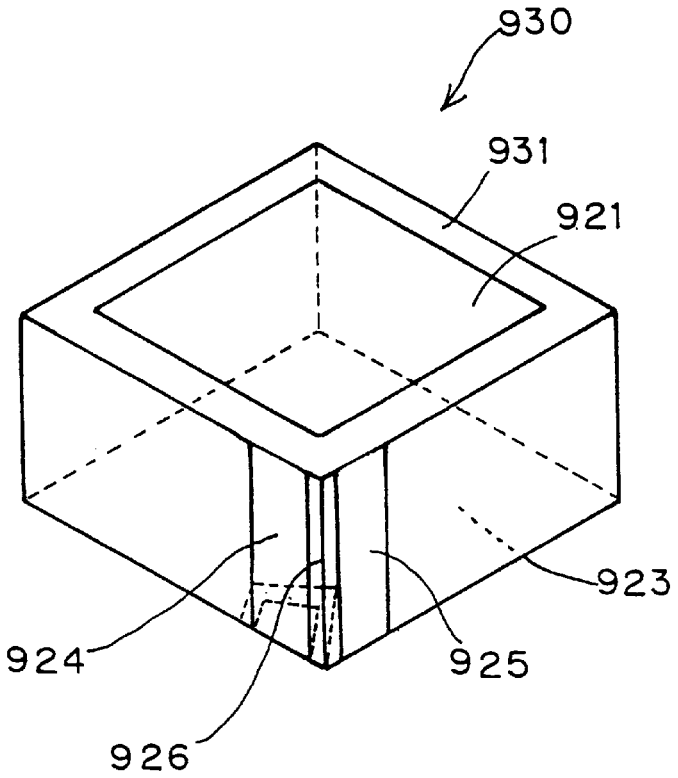
FIG. 64 is a view showing an antenna device according to Embodiment 21 of the present invention.
Figure 65:
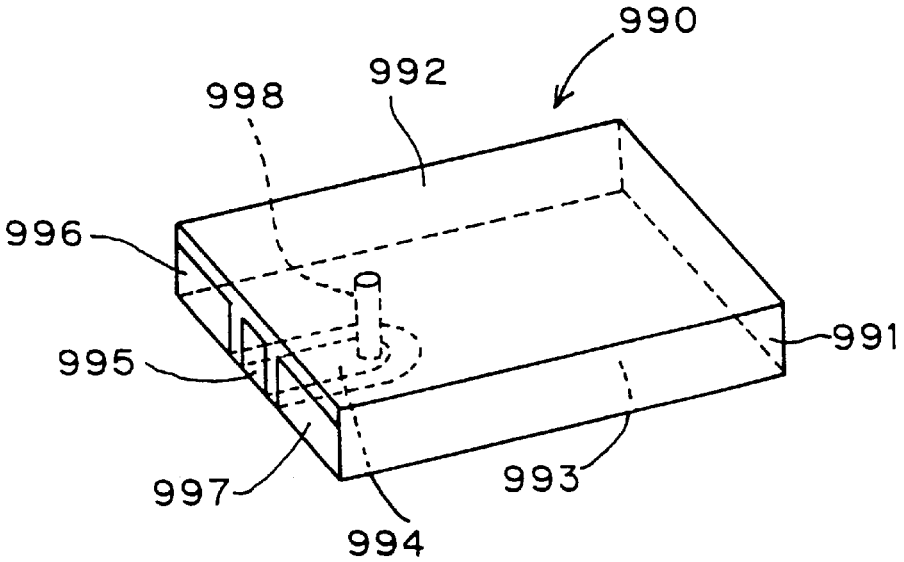
PRIOR ART FIG. 65
FIG. 65 is a perspective view showing an antenna device proposed in Japanese Unexamined Patent Publication No. JP-A-7-235825.
Figure 66:
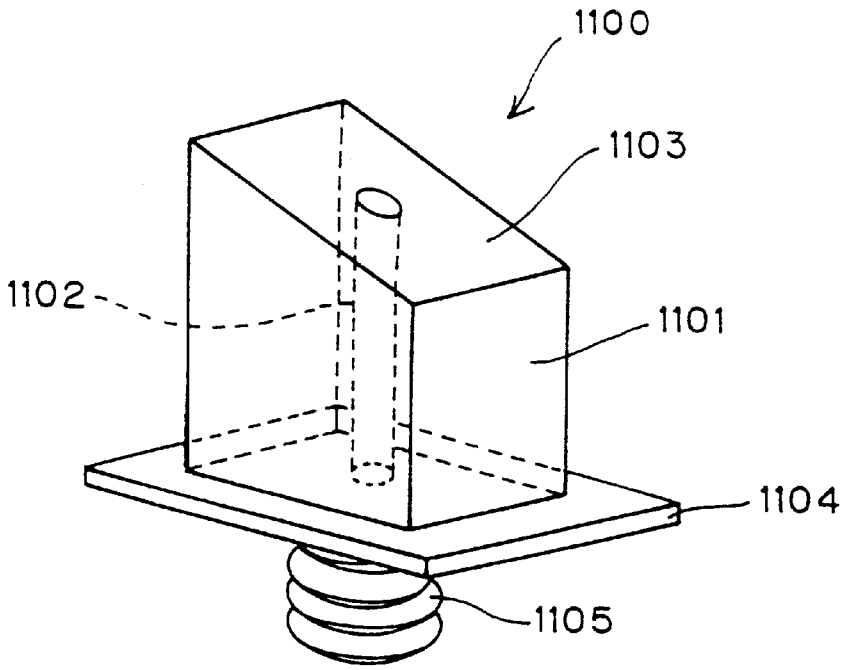
PRIOR ART FIG. 66
FIG. 66 is a perspective view showing an antenna device proposed in Japanese Unexamined Patent Publication No. JP-A-7-283639.
Figure 67:
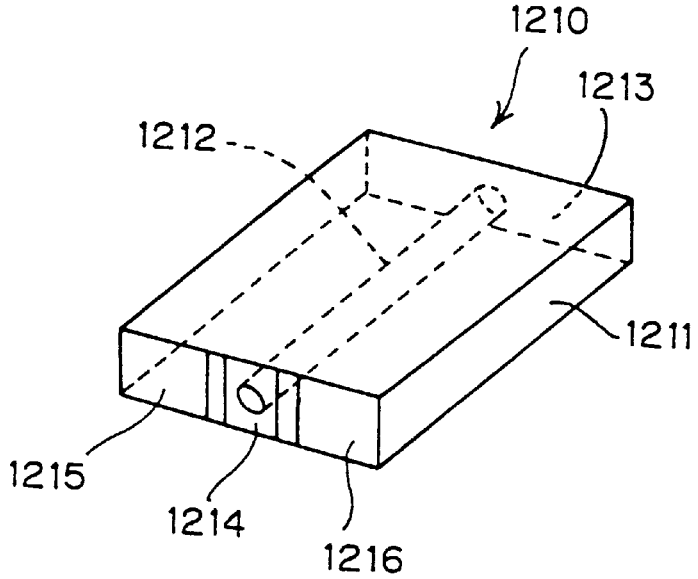
PRIOR ART FIG. 67
FIG. 67 is a perspective view showing an antenna device proposed in Japanese Unexamined Patent Publication No. JP-A-7-221537.

FIG. 64 is a view showing an antenna device 930 according to Embodiment 21 of the present invention.

The same numbers are attached to constituent elements the same as the constituent elements of the antenna device 920 shown by FIG. 59 through FIG. 63 and an explanation will be given of only differences therebetween.

A radiating conductor film 931 in a closed loop shape where a strip-like conductor film turns around along four sides of the upper face of the dielectric base body 921, is formed on the upper face of the dielectric base body 921 constituting an antenna device 930 shown by FIG. 64.

As has been explained, according to the antenna device of the present invention, radiated electromagnetic waves are efficiently used in communication.

We claim:

1. An antenna device comprising:

a dielectric base body having an upper face and a lower face in parallel with each other;

a radiating conductor film formed on the upper face of the dielectric base body, having two ends adjacent to each other, to form a loop;

a grounding conductor film formed on the lower face of the dielectric base body and extending in a planar shape; and feeding conductor films formed on a side face of the dielectric base body, respectively connected to the two ends of the radiating conductor film and extending in an up and down direction in parallel with each other, one of said feeding conductor films being connected to the grounding conductor film.

2. The antenna device according to claim 1, wherein the feeding conductor films also serve as electrodes for mounting the antenna device onto a surface of a circuit board.

3. An antenna device comprising:

a dielectric base body having an upper face and a lower face in which a through hole connecting the upper face and the lower face is formed;

a monopole conductor filled in the through hole forming a quarter length monopole antenna structure;

a loop conductor film formed on the upper face, having two ends adjacent to each other to form a loop, one of said two ends being connected to the monopole conductor; and a grounding conductor film extending on the lower face.

4. The antenna device according to claim 3, further comprising:

a coaxial connector having a central conductor connected to the monopole conductor from a side of the lower face and an external conductor connected to the grounding conductor extending on the lower face.

5. The antenna device according to claim 3, further comprising:

a signal line one end of which is connected to the monopole conductor on the lower face and forming coplanar lines along with the grounding conductor on the lower face;

a feed terminal formed on a side face of the dielectric base body where the feed terminal is formed and connected to the grounding conductor.

6. An antenna device comprising:

a dielectric base body having a lower face and side faces;

a grounding conductor film formed on the lower face and extending in a planar shape;

a radiating conductor film formed on the side faces, having two ends adjacent to each other in a left and right direction and connecting the two ends by horizontally turning around the side faces; and first and second feeding conductor films formed on the side faces, extending in an up and down direction in parallel with each other, said first feeding conductor film being connected to one of the two ends, said second feeding conductor film connected to another one of the two ends and being connected to the grounding conductor film.

7. The antenna device according to claim 6, wherein the two feeding conductor films also serve as electrodes for mounting the antenna device onto a surface of a circuit board.

8. An antenna device comprising:

a dielectric base body having a lower face;

a grounding conductor film formed on the lower face of the dielectric base body and extending in a planar shape;

a radiating conductor film formed at an inner portion of the dielectric base body, having two ends adjacent to each other to form a loop on a horizontal plane;

two inner feeding conductor films formed at an inner portion of the dielectric base body and respectively connected to the two ends of the radiating conductor film, each extending to a side face of the dielectric base body; and two side face feeding conductor films formed on the side face of the dielectric base body, extending in an up and down direction in parallel with each other and respectively connected to the inner feeding conductor films being connected to the grounding conductor film.

9. The antenna device according to claim 8, wherein the side face feeding conductor films also serve as electrodes for mounting the antenna device onto a surface of a circuit board.

10. An antenna device comprising:

a dielectric base body having an upper face and a lower face extending horizontally;

a grounding conductor film formed on the lower face of a dielectric base body and extending in a planar shape;

a first loop radiating conductor film formed on the upper face of the dielectric base body and making a turn on the upper face such that two ends opposed to each other across a predetermined first gap are formed;

a second loop radiating conductor film formed at an inner portion of the dielectric base body and making a turn on a horizontal plane such that two ends opposed to each other across a second gap are formed, said second gap having a direction different from a direction of the first gap, each of said directions being determined by a line intersecting a midpoint of a respective gap and a midpoint of a respective loop of a respective radiating conductor film;

two first feeding conductor films respectively connected to the two ends of the first loop radiating conductor film, extending in parallel with each other, one of said two first feeding conductor films being connected to the grounding conductor film; and two second feeding conductor films respectively connected to the two ends of the second loop radiating conductor film, extending in parallel with each other on a side face of the dielectric base body, one of said two second feeding conductor films being connected to the grounding conductor film.

11. The antenna device according to claim 10, wherein said direction of said first gap and said direction of said second gap are different from each other by 90° in a horizontal plane.

12. The antenna device according to claim 10, wherein the feeding conductor films also serve as electrodes for mounting the antenna device onto a surface of a circuit board.

13. An antenna device comprising:

a dielectric base body having an upper face, a lower face and side faces;

a grounding conductor film formed on the lower face of the dielectric base body;

four radiating conductor films formed on the upper face or the side faces of the dielectric base body, extending in an horizontal direction, contiguous ends of said four radiating conductor films being opposed to each other via gaps, said four radiating conductor films making a turn by forming four of the gaps at equal intervals; and eight feeding conductor films respectively connected to respective ends of the four radiating conductor films and extending in an up and down direction.

14. The antenna device according to claim 13, wherein the feeding conductor films also serve as electrodes for mounting the antenna device onto a surface of a circuit board.

15. An antenna device comprising:

a dielectric base body;

a first radiating conductor film in a closed loop shape formed on the dielectric base body and making a turn horizontally;

a grounding conductor film formed on the dielectric base body and extending horizontally; and a pair of first feeding conductor films extending in an up and down direction in parallel with each other via a side face of the dielectric base body and connected to the first radiating conductor film.

16. The antenna device according to claim 15, wherein the first radiating conductor film is a radiating conductor film in a closed loop shape making a turn on an upper face of the dielectric base body.

17. The antenna device according to claim 15, wherein the first radiating conductor film is a radiating conductor film in a closed loop shape turning around horizontally side faces of the dielectric base body.

18. The antenna device according to claim 15, wherein the first radiating conductor film is a radiating conductor film in a closed loop shape making a turn on a horizontal plane at an inner portion of the dielectric base body.

19. The antenna device according to claim 15, further comprising:

a second radiating conductor film in a closed loop shape horizontally making a turn in addition to the first radiating conductor film at a position of the dielectric base body different from a position where the first radiating conductor film is formed; and a pair of second feeding conductor films extending in the up and down direction in parallel with each other via positions of a side face of the dielectric base body different from positions where the pair of first feeding conductor films are formed and connected to the second radiating conductor film.

20. The antenna device according to claim 15, wherein a total of four pairs of feeding conductor films including the pair of first feeding conductor films are formed, two feeding conductor films of each pair of feeding conductor films being connected to the radiating conductor film at one of position equally dividing by four an interval turning around the first radiating conductor film and extending in the up and down direction in parallel with each other.

21. An antenna device comprising:

a dielectric base body having an upper face and a lower face and side faces partitioned by a side extending vertically;

a radiating conductor film in a loop formed on the upper face of the dielectric base body;

a grounding conductor film formed on the lower face of the dielectric base body and extending on the lower face; and two feeding connector films respectively formed on both sides of the side on the side faces of the dielectric base body, respectively connected to the radiating conductor film, extending in an up and down direction in parallel with each other, one of said two feeding conductor films being connected to the grounding conductor film.

22. The antenna device according to claim 21, wherein the radiating conductor film is provided with an open loop shape where points of connecting the radiating conductor film to the two feeding conductor films are electrically opened each other.

23. The antenna device according to claim 22, wherein the radiating conductor film is provided with a closed loop shape where a conductor film in a strip shape turns around.

* * * * *